US005604036A

United States Patent [19]

Price et al.

[11] Patent Number: 5,604,036

[45] Date of Patent: Feb. 18, 1997

[54] HOLLOW NYLON FILAMENTS

[75] Inventors: David A. Price, Smyrna, Del.; James P. Bennett, Hixson, Tenn.; Benjamin H. Knox, Wilmington, Del.; Dennis R. Schafluetzel, Hixson, Tenn.

[73] Assignee: E. I. Du Pont de Nemours and Company, Wilmington, Del.

[21] Appl. No.: 473,823

[22] Filed: Jun. 7, 1995

Related U.S. Application Data

[60] Division of PCT/US95/03227 March 14, 1995 which is a continuation-in-part of Ser. No. 213,307, Mar. 14, 1994, Pat. No. 5,439,626.

[51] Int. Cl.[6] ..... D02G 3/00

[52] U.S. Cl. ..... 428/376; 428/397; 428/398

[58] Field of Search ..... 428/376, 397, 428/398

[56] References Cited

U.S. PATENT DOCUMENTS

| | | | |
|---|---|---|---|
| 3,728,428 | 6/1971 | Turner | 264/177.14 |
| 3,745,061 | 7/1971 | Champaneria et al. | 428/398 |
| 3,924,988 | 5/1972 | Hodge | 425/461 |
| 4,444,710 | 2/1982 | Most, Jr. | 264/209.5 |
| 4,548,866 | 10/1983 | Cordova et al. | 428/398 |
| 4,770,938 | 9/1988 | Peterson et al. | 428/398 |
| 4,992,332 | 2/1991 | Kamei et al. | 428/376 |
| 5,104,725 | 4/1992 | Broaddus | 428/376 |
| 5,322,736 | 6/1994 | Boyle et al. | 428/398 |
| 5,356,582 | 10/1994 | Aneja et al. | 264/103 |
| 5,419,964 | 5/1995 | Boles, Jr. et al. | 428/398 |
| 5,458,971 | 10/1995 | Hernandez et al. | 428/398 |

FOREIGN PATENT DOCUMENTS

| | | |
|---|---|---|
| 58-22575 | 5/1983 | Japan . |
| 838141 | 10/1958 | United Kingdom . |
| 1160263 | 1/1967 | United Kingdom . |

OTHER PUBLICATIONS

Translation of Japan 59–49,328 (Published Dec. 1, 1984).

*Primary Examiner*—Newton Edwards

[57] ABSTRACT

A melt spinning process and the nylon hollow filaments and yarns made by such process which includes extruding molten nylon polymer having a relative viscosity (RV) of at least about 50 and a melting point ($T_M$) of about 210° C. to about 310° C. from a spinneret capillary orifice with multiple orifice segments providing a total extrusion area (EA) and an extrusion void area (EVA) such that the fractional extrusion void content, defined by the ratio [EVA/EA] is about 0.6 to about 0.95, and the extent of melt attenuation, defined by the ratio [EVA/$(dpf)_S$], is about 0.05 to about 1.5, in which $(dpf)_S$ is the spun denier per filament, the $(dpf)_S$ being selected such that the denier per filament at 25% elongation $(dpf)_{25}$ is about 0.5 to about 20 denier; withdrawing the multiple melt streams from the spinneret into a quench zone under conditions which causes substantially continuous self-coalescence of the multiple melt streams into spun filaments having at least one longitudinal void and a residual draw ratio (RDR) of less than 2.75; and stabilizing the spun hollow filaments to provide hollow filaments with a residual draw ratio (RDR) of about 1.2 to about 2.25.

14 Claims, 28 Drawing Sheets

HOLLOW NYLON FILAMENTS

This application is a division of PCT International Application No. PCT/US95/03227, filed Mar. 14 1995, which is a continuation-in-part of U.S. application Ser. No. 08/213,307, filed Mar. 14, 1994, now U.S. Pat. No. 5,409,621.

TECHNICAL FIELD

This invention relates to nylon filaments having one or more longitudinal void and particularly to a process capable of providing high quality continuous hollow nylon filaments and yarns at commercially-useful speeds, and more particularly relates to hollow filaments which have a desired filament void content, which retain their void content on drawing and which have other useful properties.

BACKGROUND OF THE INVENTION

Nylon flat and bulky continuous filament yarns have many desirable properties. However, the nylon continuous filament yarns in widespread commercial use are almost exclusively solid filament yarns with no interior voids. Yarns containing hollow filaments, i.e., filaments that have at least one longitudinal void, can provide fabrics which are lighter in weight but provide the same cover (fabric opacity) and enhanced heat retention as heavier weight conventional fabrics, i.e., higher heat retention determined as CLO values. In addition, these flat filament yarns can provide a distinctive luster in fabric and when textured can provide cotton-like fabric aesthetics. However, hollow filaments having sufficient mechanical quality for end-use processing without broken filaments is required for successful use in downstream textile processing, such as texturing (if a bulky yarn is desired), slashing, warping, beaming, knitting, weaving, dyeing and finishing. Poor mechanical quality can lead to filament fracture and/or filament fibrillation which may be undesired during initial end-use processing; but may be desirable during such fabric finishing processes, as brushing and sanding to provide suede-like fabric surfaces. A balance between mechanical quality for processing into fabrics prior to finishing of the fabric surfaces, high void content for reduced fabric weight and other features, such as dye uniformity, are required for hollow filament yarns to be commercially useful. It is also important for some critical nylon end-uses to maintain physical uniformity, both along-end and between the various filaments, because such non-uniformity often shows up in the eventual dyed fabrics as dyeing defects and/or as broken filaments after textile end-use processing.

Processes are known for producing nylon hollow filaments; however, such processes are typically low speed spinning processes which require a separate (split) or in-line (coupled) drawing step with a high process draw ratio (PDR). In a coupled spin/draw process the speed of the yarn entering the draw zone (feed roll speed) is typically less than 1000 meters per minute (mpm) and such processes therefore have low spinning productivity ($P_S$), and further, such known processes for making hollow filaments have not been able to provide the desired combination of mechanical quality, void content, and/or dye uniformity.

SUMMARY OF THE INVENTION

Processes in Accordance with the Invention

The invention provides a melt spinning process for making nylon hollow filaments that includes extruding molten nylon polymer having a relative viscosity (RV) of at least 50 and a melting point ($T_M$) of about 210° C. to about 310° C. from a spinneret capillary orifice with multiple orifice segments providing a total extrusion area (EA) and an extrusion void area (EVA) such that the fractional extrusion void content, defined by the ratio [EVA/EA] is about 0.6 to about 0.95, and the extent of melt attenuation, defined by the ratio [EVA/$(dpf)_S$], is about 0.05 to about 1.5, in which $(dpf)_S$ is the spun denier per filament, the $(dpf)_S$ being selected such that the denier per filament at 25% elongation $(dpf)_{25}$ is about 0.5 to about denier 20; withdrawing the multiple melt streams from the spinneret into a quench zone under conditions which causes substantially continuous self-coalescence of the multiple melt streams into spun filaments having at least one longitudinal void and a residual draw ratio (RDR) of less than 2.75; and stabilizing the spun hollow filaments to provide hollow filaments with a residual draw ratio (RDR) of about 1.2 to about 2.25.

In accordance with the preferred form of the invention, the process provides the spun filaments which have a fractional void content (VC) at least [(7.5Log$_{10}$(dpf)+10)/100], more preferably at least [(7.5Log$_{10}$(dpf) +15)/15)/100]. It is also preferred for the process to provide a void retention index (VRI) of at least about 0.15, most preferably also at least the value of the expression $$n\left\{K_1\left[RV\cdot\left(\frac{T_M+25}{T_P}\right)^6\right]\cdot\left[\frac{(dpf)_S\cdot V_S}{1-\frac{EVA}{EA}}\right]^{1/2}\cdot\left[\frac{H}{W}\right]^{0.1}\cdot[QF]^{0.2}+K_2\right\},$$

wherein n is 0.7, $K_1$ is $1.7\times10^{-5}$, $K_2$ is 0.17, $T_P$ is the spin pack temperature, $V_S$ is the withdrawal speed form the spinneret, H and W are the height and width, respectively, of the spinneret capillary orifice and QF is the quench factor.

In accordance with the invention, it is preferred for the process to provide a value for the base 10 logarithm of the apparent spin stress ($\sigma_a$) of between 1 and 5.25.

It is also preferred for the filaments as spun to have a normalized tenacity at break $(T_B)_n$ of at least 4 g/dd, most preferably, the filaments also have a normalized tenacity at break in g/dd of at least the value of the expression $\{4\cdot[(1-\sqrt{VC})/(1+\sqrt{VC})]+3\}$, wherein VC is the fractional void content of the filaments.

The process of the invention is advantageously used to produce feed yarns with a residual draw ratio (RDR) of 1.6 to 2.25, or when a drawing step is used, to produce a drawn yarn with a residual draw ratio (RDR) of 1.2 to 1.6. Drawing and bulking steps are used in accordance with the invention when a bulked yarn with a residual draw ratio (RDR) of 1.2 to 1.6 is desired.

In accordance with another form of the invention, the spinneret capillary orifice provides filaments which comprise a longitudinal void asymmetric with respect to the center of the filament cross-section such that the filaments will self helical crimp on exposure to heat.

Preferably, the nylon polymer used has a melting point of about 240° C. to about 310° C. It is especially preferred for such nylon polymer to be comprised of 30 to 70 amine-end equivalents per $10^6$ grams of nylon polymer and for the hollow filaments have a small-angle x-ray scattering intensity ($I_{saxs}$) of at least 175, a wide angle x-ray scattering crystalline orientation angle ($COA_{waxs}$) of at least 20 degrees and a large molecule acid dye transition temperature ($T_{dye}$) of less than 65° C.

In another preferred form of the invention, the nylon polymer contains a sufficient quantity of at least one bi-functional comonomer to provide a filament boil-off shrinkage (S) of at least 12%. Such higher shrinkage filaments are advantageously used in one preferred yarn in accordance with the invention also having lower shrinkage filaments with a boil-off shrinkage of less than 12%, the difference in shrinkage between at least some of the higher shrinkage filaments and at least some of the lower shrinkage filaments being at least 5%.

In accordance with another preferred form of the process of the invention, the nylon polymer has a relative viscosity of at least 60, most preferably at least 70.

Products in Accordance with the Invention

In accordance with the invention, hollow filaments of nylon polymer are provided having a relative viscosity (RV) of at least 50 and a melting point ($T_M$) between 210° C. and 310° C., said filaments having a denier per filament (dpf) such that the denier per filament at 25% elongation $(dpf)_{25}$ is about 0.5 to denier 20 and having at least one longitudinal void such that the fractional void content (VC) is at least $[(7.5\text{Log}_{10}(dpf)+10)/100]$, the filaments having a residual draw ratio (RDR) of 1.2 to 2.25 and a small-angle x-ray scattering intensity ($I_{saxs}$) of at least about 175.

In accordance with a preferred form of the invention, the filaments have a fractional void content (VC) of at least $[(7.5\text{Log}_{10}(dpf)+15)/100]$.

In accordance with a preferred form of the invention, the filaments have a wide-angle x-ray scattering crystalline orientation angle ($COA_{waxs}$) of at least about 20 degrees.

In accordance with a preferred form of the invention, the filaments have a normalized tenacity at break of at least about 4 g/dd, most preferably also at least the value in g/dd of the expression $\{4\cdot[(1-\sqrt{VC})/(1+\sqrt{VC})]+3\}$, wherein VC is the fractional void content of the filaments.

In accordance with a preferred form of the invention in which the filaments are particularly suitable for dyeing with large molecule acid dyes, the nylon polymer contains about 30 to about 70 amine-end equivalents per $10^6$ grams of nylon polymer and the hollow filaments have a large molecule acid dye transition temperature ($T_{dye}$) of less than about 65° C.

In accordance with another preferred form of the invention, the nylon polymer has a relative viscosity of at least about 60, most preferably at least about 70.

In accordance with another form of the invention, a woven fabric is provided which is made from yarns of thermoplastic polymer filaments arranged in warp and fill directions, at least some of the filaments of the yarns are hollow filaments having at least one longitudinal void. In the fabric, at least a majority of the hollow filaments are collapsed to form collapsed hollow filaments having an oblong exterior cross-section with major and minor dimensions. The major dimension of the cross-section of at least a majority of the collapsed hollow filaments are generally aligned with having front and back surfaces of the fabric.

In accordance with a preferred form of the invention, all of the filaments of the yarns in one of the warp and fill directions are hollow filaments having at least one longitudinal void.

Preferably, the thermoplastic polymer comprising the filaments is nylon polymer.

BRIEF DESCRIPTION OF THE DRAWINGS

FIG. 1A—round filament with a concentric longitudinal void; FIG. 1B—trilobal filaments with a concentric longitudinal void; FIG. 1C—round filaments with a large longitudinal void which may take on non-round shapes and may collapse to form cotton-like cross-sectional shapes; FIG. 1D—incomplete self-coalescence providing "opens"); FIG. 1E—false-twist textured filaments wherein the void is collapsed and resembles the filament cross-sections of cotton (FIG. 1G); FIG. 1F—air-jet textured filaments showing that the voids are partially collapsed (i.e., a thin void "strip" is visible) and resemble the filament cross-sections of cotton (FIG. 1G); FIG. 1H—bundle of cut (uncrimped) hollow staple fibers; FIG. 1I—bundle of cut/crimped hollow fibers with a partially collapsed void; FIG. 1J—trilobal hollow filament wherein the sides are not completely coalesced, if desired; FIG. 1K—a completely coalesced filament having a novel "sponge-like" cross-section "texture"; and FIG. 1L are asymmetric hollow filaments which self-crimp on relaxation of spinning stress and further relax and crimp after boil-off.

As shown in FIG. 2 in broken lines, the yarn is stabilized to reduce its residual draw ratio (RDR) to about 1.2 to about 2.25 which may be performed by means of a number of different alternatives. "Stabilization" can be accomplished as indicated in Alternative A by exposing the spun yarn to steam in a steam chamber 4 as disclosed in U.S. Pat. No. 3,994,121 or passing the yarn through a steamless, heated tube as disclosed in U.S. Pat. No. 4,181,697. The yarn then passes through puller and letdown rolls, 5 and 6, respectively, although it is not drawn to any substantial extent. Alternative B indicates a set of puller and letdown rolls 5 and 6 which are driven at essentially the same speed as the wind-up and thus there is no substantial drawing the yarn between these rolls and the windup. Stabilization is thereby imparted by the high spinning speed as in Alternative C. The rolls 5 and/or 6 may be heated if desired for the purpose of stabilizing the yarn shrinkage. Alternative C is a "godetless" process in which the yarn is not contacted by rolls between the spinneret and the wind-up. The selection of the withdrawal speed ($V_S$), nylon polymer, and melt attenuation ratio $[(EVA/(dpf)_S]$ provide an apparent spin stress ($\sigma_a$) that is sufficient to impart a level of spin orientation (birefringence) which initiates crystallization to filaments in spinning that stabilizes the spun yarn without other separate stabilization steps being required. Yarns produced by Alternatives B and C are often referred to as spin-oriented or "SOY" yarns. Alternative D illustrates the use of "partial drawing" to stabilize the yarns. Before the letdown rolls 6, feed rolls 7 and draw rolls 8 draw the yarn sufficiently for stabilization. Yarns produced by Alternative D are often referred to as "partially-drawn" or "PDY" yarns. Fully drawn yarns may be formed by Alternate D by selecting a ratio of roll speeds to provide a PDR such that drawn yarn has a $(RDR)_D$ of about 1.2 to about 1.4. In the preferred processes in accordance with the invention, the feed yarns undergo drawing and relaxing in split or in coupled processes, which may include a texturing (bulking) component (not shown in FIG. 2 schematic) to provide drawn flat and bulky (textured) filament yarns. The yarns are interlaced at interlace jet 9 so that the yarns have sufficient degree of interlace to enable efficient wind-up of the yarns at wind-up 10 and removal of the yarns from the bobbin and as required for subsequent textile processes.

Figure 4A:
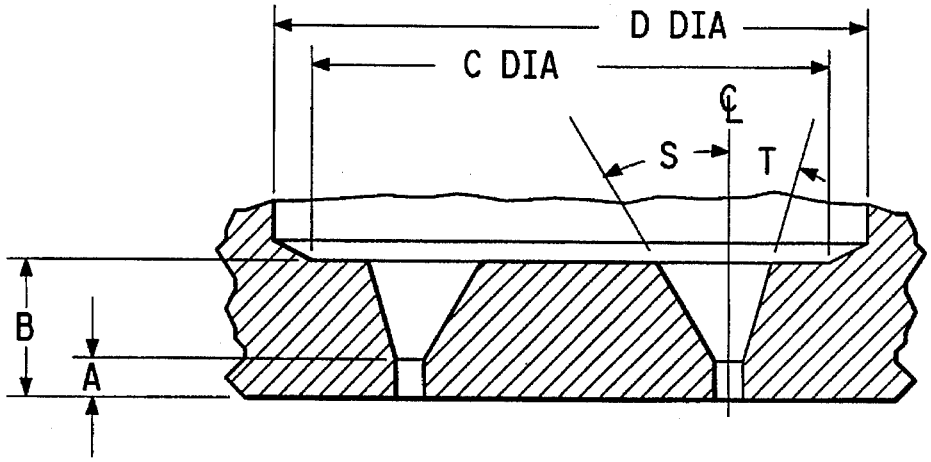
FIGS. 4A, 5A, and 6A are schematics representative of the vertical plane of the spinneret capillary and counter bore
Figure 5A:
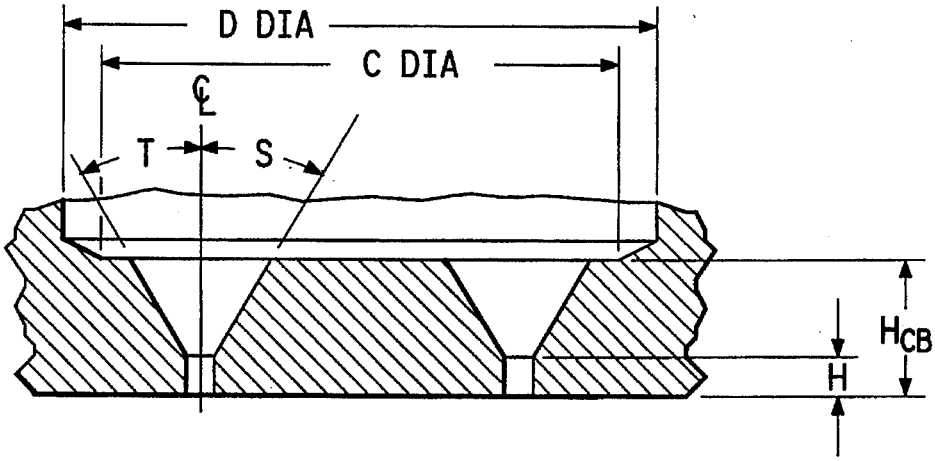
Figure 6A:
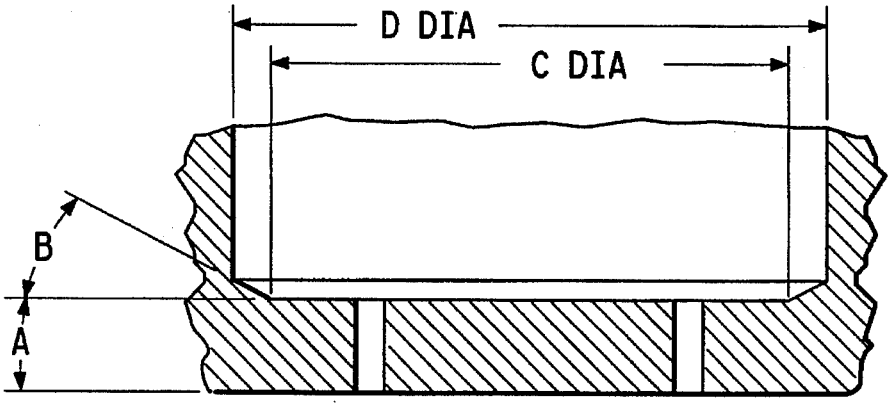

The arc-shaped orifice capillaries have a height H and polymer is fed into the orifice capillaries from either cone-shaped counter bores of height ($H_{CB}$), where the total counter bore entrance angle, (S+T) is comprised of S the inbound entrance angle and T the outbound entrance angle from centerline ℄, as in FIG. 4A for S>T and in FIG. 5A for S=T; or by use of straight wall reservoir counter bores (FIG. 6A) having a short angled section at the bottom of the reservoir where the reservoir joins the orifice capillary of height (H) and further, if required, the entrance of the orifice capillaries in FIG. 6A may be chamfered for more uniform flow. The orifice capillary in FIG. 6A preferably has an orifice capillary height-to-width ratio (H/W) typically at least about 1.33, more preferably at least 2, and most preferably at least 3, to provide improved uniform metering of the polymer (i.e., via high capillary pressure drop). To provide the sufficient pressure drop required for uniform polymer flow when using orifice capillaries with H/W-ratios of less than 2 (such as shown in FIGS. 4A and 5A) a metering capillary (typically round in cross-section) of height $H_{mc}$ and diameter $D_{mc}$ (not shown in FIGS. 4A and 5B) may be positioned above (or incorporated as part of) the counter bores wherein the pressure drop of the round metering capillaries is proportional to the expression $[H/D^4]_{mc}$. As the orifice capillary height (H) is increased, such as shown in FIG. 6A, the need for an "extra" metering capillary becomes less important as well as the criticality of the values and symmetry of the entrance angles of the spinnerets using cone-like counter-bores (FIG. 4A and 5A); and if desired, the metering capillaries may also have different $H_{mc}$ and $D_{mc}$ values so to provide different capillary mass flow rates, i.e., hollow filaments of different spun dpf from the same spinneret, where $[(dpf)(H/D^4)]_{mc,1} \sim [(dpf)(H/D^4)]_{mc,2}$ and $(dpf)_1/(dpf)_2 \sim (H/D^4)_{mc,2}/(H/D^4)_{mc,1}$; and more generically $(dpf)_1/(dpf)_2 = (H/area^2)_2/(H/area^2)_1$, where for slot-shaped capillary, the area is given by W×L. Further, the orifice comprising said segmented capillary may differ in dimensions and arrangement to provide filaments of different shape and/or having the capability to self crimp on exposure to heat.

Figure 8:
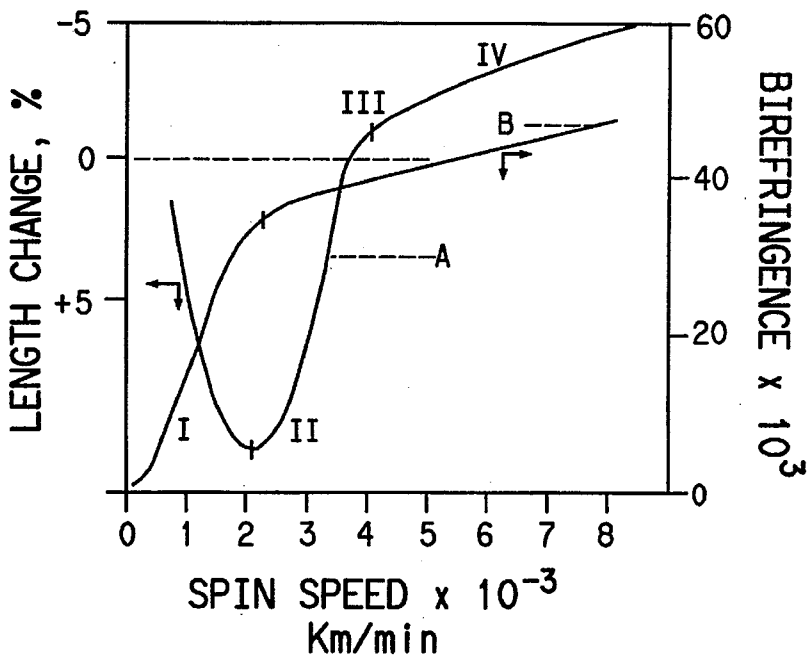
Figure 7:
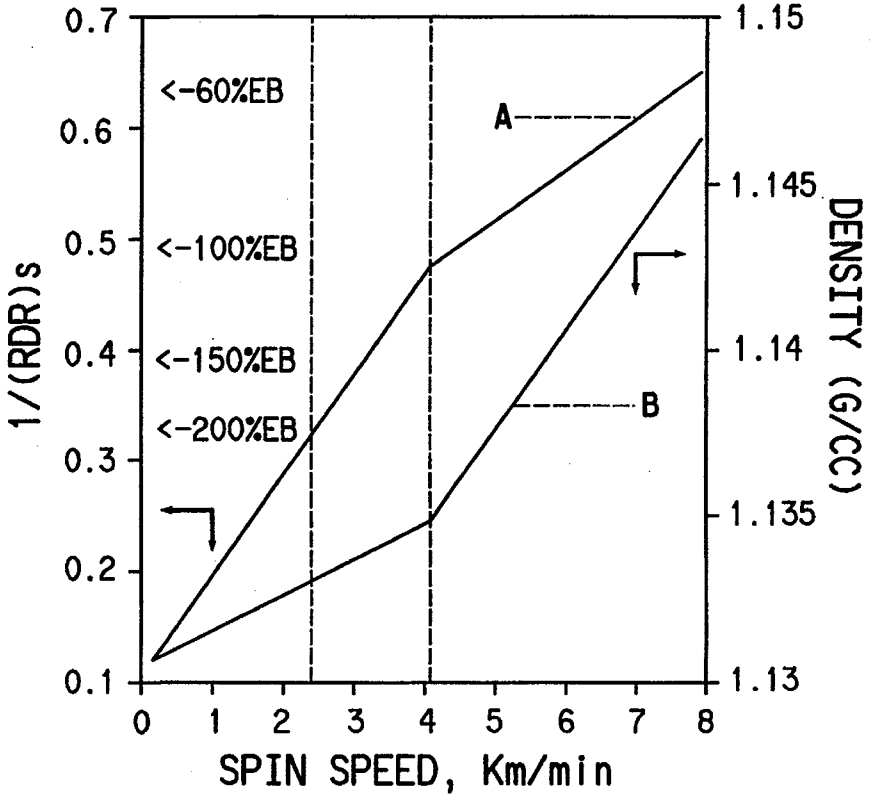

FIGS. 7 and 8 are plots of important as-spun nylon 66 yarn properties versus spin speed ($V_S$), and the general behavior is also found for nylon 6. FIG. 7 (Lines A and B) are representative plots of the residual draw ratio $(RDR)_S$, expressed by its reciprocal, $1/(RDR)_S$ and of density versus ($V_S$), respectively, with a change in rate of change in $1/(RDR)_S$ and density observed at an $(RDR)_S$ of about 2.25. The spin speed at which the transition in behavior occurs is dependent on, for example, nylon polymer type and RV, rate of quenching and $(dpf)_S$. Above the transition point (i.e., $(RDR)_S \leqq 2.25$), no thermal/mechanical stabilization is usually required to provide a stable yarn package. Below the transition point (i.e., $(RDR)_S \geqq 2.25$) the spun yarn usually requires further stabilization. The apparent transition in behavior for hollow filaments corresponding to $(RDR)_S$ of 2.25 occurs at lower $V_S$ than is observed for solid filaments, typically about 1500–2000 mpm depending on filament denier.

FIG. 8 (line A) is a representative plot of the length change (ΔL) after boil-off of spun solid filament yarns not permitted to age more than 24 hours versus spin speed. Up to about 2000 mpm, such spun yarns elongate in boiling water (region I). Between 2000 and 4000 mpm, the spun-yarns elongate in boiling water, but to a lesser extent versus $V_S$ (region II). Above 4000 mpm, the as-spun yarns shrink in boiling water (region III). In FIG. 8 (line B) the corresponding birefringence (Δn) values for these yarns are plotted versus $V_S$. There is observed a reduction in the rate of increase in birefringence (Δn) versus $V_S$ at about 2000 mpm which is believed to be associated with the transition between region I and region II behavior and attributed to the onset of spin line stress-induced nucleation (SIN) and Region III being representative of the onset of significant spin line stress-induced crystallization (SIC). The transition between regions I and II corresponds approximately to an as-spun yarn $(RDR)_S$ of less than 2.75. For "hollow" filaments of the invention the transition between regions I and II occurs at lower $V_S$; e.g., about 1250–1500 mpm, depending on filament denier.

Figure 3:
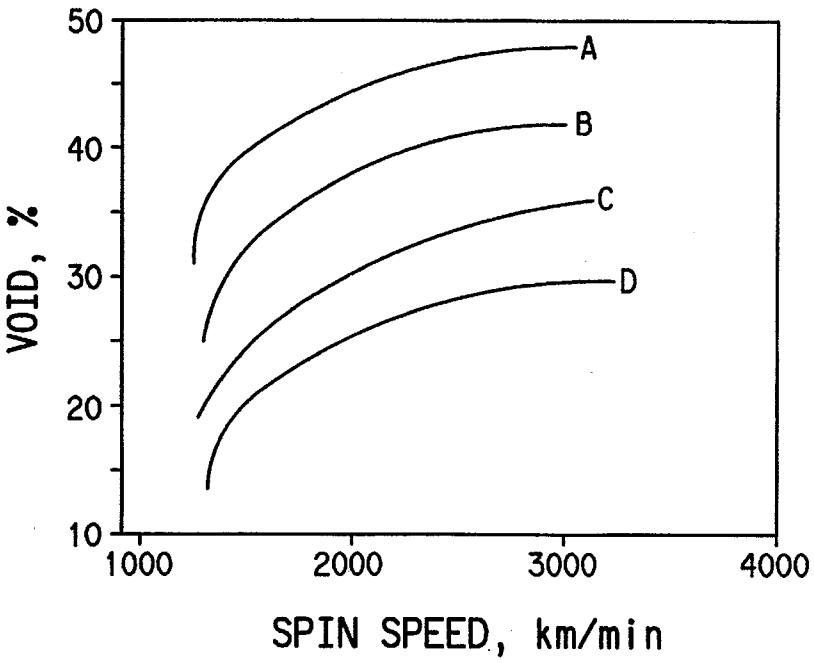
FIG. 3 (Lines 1 through 4) is a plot of fractional void content (VC) of hollow nylon 66 filaments versus withdrawal speeds ($V_S$); where Lines A, B, C, and D are representative yarns of nominal relative viscosity (RV) of 75, 65, 60, and 55, respectively.
Figure 9G:
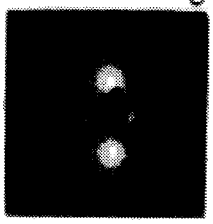
Figure 9A:
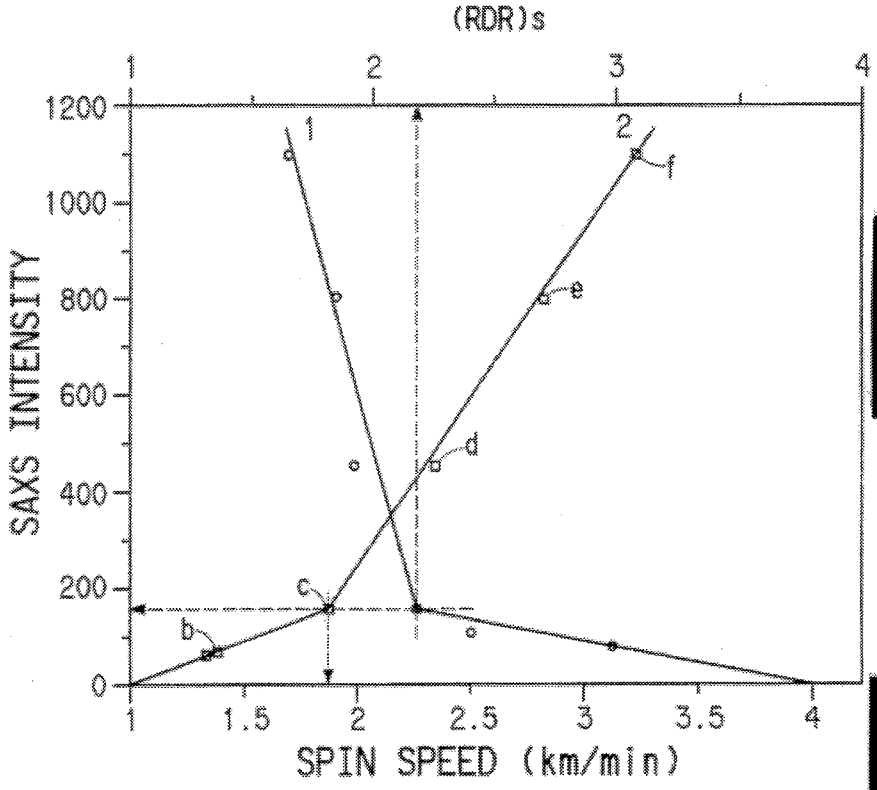
Figure 9F:
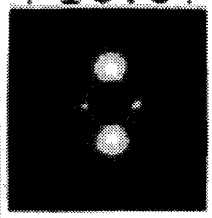
Figure 9E:
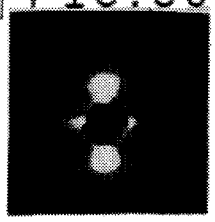
Figure 9B:
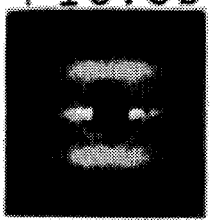
Figure 9C:
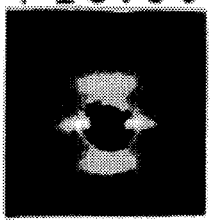
Figure 9D:
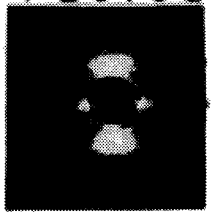

FIG. 9A (Lines 1 and 2) are plots of $I_{saxs}$ versus $V_S$ and versus $(RDR)_S$, respectively, of the yarns in FIG. 3; wherein there is distinct change in fiber structure as indicated by an abrupt increase in $I_{saxs}$ at values of about 175, corresponding to ($V_S$) of about 1500–2000 mpm and a $(RDR)_S$ of about 2.25. Filaments in accordance with the invention have an $I_{saxs}$ of at least 175, more preferably at least 200, and most preferably at least 400. FIGS. 9*b*–9*f* are SAXS patterns for hollow filament yarns of polymer RV and withdrawal speed ($V_S$): 76 and 1330 mpm; 77 and 1416 mpm; 76 and 1828 mpm; 76 and 2286 mpm; 76 and 2743 mpm; 78 and 3108 mpm, respectively; with FIG. 9*g* being representative of a 65 RV nylon 66 homopolymer POY of solid filaments spun at a withdrawal speed ($V_S$) of 5300 mpm according to Knox et al in U.S. Pat. No. 5,137,666.

Figure 10:
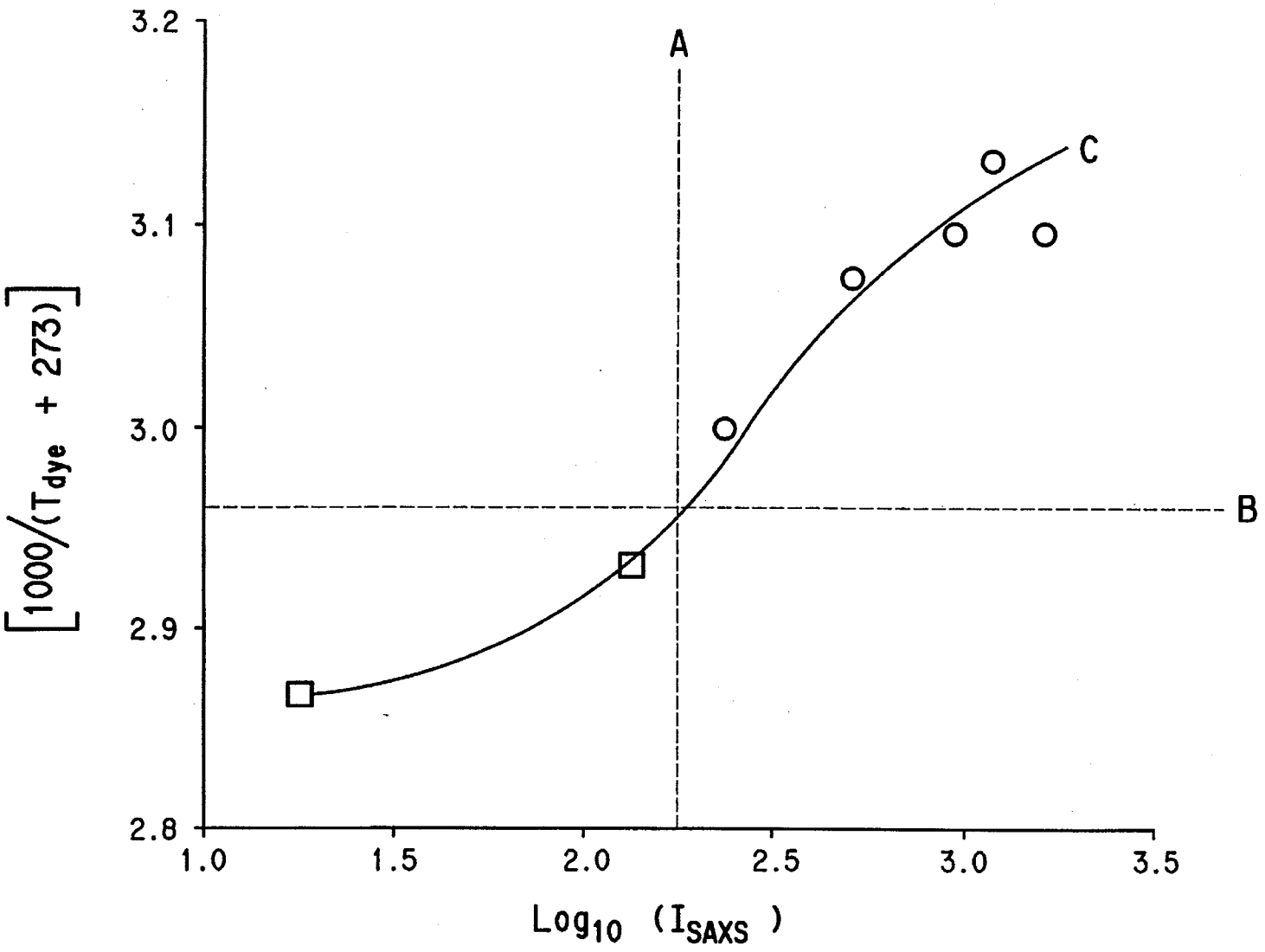

FIG. 10 is a plot of the large molecule acid dye transition temperature ($T_{dye}$), expressed by $[1000/T_{dye}+273]$, versus the base 10 logarithm of the small-angle x-ray scattering intensity ($I_{SAXS}$). Line A corresponds to $I_{SAXS}$ values of 175–200 Å and line B corresponds to a $T_{dye}$ of 65° C. The sigmoidal curve C is representative of the relationship between $T_{dye}$ and $I_{SAXS}$. Filaments of the invention are shown as circles and comparative filaments are shown as squares.

Figure 11:
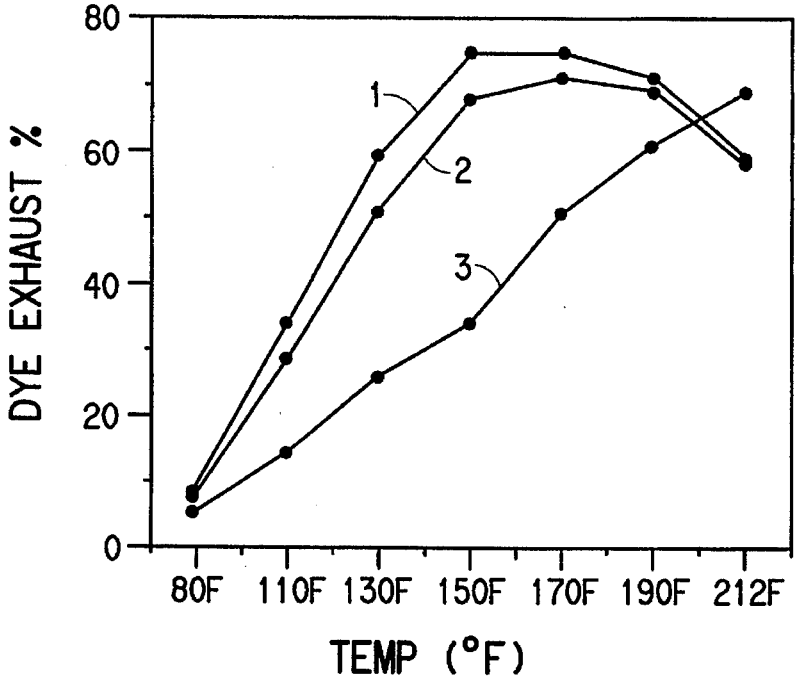

FIG. 11 is a plot of the percent dye exhaustion of an acid dye is plotted versus increasing dye bath temperature (expressed in °F.). Lines 1, 2, and 3 are representative dye exhaustion curve for a 40 denier 14 hollow filament yarn with a fractional void content (VC) of 0.41 and an $E_B$ of 65%; a 40 denier 14 hollow filament yarn with a VC of 0.45 and an $E_B$ of 42%; and a 70 denier 17 solid filament yarn with an $E_B$ of 42%, respectively; wherein the 70-17 solid filament yarn has about the same filament cross-sectional area (CSA) as the 40 denier 14 hollow filament yarn, where: CSA, $mm^2$=[(dpf/density)/($9\times10^5$ cm)]×[(10 mm/cm)$^2$×(1−VC)] and proportional to [dpf(1−VC)]; and the filament surface area (SA) is proportional to the square-root of CSA (i.e., $[dpf(1-VC)]^{1/2}$); therefore the 70-17 denier solid filament yarn has approximately the same total yarn surface area (SA) as that of the 40-14 denier hollow filament yarn; e.g., $17[70/17)/(1)]^{1/2}$~$14[(40/14)/(1-42/100)]^{1/2}$; however, the hollow filaments of the invention have a greater rate of dye uptake than that of solid filament yarns of comparable CSA and SA-values. This suggests that the spun and spun/drawn hollow yarns of the invention have a unique fiber structure versus conventional spun/drawn solid filaments.

Figure 12:
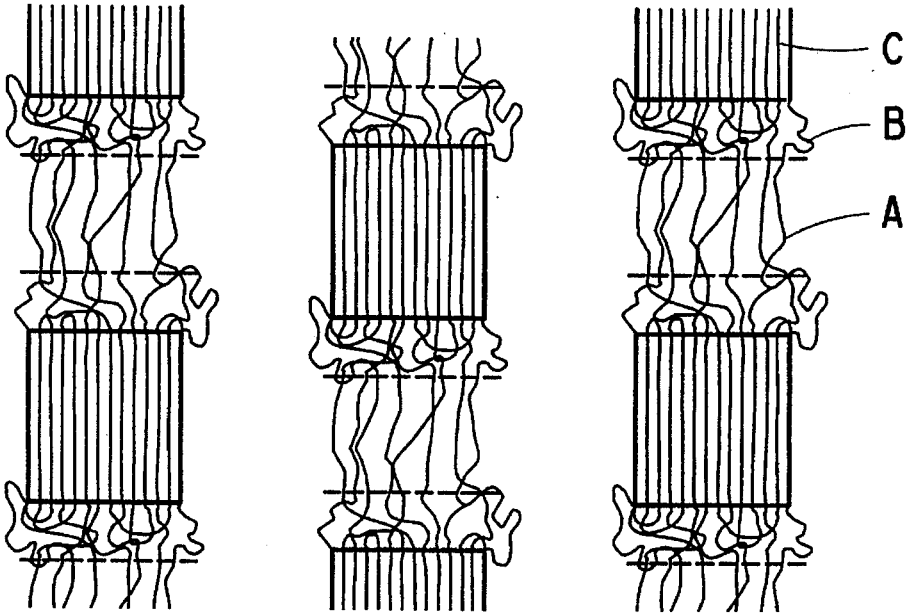

FIG. 12 is a simplified representation of a 3-phase fiber structure comprised of an amorphous phase (A); a paracrystalline phase (B) that comprises the highly ordered fringe/interface between the amorphous phase (A) and the crystalline phase (C), and sometimes is referred to as the mesophase (B). The $CPI_{waxs}$, and $I_{saxs}$, are measures of the "perfection" of the crystalline phase where higher values of $CPI_{waxs}$, and $I_{saxs}$ indicate an inter-crystalline region that is of less order (i.e., less paracrystalline and more amorphous in nature) which provides for a greater apparent pore volume $APV_{waxs}$, defined by the expression $APV_{waxs}$={$CPI_{waxs}$[(1−X)/X][$V_C$]}; wherein he average crystal volume $V_C$ is defined by [(avg. waxs crystal width)$_{010}$(avg. waxs crystal width)$_{100}$]$^{3/2}$ in cubic angstroms; and the fractional crystallinity by volume (X) is defined by X=[($d_p$−$d_{am}$)/($d_c$−$d_{am}$)], wherein $d_p$=$d_m$(1−VC)=(dpf)/[(1−VC)(CSA)]; and p, c, am, and m denote density of the polymer (i.e., of the filament without voids), amorphous phase, crystalline phase and the measured density of the hollow filament, respectively; and CSA is the measured filament cross-sectional area ($cm^2$). As the value of $APV_{waxs}$ increases, the dye rate increases and the ($T_{dye}$) decreases for a given extent of orientation (herein defined in terms of the apparent amorphous pore mobility APM given by [(1−$f_{am}$)/$f_{am}$] where $f_{am}$ is the ratio of the measured amorphous birefringence $\Delta_{am}$ and the maximum value of $\Delta_{am}$, taken herein to be 0.073; that is, $f_{am}$=$\Delta_{am}$/0.073, where $\Delta_{am}$=[$\Delta_{fiber}$−X$\Delta_c$]/(1−X) and the value of $\Delta_c$ is determined from WAXS crystal orientation angle ($COA_{WAXS}$) and may be approximated by the expression $$F_c \approx \frac{90 - COA_{WAXS}}{90},$$

where $F_c$ is the crystalline Herman's orientation function.

Figure 13:
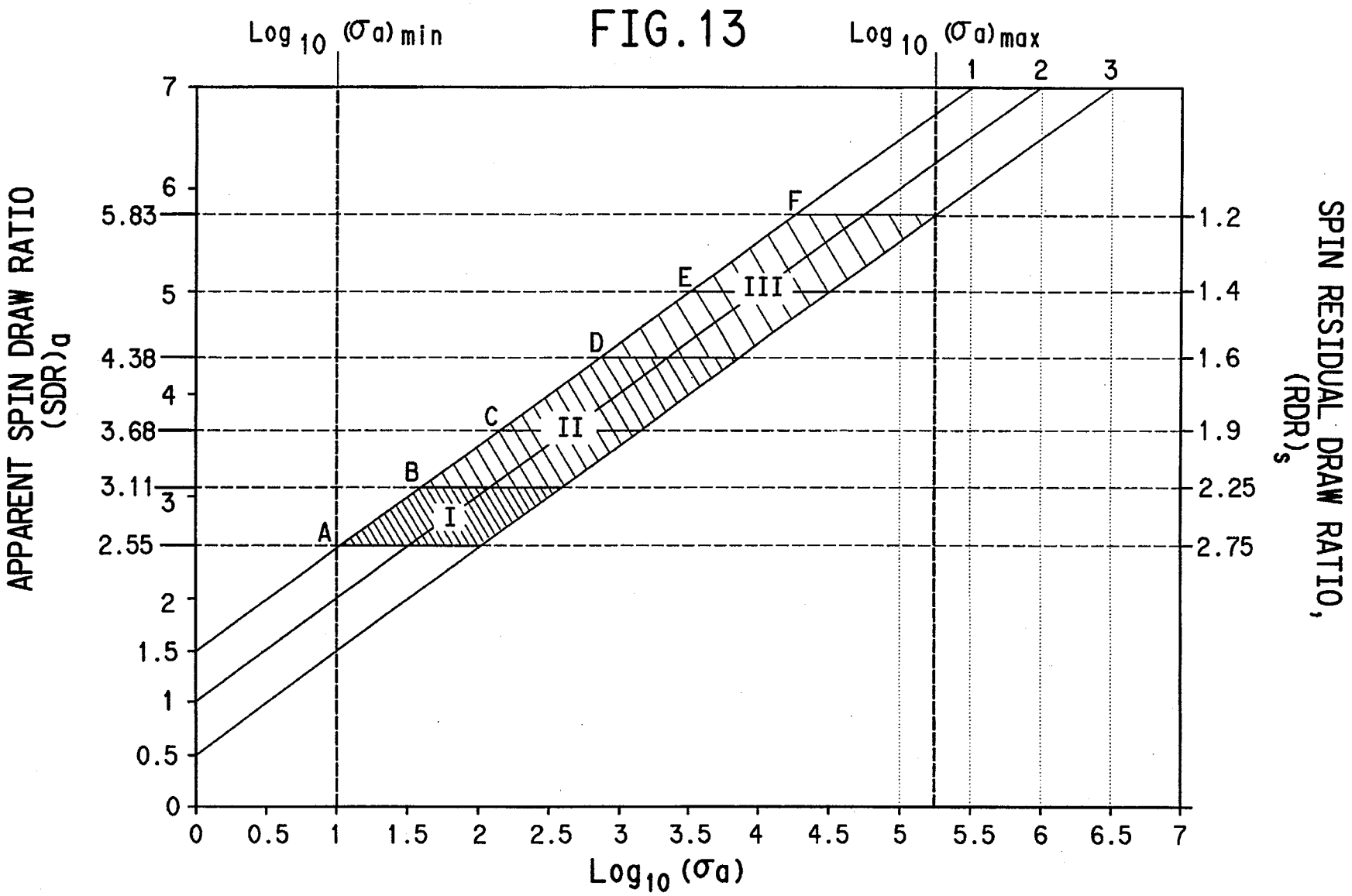

FIG. 13 is a plot of [SDR] versus [$Log_{10}(\sigma_a)$] where SDR, defined hereinafter, is taken herein to be the spin draw ratio, a measure of the average orientation developed in melt attenuation and quench. The SDR increases linearly with [$Log_{10}(\sigma_a)$], where points A, B, C, D, E, and F represent yarns having $(RDR)_S$ values of 2.75, 2.25, 1.9, 1.6, 1.4 and 1.2, respectively, where $(RDR)_S$=7/SDR. Lines 1, 2, and 3 have the form: y=mx+b where the values of the slope m is 1 and the values of the y intercept b are 1.5, 1, and 0.5, respectively. The process for preparing the hollow filaments of the invention is represented by the area between Lines A through F and Lines 1 and 3. Areas marked as "III" denote preferred process for preparing hollow filaments having a $(RDR)_S$ of about 1.2 to about 1.6; Area II for preparing hollow filaments having a $(RDR)_S$ of about 1.6 to about 2.25; and Area I for preparing hollow filaments having a $(RDR)_S$ of about 2.25 to about 2.75 which must be stabilized prior to use as a DFY or as a flat yarn. Preferred minimum and maximum values of [$Log_{10}(\sigma_a)$] of 1 and 5.25, respectively, are marked with vertical dashed lines.

Figure 14:
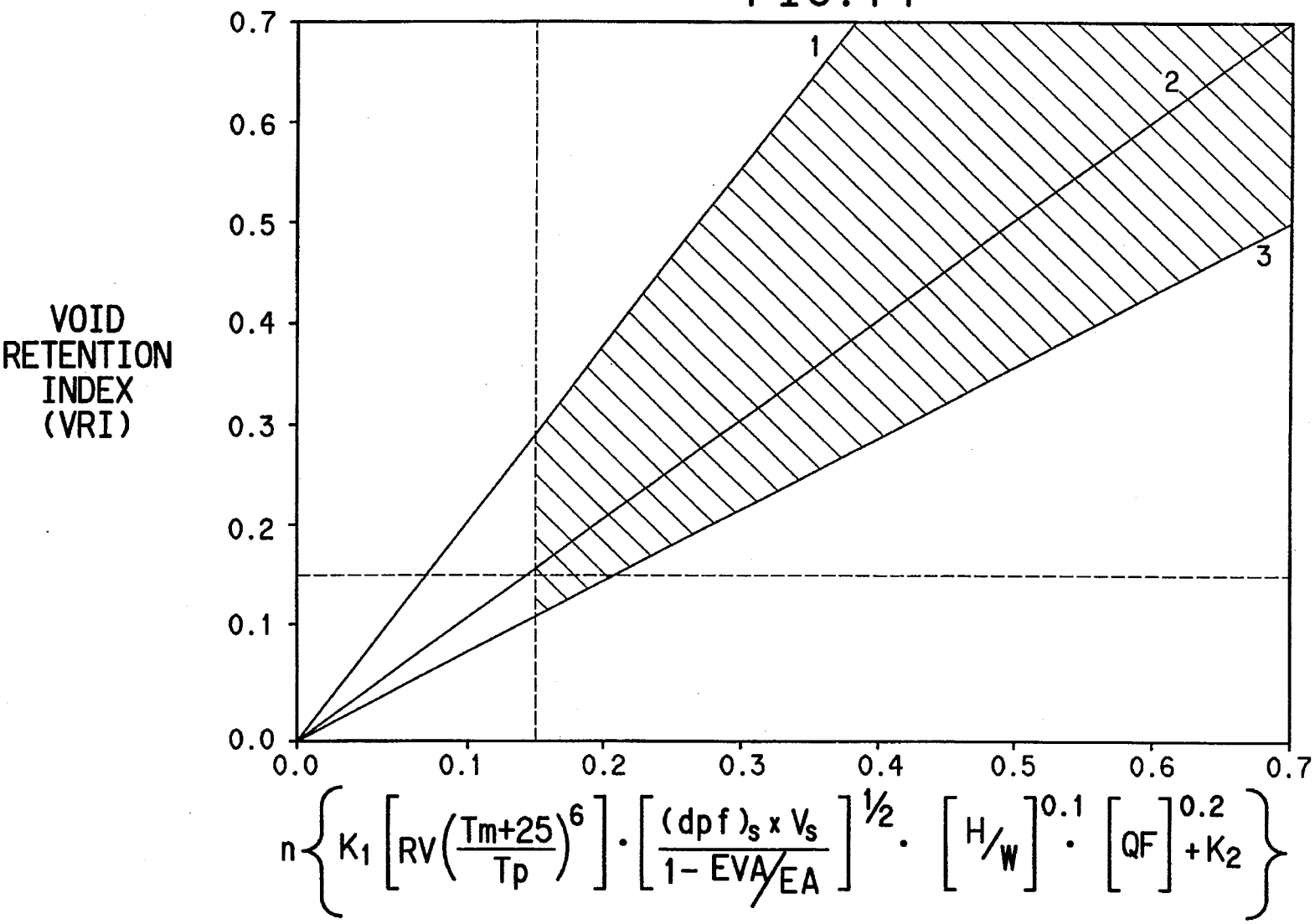

FIG. 14 is a plot of the void retention index (VRI) defined herein by the ratio of measured fractional filament void content (VC) and the fractional spinneret capillary extrusion void content (EVA/EA) versus empirical process expression for the void retention index (VRI), $$n\left\{K_1\left[RV\cdot\left(\frac{T_M+25}{T_P}\right)^6\right]\cdot\left[\frac{(dpf)_S\cdot V_S}{1-\frac{EVA}{EA}}\right]^{1/2}\cdot\left[\frac{H}{W}\right]^{0.1}\cdot[QF]^{0.2}+K_2\right\},$$

wherein n is 0.7, $K_1$ is $1.7\times10^{-5}$, $K_2$ is 0.17, $T_P$ is the spin pack temperature, $V_S$ is the withdrawal speed form the spinneret, H and W are the height and width, respectively, of the spinneret capillary orifice and QF is the quench factor; wherein yarns of the invention are represented by area defined by Lines 1 and 3; and where Line 2 represents the average relationship for hollow filaments prepared many diverse combinations of spinning parameters. The Lines 1 through 3 have the form: y=nx, where the value of the slope n is 2, 1, and, 0.7, respectively.

Figure 15:
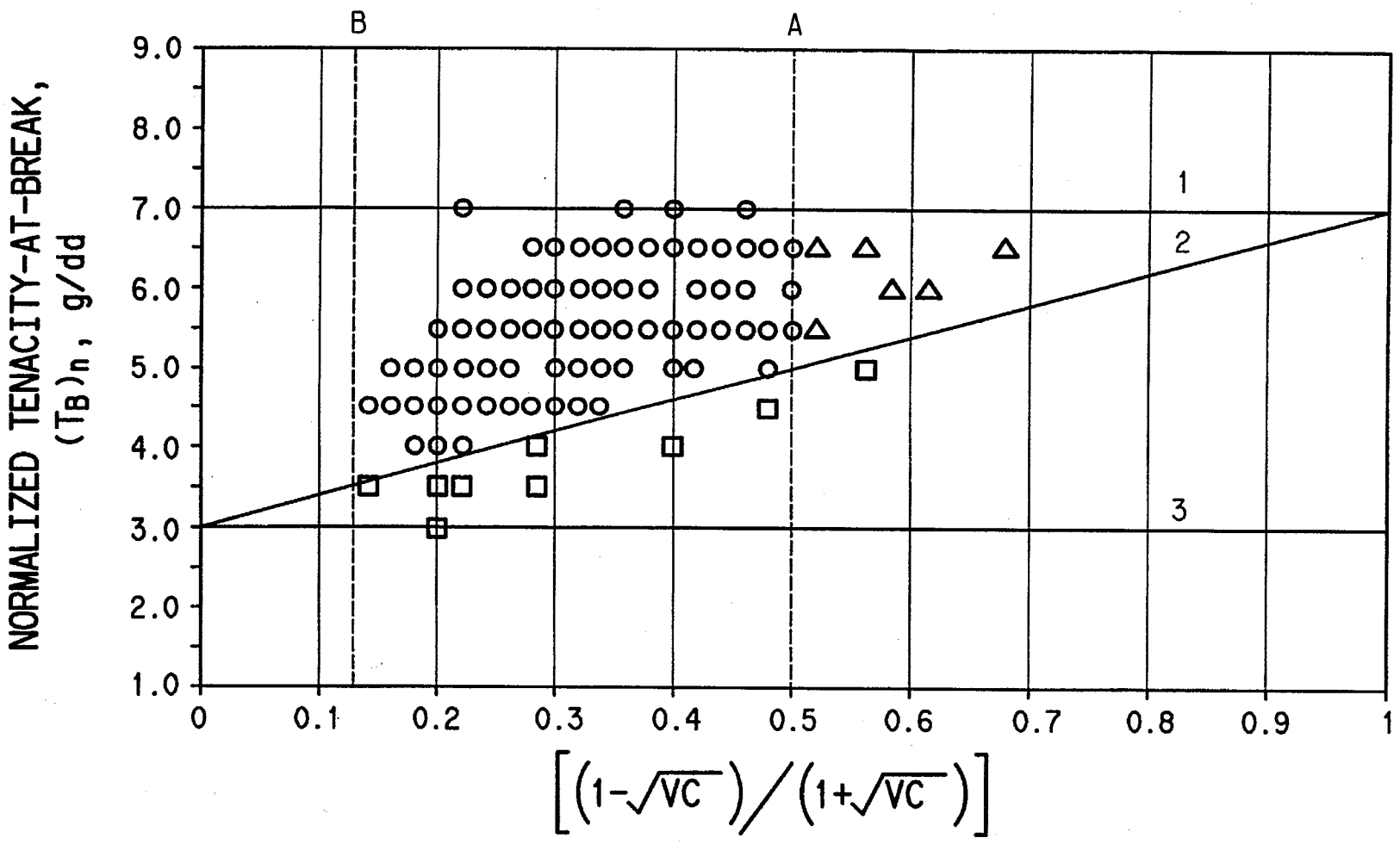

FIG. 15 is a plot of tenacity-at-break normalized to 65 RV, $(T_B)_{65}$ or $(TB)_n$, versus a reduced expression for the ratio of filament thickness to the filament circumference multiplied by the constant 27 π to give the ratio [(1−√VC)/(1+√VC)]. The ratio equals 0 for VC=1 equals 1 for VC=0. The yarns of the invention preferably have $(T_B)_n$ values at least 4 g/dd and most preferably at least a value in g/dd of the expression {4·[(1−√VC)/(1+√VC)]+3}. Extrapolation of VC to 1 (i.e., a ratio of 0) is not valid for this simplified representation. Lines A and B correspond to VC values of 0.1 and 0.6, a practical range of the VC values for the yarns of the invention. As a reference, Line 1 represents a nominal value for a solid filament yarn of round cross-section and of 65 RV polymer and line 2 represents the relationship $(TB)_n \geqq$ {4·[(1−√VC)/(1+√VC)]+3}. Yarns of the invention are denoted by circles; yarns having a desired void level but are of inferior mechanical quality are denoted by squares. Comparative yarns having low void content are denoted by triangles.

Figure 16:
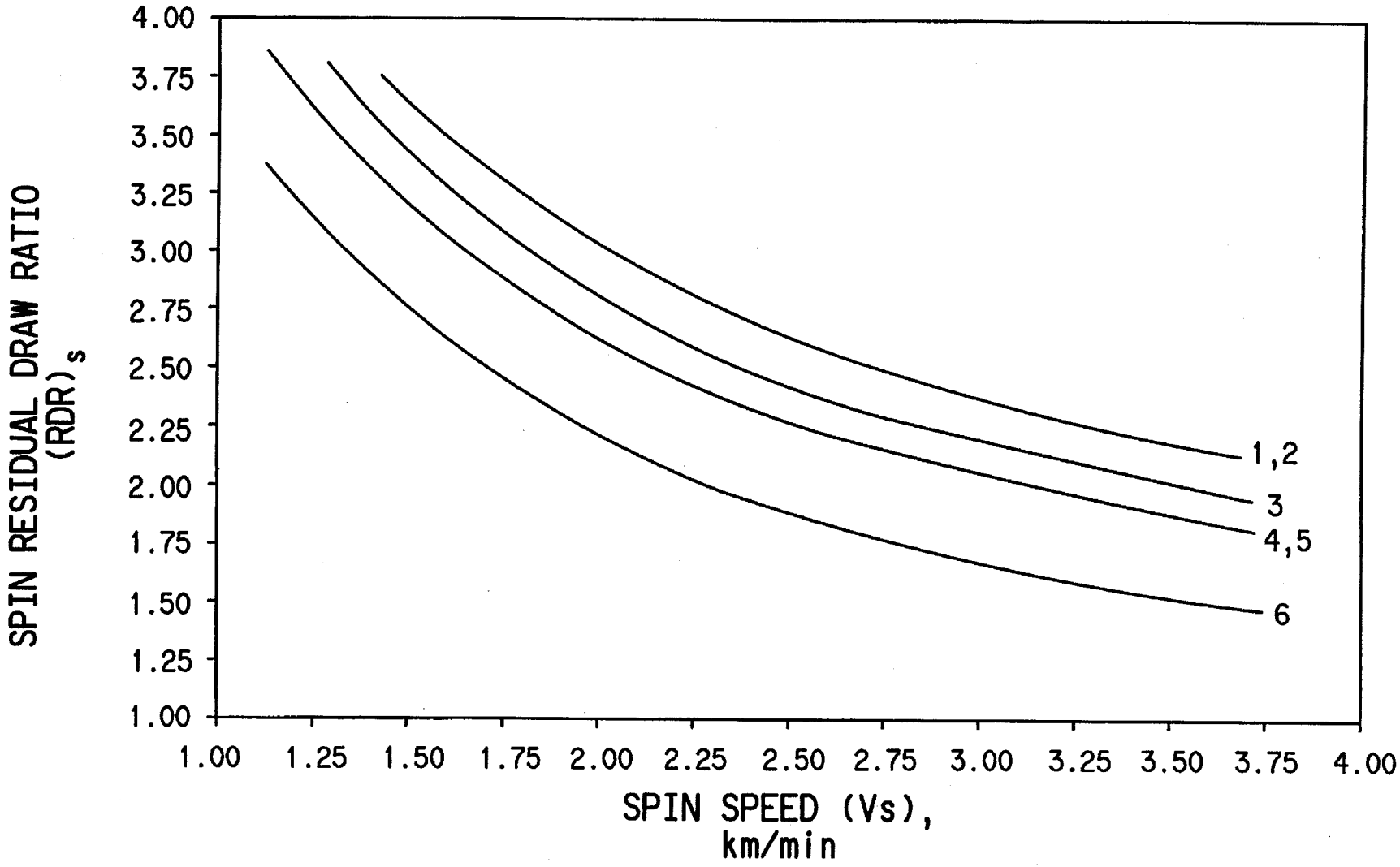

FIG. 16 is a representative plot of $(RDR)_S$ of solid and hollow nylon and polyester filaments versus spin speed (VS); (Line 1)=hollow polyester copolymer; (Line 2)=solid polyester copolymer; (Line 3)=solid polyester homopolymer; (line 4)=solid nylon 66 homopolymer; (line 5)=hollow polyester homopolymer; and (line 6)=hollow nylon 66 homopolymer. Co-drawing of mixed filament yarns are preferably carried out such that the $(RDR)_D$-values of all filaments are at least 1.2 to insure acceptable mechanical quality (i.e., no broken filaments).

Figure 17A:
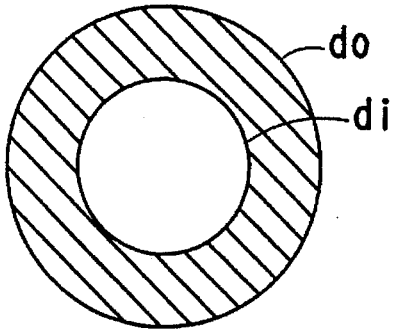
Figure 17B:
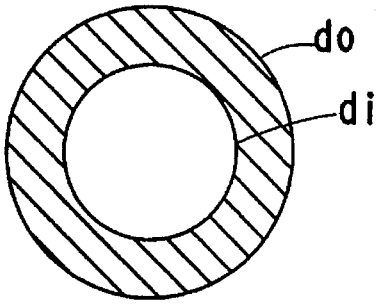
Figure 17C:
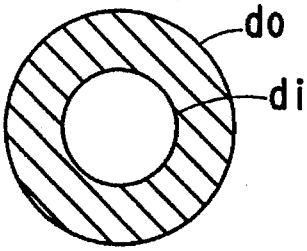
Figure 17D:
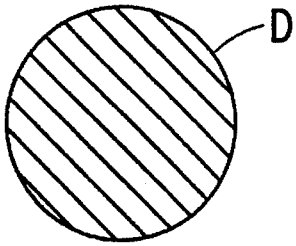

FIGS. 17A through 17D depict cross-sections of round filaments with an outer diameter (OD) of "D" in FIG. 17D for solid filaments where there is no void, and $d_o$ in FIGS. 17A, 17B, and 17C, for three representative types of comparable hollow filaments according to the invention, where there are voids. The inner diameter (ID) is noted as $d_i$ in the latter Figures. Filaments depicted by FIG. 17A are hollow but have the same denier (mass per unit length) as the solid filaments of FIG. 17D; that is, their cross-sections contain the same amount of polymer (i.e., total cross-sectional area of FIG. 17D equals the annular hatched area of the "tube wall" of FIG. 17A). It will be understood that a family of hollow filaments like FIG. 17A could be made with differing void contents, but the same denier. Fabrics made from such filament yarns of FIG. 17A would weigh the same as those from FIG. 17D, but would be bulkier and have more "rigidity", i.e., the filaments have more resistance to bending. Filaments depicted by FIG. 17B are hollow and designed to have the same "rigidity" (resistance) to bending as those from FIG. 17D; this "rigidity" defines, in part, the "drape" or "body" of a fabric, so fabrics made from filaments of FIG. 17B and 17D would have the same drape. It will be noted that there is less polymer in the wall of FIG. 17B than for FIG. 17A, and, therefore, for FIG. 17D. So fabrics from these filaments from FIG. 17B would be of lower weight and greater bulk than those for FIG. 17D. Again, a family of hollow filaments like FIG. 17B could be made with differing void contents, but the same "rigidity". Filaments depicted by FIG. 17C have the same outer diameter (do) as FIG. 17D. Again, a family of such hollow filaments like FIG. 17C could be made with differing void contents, but the same outer diameter. Fabrics made from filaments FIGS. 17C and 17D would have the same filament and fabric volumes, but such fabrics made from filaments of FIG. 17C would be lighter and of less "rigidity". It is also possible to have mixed filament hollow yarns with cross-sectional shapes as depicted in FIGS. 17B through 17D, as well as including a portion of solid filaments as in FIG. 17A.

Figure 18:
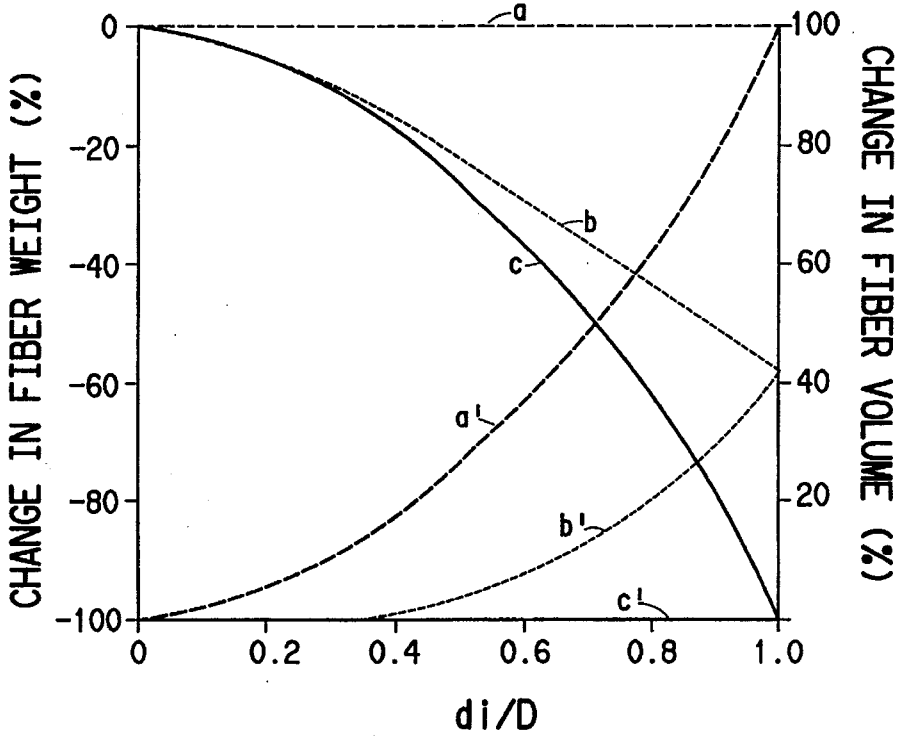

FIG. 18 plots change (decrease) in fiber (fabric) weight (on the left vertical axis) versus increasing void content (VC), i.e., with increasing $(d_i/d_o)$-ratio, where Lines a, b and c, respectively, represent the changes in weight of filaments (and fabric therefrom) of the families represented by FIGS. 17A, 17B, and 17C. For instance, for the family of filaments of FIG. 17A, the denier will remain constant even as the $d_i$ and void content increase, so Line a is horizontal indicating no change in filament weight as void content increases. FIG. 18 also plots fiber (fabric) volume (on the right vertical axis) versus void content $(d_i/d_o)$ where Lines a', b', and c' correspond to the families of filaments of FIGS. 17A, 17B, and 17C, respectively. In this case, Line c' is horizontal, as the outer diameter of FIG. 17C remains constant.

Figure 19:
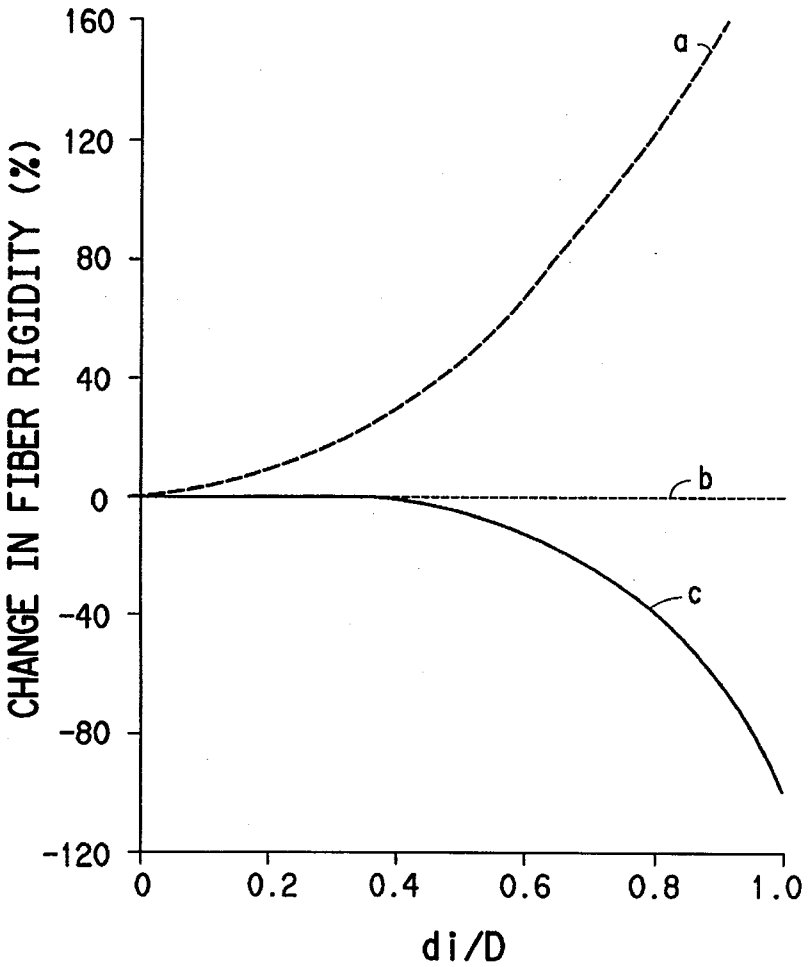

FIG. 19 plots the change in fiber (fabric) "rigidity" (bending modulus, $M_B$) versus void content $(d_i/d_o)$, where Lines a, b, and c correspond to filaments of FIGS. 17A, 17B, and 17C, respectively. In this case, Line b is horizontal since the "rigidity" of the filaments of FIG. 17C is kept constant even as the void content increases. Details on calculations of filament rigidity, weight, and volume as a function of void content are provided in an article: "The Mechanics of Tubular Fiber: Theoretical Analysis", Journal of Applied Science, Vol. 28, pages 3573–3584 (1983) by Dinesh K. Gupta. FIGS. 17–19 are based in part on information taken from this article.

Figure 20:
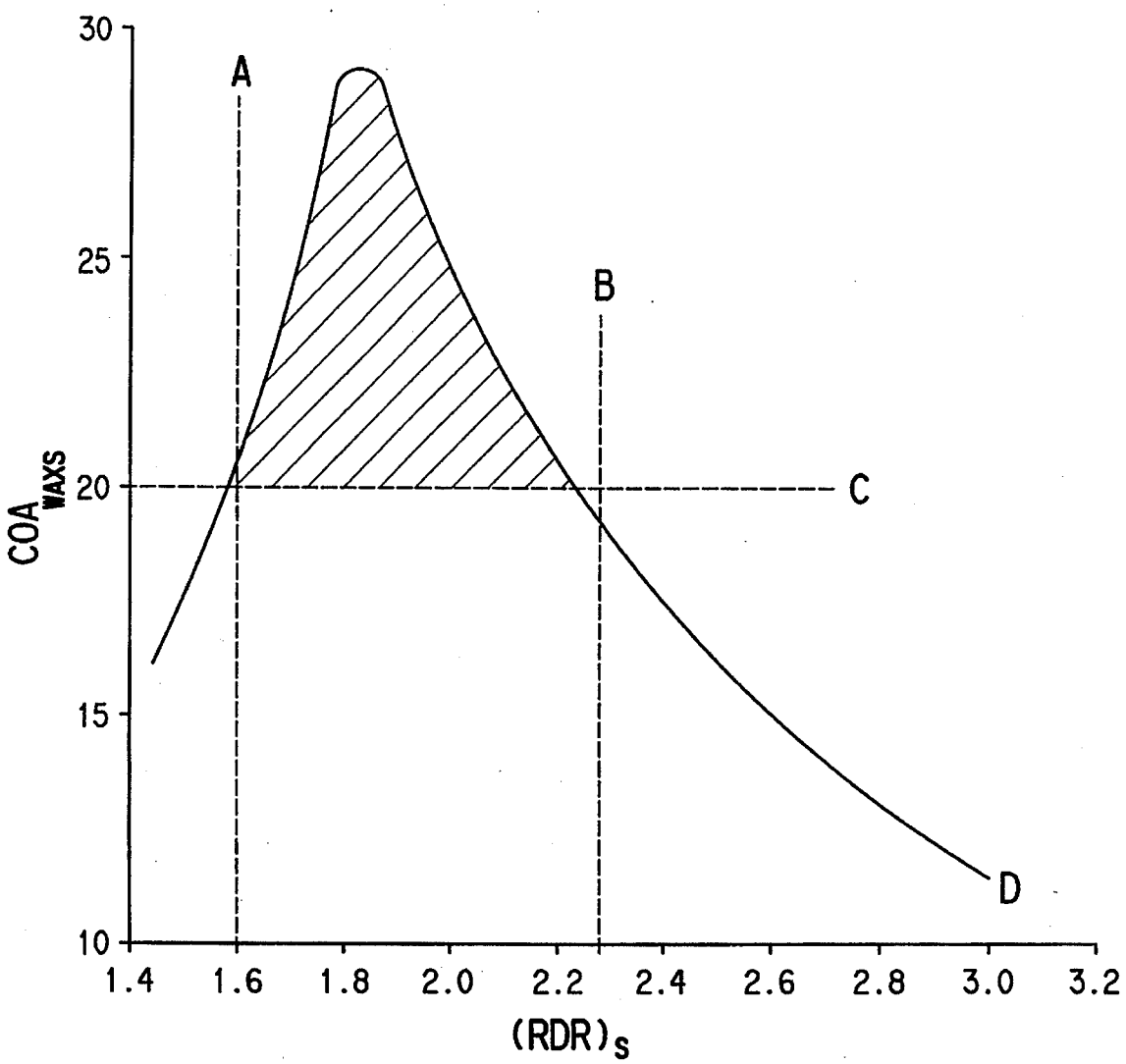

FIG. 20 is an illustrative best fit plot of $COA_{WAXS}$ values for hollow and solid filaments of Table 9 versus the corresponding $(RDR)_S$ values.

Figure 21:
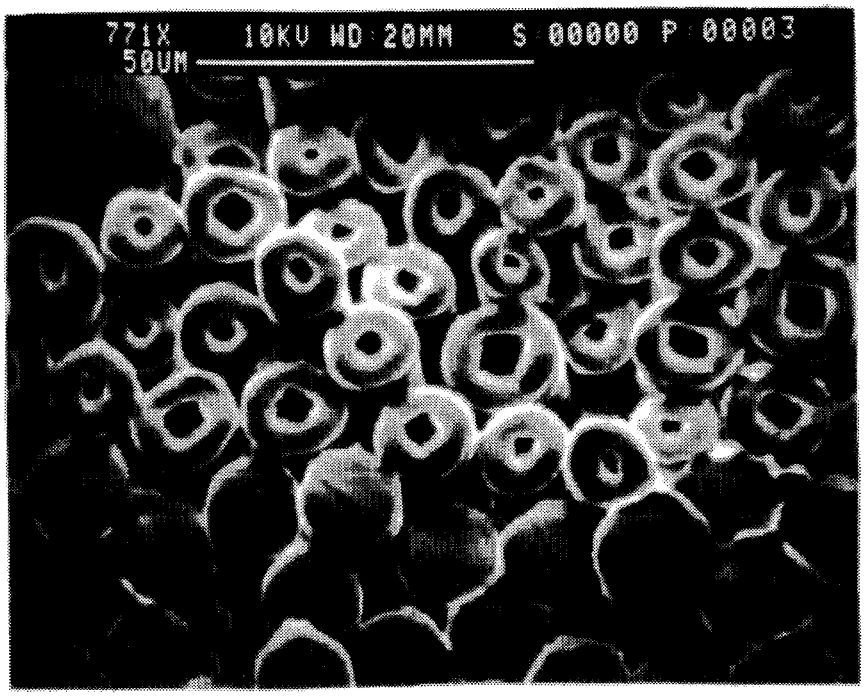

FIG. 21 is an enlarged photograph of the cross-section of hollow filaments and solid filaments of yarns employed in Example 23 shown together in the same photograph so that the outside diameters can be compared.

Figure 22:
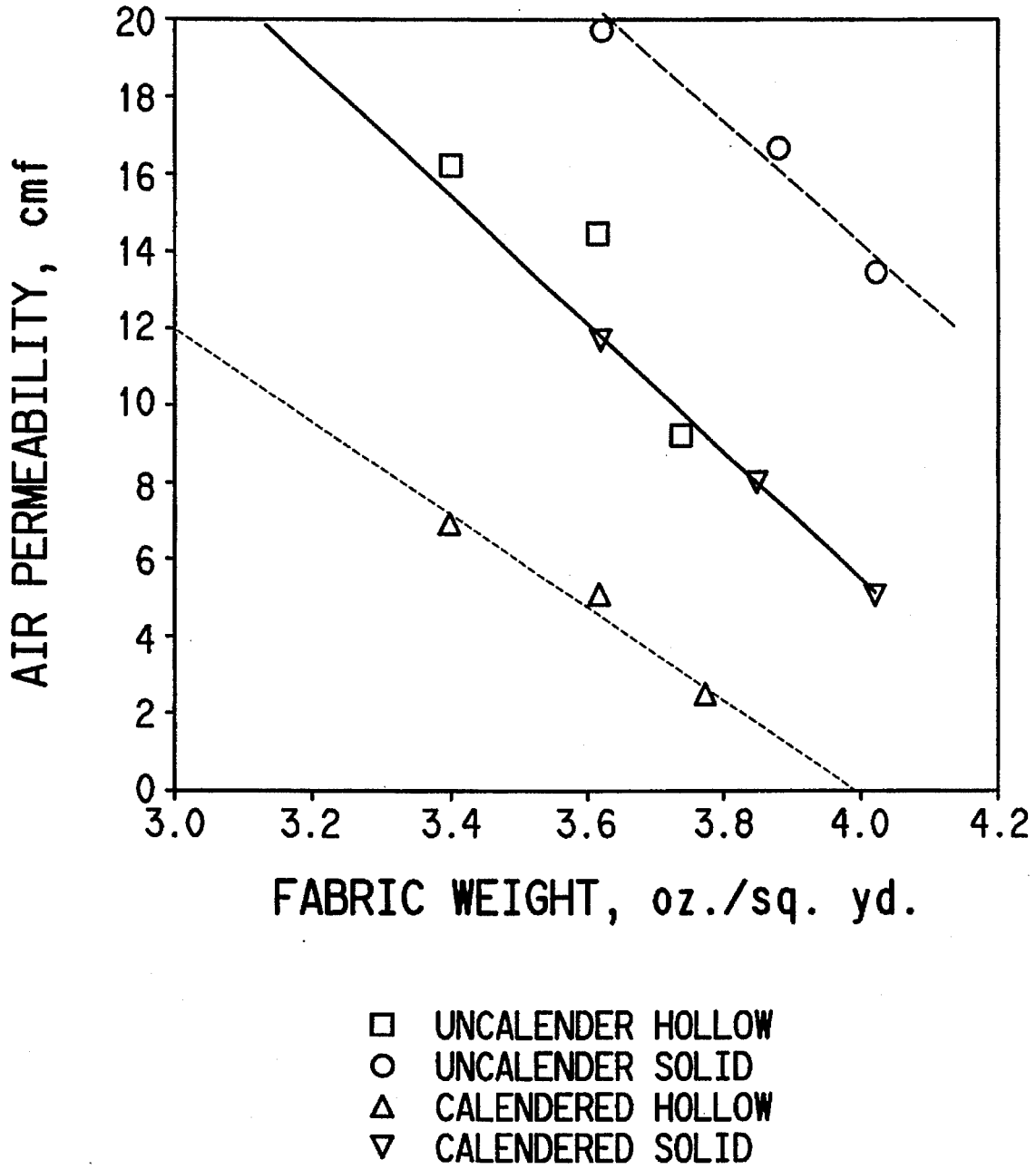

FIG. 22 is a plot of the air permeability versus fabric weight for the fabrics illustrated in Example 23.

Figure 23:
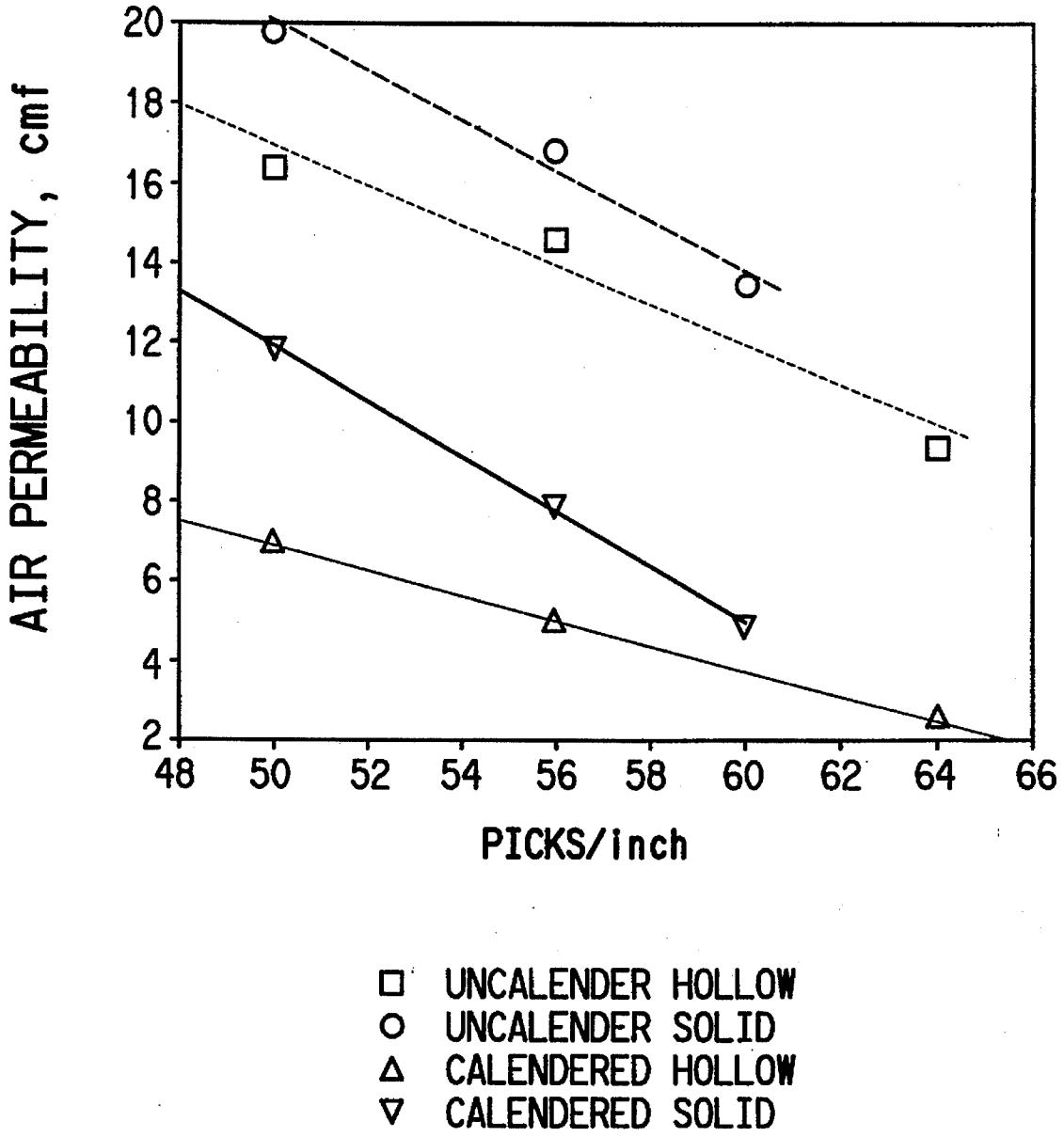

FIG. 23 is a plot of the air permeability versus picks/inch for the fabrics illustrated in Example 23.

Figure 24:
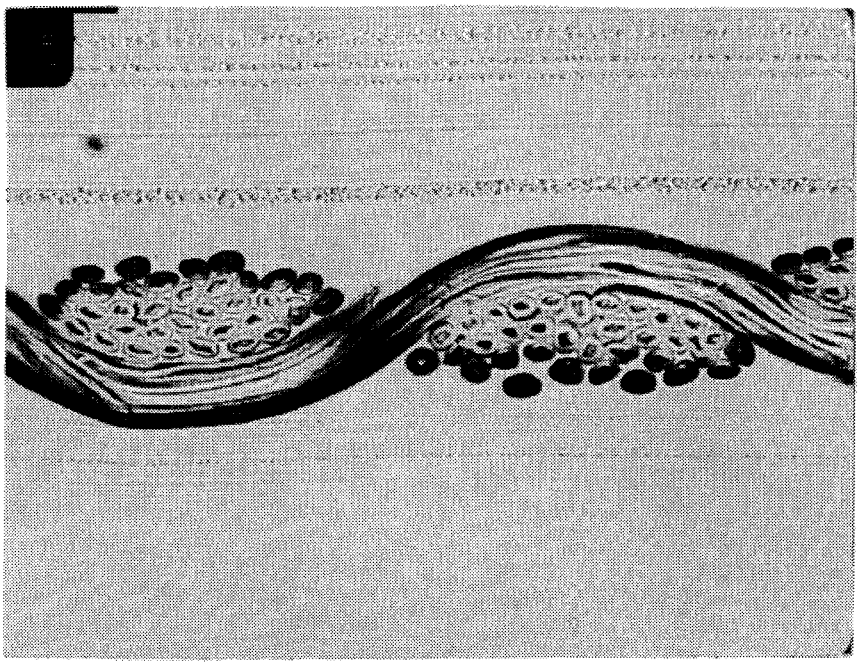

FIG. 24 is an enlarged photograph showing the cross-section of a fabric of Example 24 employing a yarn with hollow filaments.

Figure 25:
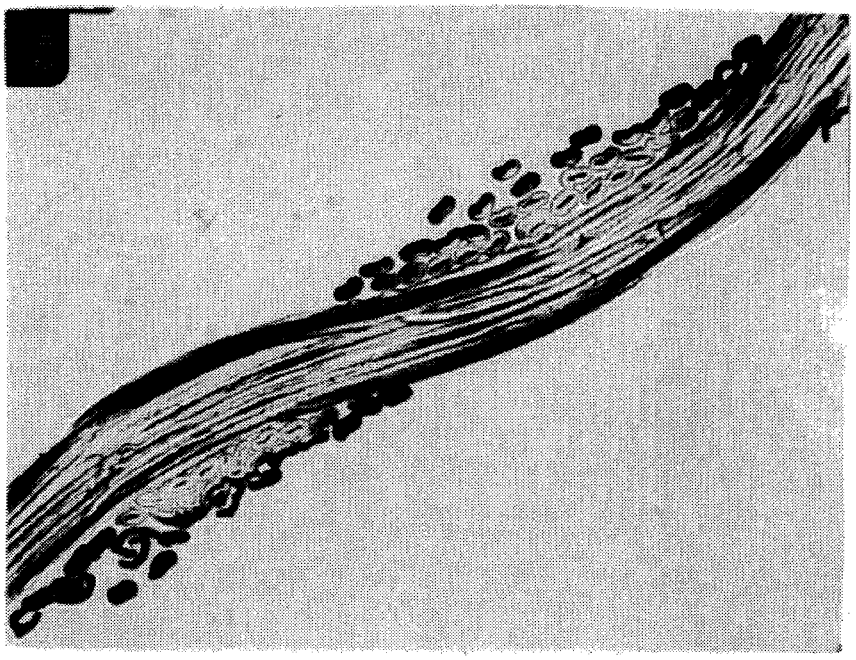

FIG. 25 is an enlarged photograph of showing the same fabric of FIG. 24 after washing.

Figure 26:
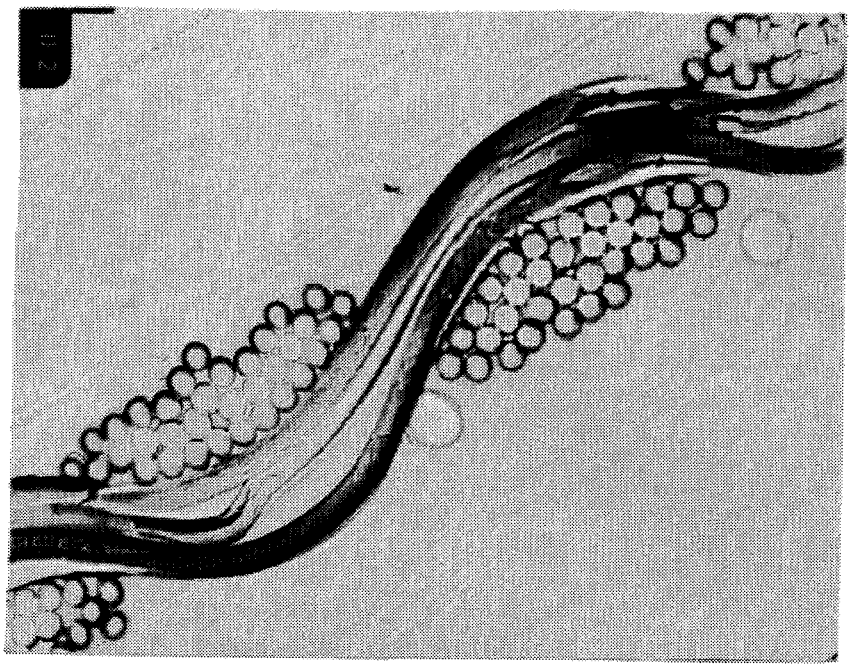

FIG. 26 is an enlarged photograph showing the cross-section of a comparative fabric of Example 24 employing solid filament yarns.

Figure 27:
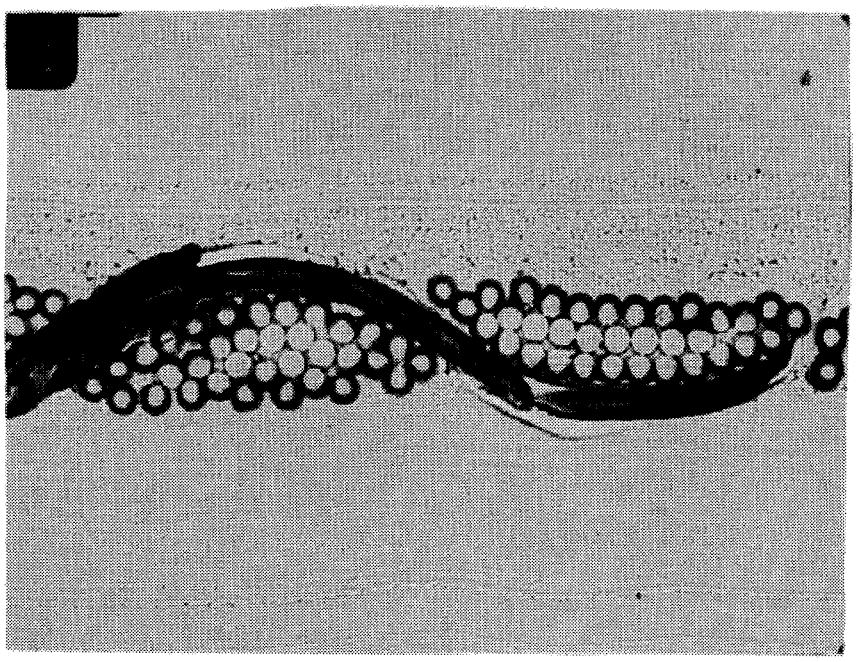

FIG. 27 is an enlarged photograph of showing the same fabric of FIG. 26 after washing.

Figure 28:
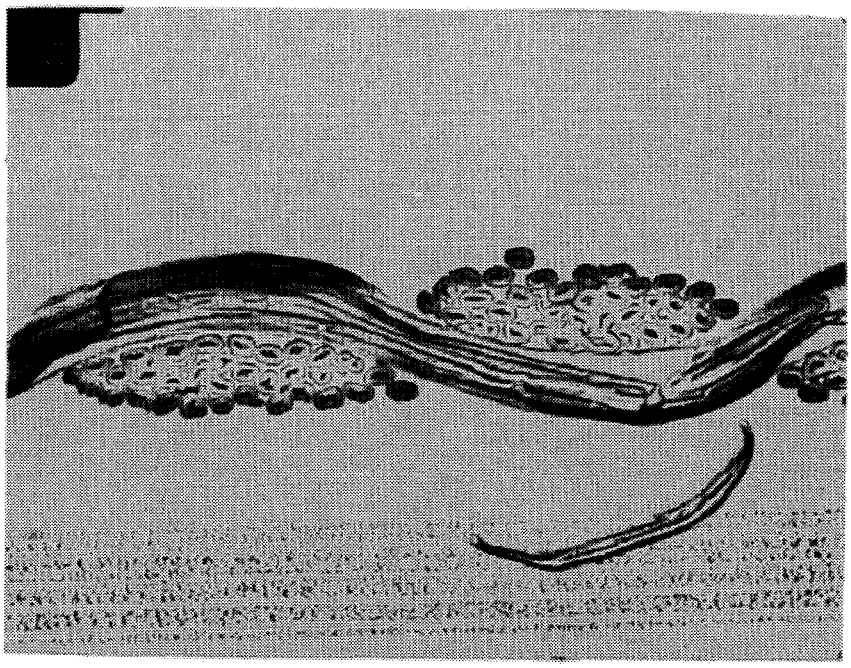

FIG. 28 is an enlarged photograph showing the cross-section of a dyed and heat set fabric of Example 25 employing a yarn with hollow filaments.

Figure 29:
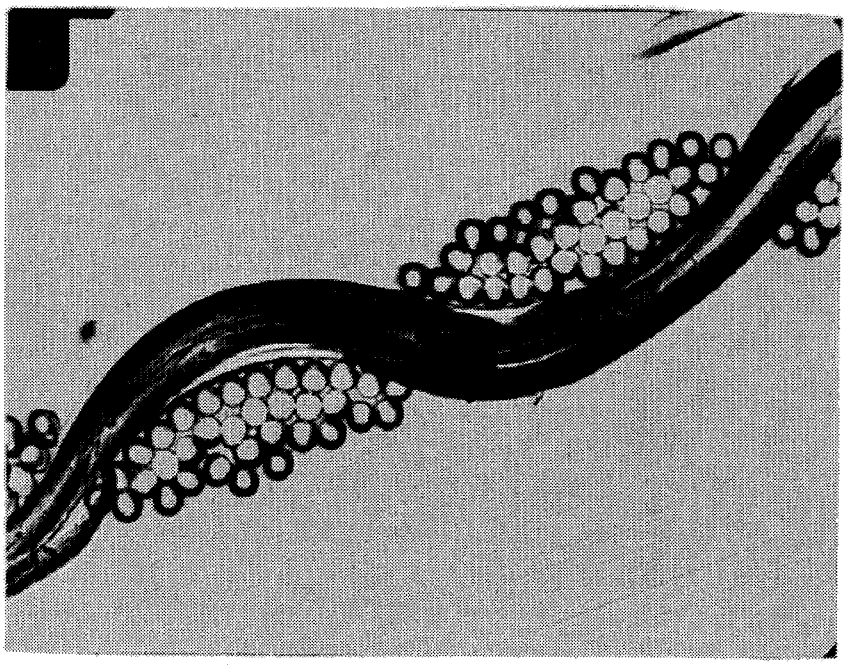

FIG. 29 is an enlarged photograph showing the cross-section of a dyed and heat set comparative fabric of Example 25 employing solid filament yarns.

Figure 30:
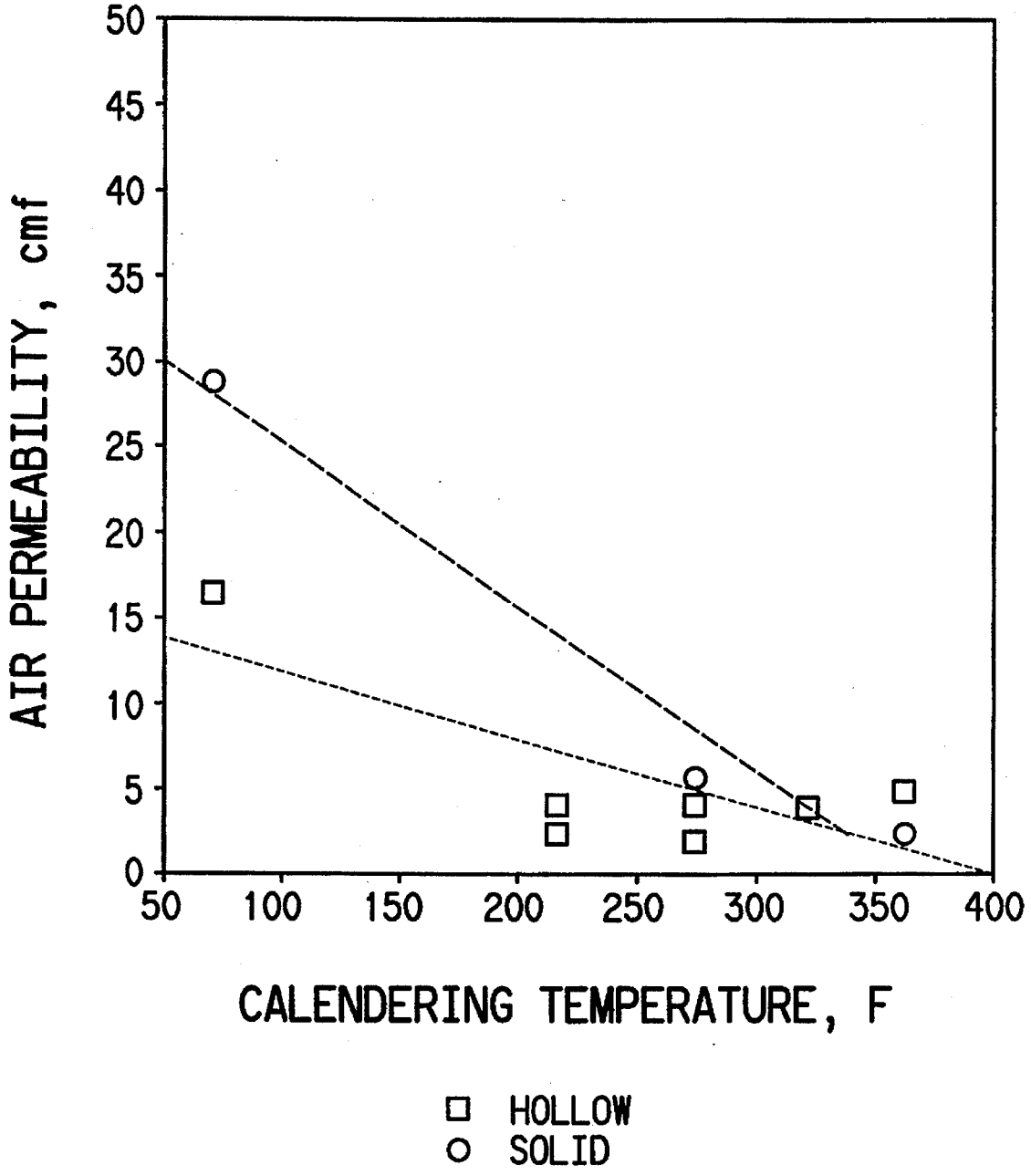

FIG. 30 is a plot of air permeability versus calendering temperature for fabrics illustrated in Example 25.

Figure 31:
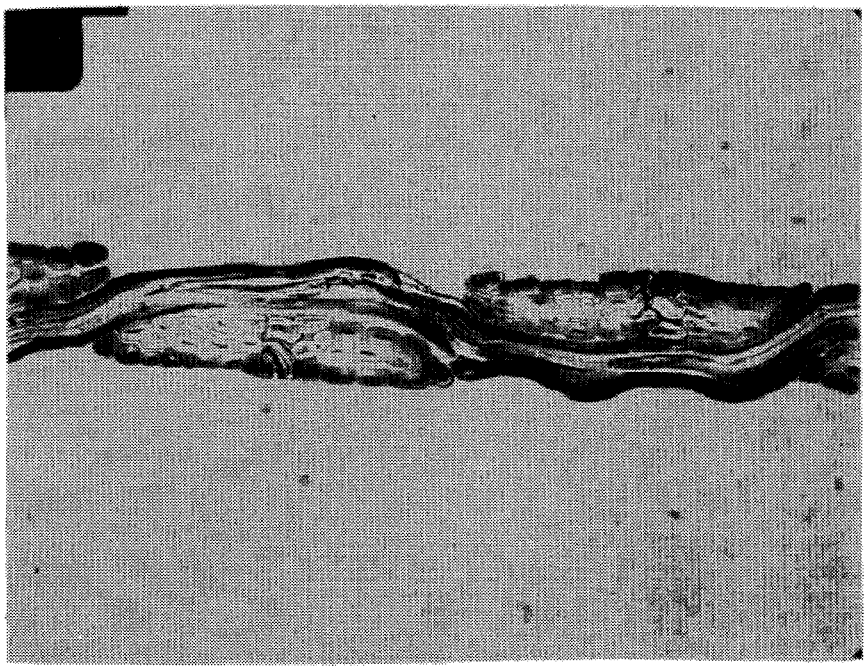

FIG. 31 is an enlarged photograph showing the cross-section of a fabric of Example 25 employing a yarn with hollow filaments calendered at a temperature of 280° F.

Figure 32:
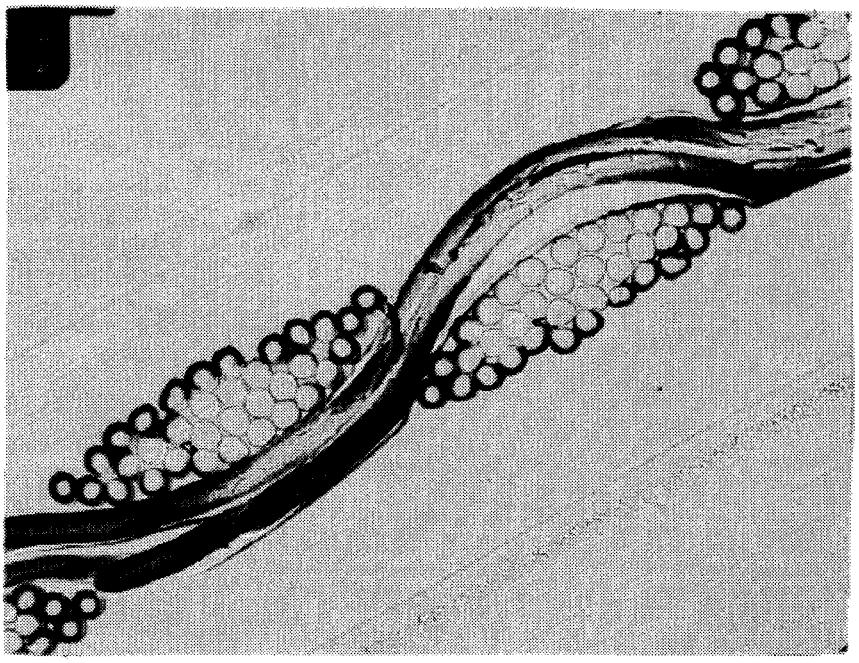

FIG. 32 is an enlarged photograph showing the cross-section of a comparative fabric of Example 25 employing solid filament yarns calendered at a temperature of 280° F.

Figure 33:
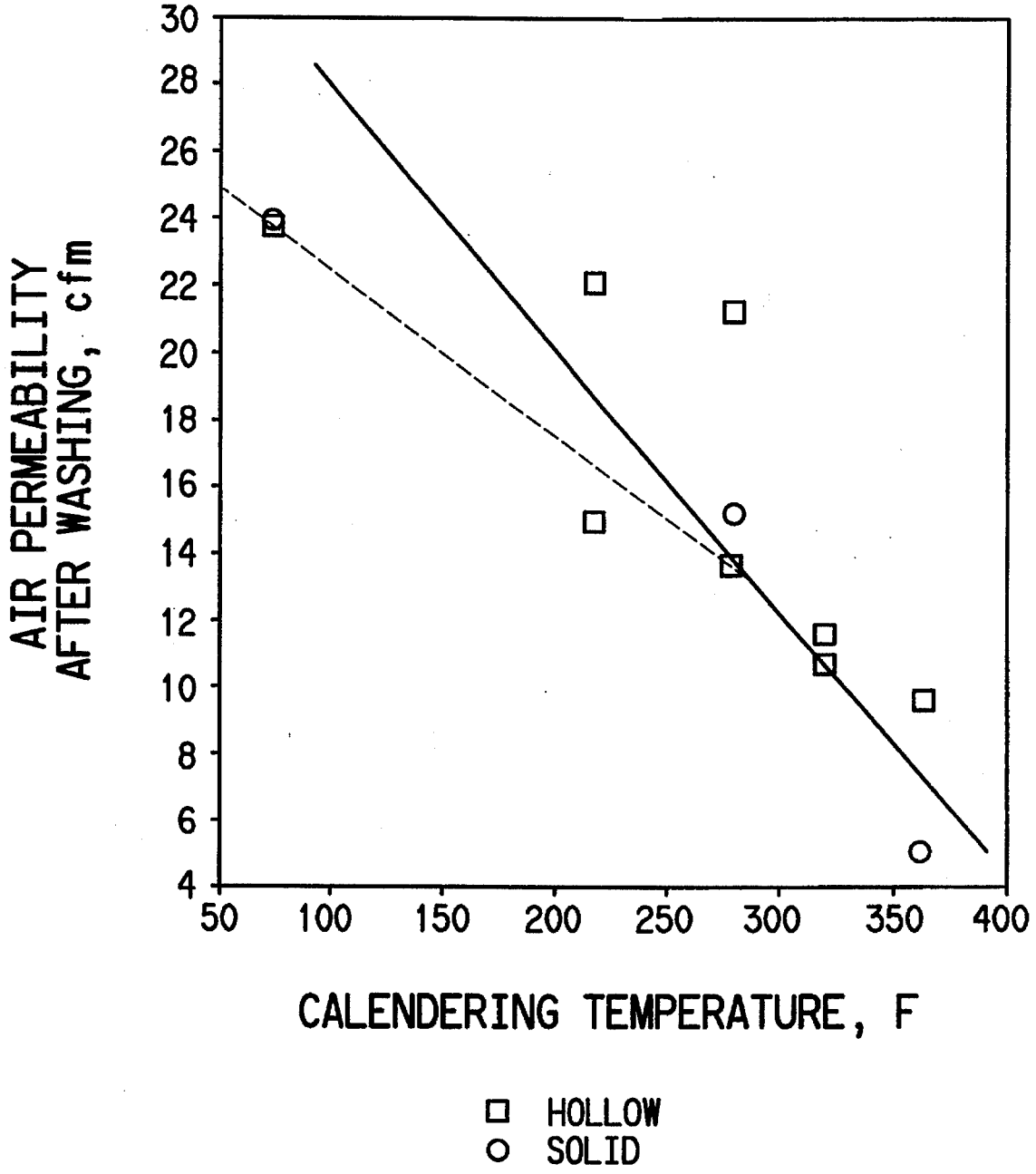

FIG. 33 is a plot of air permeability versus calendering as in FIG. 30 except that the fabrics are washed.

Figure 34:
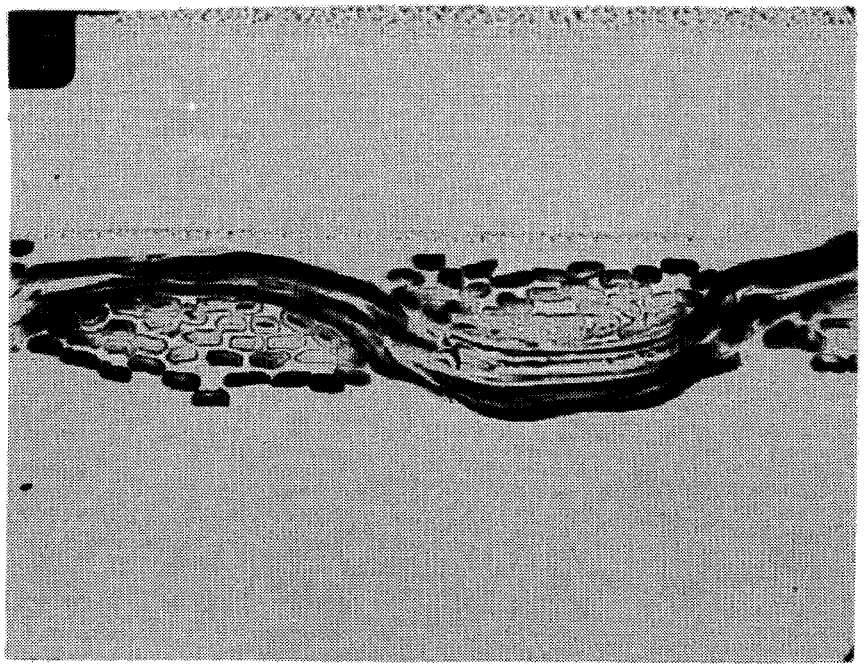

FIG. 34 is an enlarged photograph of showing the same fabric of FIG. 31 after washing.

Figure 35:
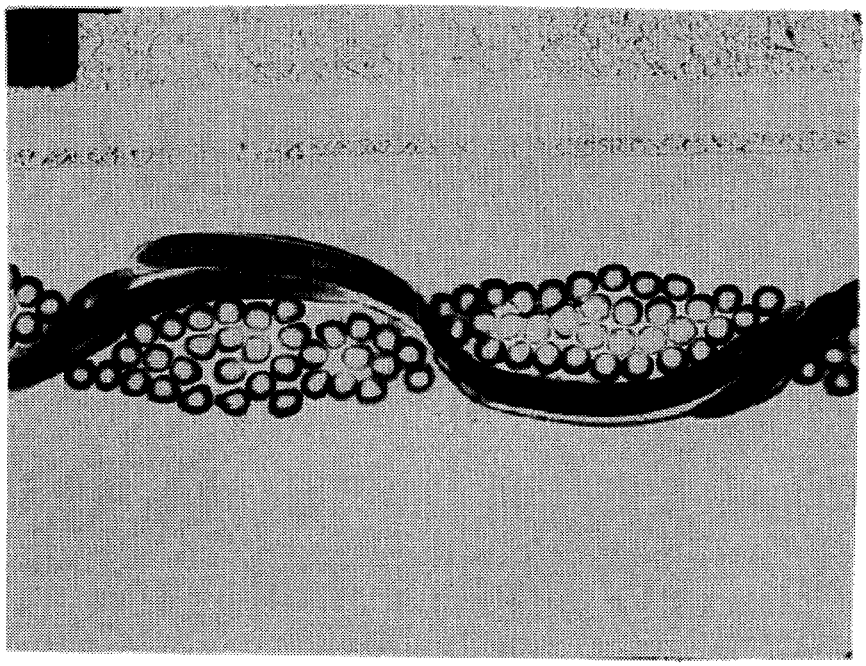

FIG. 35 is an enlarged photograph of showing the same fabric of FIG. 32 after washing.

DETAILED DESCRIPTION

In this application, "textured yarns" (e.g., air-jet, false-twist, stuffer-box, mixed-shrinkage, self-helical crimping) are referred to as "bulky" (or "bulked") yarns and "untextured" filament yarns are referred to as "flat" yarns. The "flat" yarns and the "bulky" yarns referred to herein may be obtained directly; that is, without drawing; such as a direct spun yarn that is suitable for use without drawing (herein are referred to as "direct-use" flat yarns) by virtue of having obtained sufficient properties to be used directly by selection of the nylon polymer, melt attenuation rate $[EVA/(dpf)_S]$, and use of high withdrawal rates $V_S$); and "bulky" yarns that may obtain their bulk without drawing, such as in air-jet texturing or stuffer box/tube texturing when using a "flat" or a "direct-use" yarn as the "feed" yarn. Further, drawn "bulky" yarns may be prepared by sequentially drawing the "feed" yarn and then bulking the drawn flat yarn (e.g., as in air-jet texturing) or may be drawn simultaneously with the bulky step (e.g., draw false-twist texturing. Thus, for convenience herein, drawn "flat" or undrawn as-spun "flat" yarns and sequentially or simultaneously drawn "bulky" yarns and undrawn "bulky" yarns, in accordance with the invention, may often be referred to as "flat" yarns and as "bulky" yarns without intending specific limitation by such terms. Further all filaments mentioned herein are hollow unless stated otherwise.

To be suitable for its intended use, a "textile" yarn (i.e., "flat" yarn, or "bulky" yarn) must have certain properties, such as sufficiently high modulus, tenacity, yield point, and thermal stability which distinguish these yarns from yarns that require further processing before they have the minimum properties for processing into textiles. These yarns are referred to herein as "feed" yarns or as "draw feed" yarns. Such "feed" yarns may be drawn off-line in a separate "split" process or such "feed" yarns may be sequentially drawn following the formation of the spun feed yarn in a "coupled" spin/draw process to provide "flat" yarns or such "feed" yarns may be drawn sequentially or simultaneously with a bulking step to provide drawn "bulky" yarns. Such drawing may be carried out on a single yarn or may be carried out on several yarns, such as the number of yarns that are wound-up into packages of yarn by a multi-end winder or in a form of a multi-end weftless warp sheet as in warp drawing. Also the filaments may be supplied and/or processed according to the invention in the form of a yarn or as a bundle of filaments that does not necessarily have the coherency of a true "yarn". Thus, for convenience herein, a plurality of filaments in accordance with the invention may often be referred to as "filaments", "yarn", "multi-filament yarn", "bundle", "multi-filament bundle" or even "tow", without intending specific limitation by such terms. "Spinning speed" or "withdrawal speed" ($V_S$) refers to the speed of the first driven roll pulling the filaments away from the spinneret.

In addition, the filaments in accordance with the invention may be present together with other filaments in a yarn or bundle where such other filaments are not of the invention, such as, made of different polymer (e.g., polyester) and said companion filaments maybe solid or hollow. In accordance with the invention the nylon and/or the companion filaments may differ in physical properties, such as, but not limited to, difference in VC (including solid), dpf, cross-section (shape, symmetry and aspect-ratio), and placement of the void with respect to the center (by area) of the filament cross-section, and of filaments of nylon polymer which differ in properties, such as shrinkage and dyeability. Such yarns are referred to herein as "mixed-filament" "yarns" (MFY) and the process step of combining the two or more filament components of the MFY may be done in a separate split process, such as co-feeding two yarns of the invention which differ in shrinkage prior to being air-jet textured. Preferably, the different filament components are combined during spinning prior to introduction of interlace and especially at the first point of filament convergence.

As used herein, the term "Residual Draw Ratio" (RDR) is the number of times the length of the yarn may be increased by drawing before the yarn breaks and may be calculated from elongation to break in percent ($E_B$) by the following formula: RDR=[1+($E_B$/100)]. For feed yarns, $(RDR)_F$ refers to the RDR of the feed yarn prior to drawing. $(RDR)_D$ is the RDR of a drawn yarn. Thus, in describing a process in which a feed yarn is subjected to a process draw-ratio (PDR), the PDR is defined by the ratio $(RDR)_F/(RDR)_D$ where the value of $(RDR)_D$ is determined from standard Instron load-extension curves and the value of $(RDR)_F$ may be determined by winding up the feed yarn without drawing and determined from the Instron load-extension curves of the feed yarns or the $(RDR)_F$ may be estimated by the ratio of filament deniers; e.g., $(RDR)_F=[(dpf)_F/(dpf)D_1\times(RDR)_D$; and estimated by the expression: $(RDR)_F=(RDR)_D\cdot PDR$, where $PDR=V_{windup}/V_{feed}$. A spin draw ratio (SDR), analogous to a machine draw ratio and indicating the level of spin orientation, is defined herein by the ratio $(RDR)_{MAX}/(RDR)_S$, wherein $(RDR)_S$ is the measured residual draw ratio of the yarn as spun. $(RDR)_{MAX}$ is the RDR value in absence of orientation, such as determined by Instron testing on a rapidly quenched free-fall filament from the spinneret. For nylon polymers, the value of $(RDR)_{MAX}$ is proportional to the square root of the ratio of the average molecular weight of the polymer chain in the nylon polymer and of the "flexible" chain links contained in the polymer chain (which differs from that of the monomer repeat units). For simplicity, a nominal value of 7 is used herein for $(RDR)_{MAX}$. A level of average spin orientation, used herein, is described by the spin draw ratio (SDR) and is defined by the ratio $(RDR)_{MAX}/(RDR)_S$, wherein $(RDR)_S$ is the measured residual draw ratio of the yarn as spun.

The term "nylon polymer" as used in this application refers to linear, predominantly polycarbonamide homopolymers and copolymers with preferred nylon polymers being poly(hexamethylene adipamide) (nylon 66) and poly(epsilon-caproamide) (nylon 6). The nylon polymers used in preparing the hollow filaments of the invention have a melting point ($T_M$) of about 210° C. to about 310° C., preferably about 240° C. to about 310° C. Nylon polymers containing a minor amount of bi-functional polyamide comonomer units and/or chain branching agents as discussed in detail in Knox et al. U.S. Pat. No. 5,137,666 may be used herein. The value for $T_M$ of the polymer is primarily related to the its chemical composition and $T_M$ is typically depressed 1°–2° C. per mole percent of modifying bi-functional polyamide, such as addition of nylon 6 to nylon 66. For providing a high shrinkage hollow yarns in accordance with the invention, it is preferable to employ a sufficient quantity of a bi-functional comonomer to provide a boil-off shrinkage (S) of at least 12%. For dyed textile apparel applications, the nylon polymer is further characterized by having about 30 to about 70 equivalent $NH_2$-ends per $10^6$ grams of polymer and the nylon polymers may be modified by incorporating cationic moieties as dye sites, such as that formed from ethylene-5-M-sulfo-isophthalic acid and hexamethylene diamine (where M is an alkali metal cation, such as sodium or lithium), so to provide dyeability with cationic dyes. It is also preferable for the nylon polymer to have a large molecule acid dye transition temperature ($T_{dye}$) of at least 65° C. As is also well-known in the art, delusterants such as titanium dioxide, colorants, antioxidants, antistatic agents, and surface friction modifiers, such as silicon dioxide, and other useful additives can be incorporated into the polymer, including minor amounts of immiscible polymers, such as 5% polyester, and agents which either enhance or suppress stress-induced crystallization and/or orientation, such as tri-functional chain branching (acid or diamine) agents.

The nylon polymers used for preparing hollow filaments of the invention have a relative viscosity (RV) of at least 50 which is higher than conventional textile RV of about 35 to 45. Preferably, the nylon polymer has an RV of at least 60, and most preferably at least 70. For most textile uses, there is no advantage to RV values in excess of 100 but higher RV values may be used if thermal and oxidative degradation is minimized as the RV level is increased. Nylon with an RV between 50 to 100 and higher may be obtained by one of a variety of techniques such as by incorporating a catalyst, especially catalysts disclosed in U.S. Pat. No. 4,912,175, into lower RV flake produced in an autoclave and remelting with a vented screw melter with controlled vacuum to produce the desired higher RV polymer. Higher RV flake can be produced directly in an autoclave (AC) using vacuum finishing. Conventional textile RV flake may also be increased in RV by solid phase polymerization (SPP). It is possible also to use a continuous polymerizer (CP) using a finisher where polymerization is performed under controlled temperature and time and finished under vacuum to achieve the increased RV. The molten polymer from the continuous polymerizer (CP) may either be supplied directly to the spinning machine or cast into flake and remelted for use in spinning.

The hollow filaments of the invention are formed at high spinning speeds using spinnerets which initially form multiple melt streams. Process conditions are employed which cause the subsequent post-coalescence of the streams without use of injected gases to maintain the hollow during attenuation. In this application, such coalescence is referred to as "self-coalescence". It is known to coalesce multiple melt streams at low withdrawal speeds (less than 500 mpm) to produce hollow filaments such as taught by British Patents 838,141 and 1,160,263. However, in the process of the present invention where withdrawal speeds are sufficient to reduce the residual draw ratio $(RDR)_S$ to less than 2.75 (typically about 1250–1500 mpm for hollow filaments), it was discovered that such techniques will not produce hollow filaments at such speeds unless the RV is increased to levels higher than used for conventional textile filaments; i.e., increased to values in the range of at least 50 in accordance with the present invention. As in most melt spinning processes, the polymer melt is extruded at $T_P$ that is preferably in the range of about 20° C. to about 50° C. greater than $T_M$ of the nylon polymer.

Figure 4B:
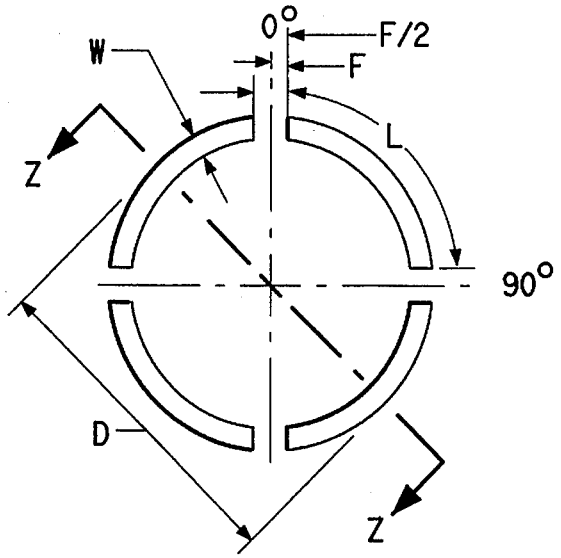
FIGS. 4B, 5B, and 6B are schematics representative of the horizontal plane of the spinneret capillary orifice used herein for spinning of filaments having a single concentric longitudinal void (different capillary spinnerets would be required if more than one longitudinal void is desired); wherein the spinneret capillaries are comprised of two or more arc-shaped orifices (FIGS. 4B, 5B and FIG. 6B) of "rim" width (W) and length (L) and ends (herein also referred to as "toes") of width "F" such to provide an outer diameter (OD) of "D" and an inner diameter (ID) of (D–2W); and where the arc-shaped orifices (FIG. 4B) have enlarged ends of width (G) and radius (R). For the representative capillary orifices of FIGS. 4B, 5B, and 6B, the extrusion area (EA) is defined, using the nomenclature of the figures, by $[(\pi/4)(D^2)]$ and the extrusion void area (EVA) is defined by $[(\pi/4)(D-2W)^2]$ for filaments having circular cross-sections. Non-round cross-sections would require using different expressions, but the definitions of EVA and EA are conceptually the same as that of round cross-sections.
Figure 5B:
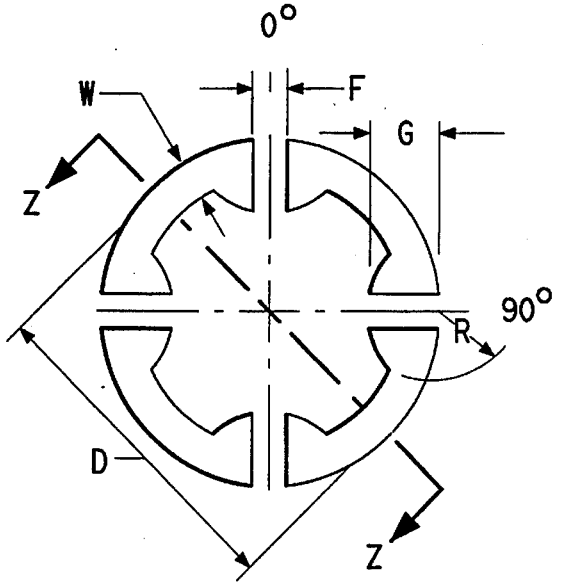
Figure 6B:
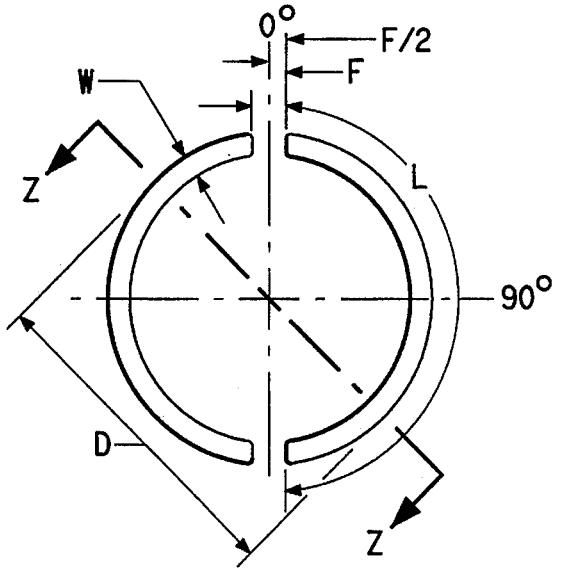

Spinnerets which are known for making hollow filaments at low spinning speeds are useful in a process in accordance with an invention as illustrated, for example, in FIG. 1 of Hodge, U.S. Pat. No. 3,924,988, in FIG. 3 of Most, U.S. Pat. No. 4,444,710, FIG. 1 of Champaneria, et al., U.S. Pat. No. 3,745,061 and as illustrated herein in FIGS. 4B, 5B, and 6B. Extrusion using the above segmented spinneret capillaries is described in description of FIGS. 2, 4 though 6. For the present invention, the arc-shaped orifice segments are arranged so to provide a ratio of the extrusion void area $EVA=[(\pi/4)ID^2]$ where ID=D–2W and the total extrusion area $EA=[(\pi/4)OD^2]$, [EVA/EV], between 0.6 and 0.95 and an extrusion void area EVA, between 0.3 $mm^2$ and 3 $mm^2$. These calculations, for simplification, ignore the areas contributed by small solid "gaps", called "tabs" and sometimes "islands", between the ends of the capillary arc-orifices (sometimes referred to as "slots" of width W and length L). Frequently, the arc-shaped orifices may have enlarged ends (herein referred to as "toes"), as illustrated in FIG. 5B, to compensate for polymer flow not provided by the tabs between the orifice segments and/or for special affects as illustrated by FIGS. 1J and 1K. Extrusion void area (EVA) of values in the range of about 1.5 $mm^2$ to about 3 $mm^2$ with an [EVA/EA] ratio of about 0.70 to about 0.90 is preferred to form uniform hollow filaments of deniers less than 15, useful in most textile fabric end-uses. If there is insufficient extrudate bulge or the polymer rheology has not stabilized at these low polymer flow rates, then using asymmetric orifice counter bores (see FIG. 4A), metering capillaries and/or deep capillaries (i.e. large H/W-values) (FIG. 6A), may be used to achieve the desired fractional VC and self-coalescence. Spinnerets for use in the practice of the invention can be made, for example, by the method described in European Application EP-A 0 440 397, published Aug. 7, 1991, or in European Application EP-A 0 369 460, published May 23, 1990.

After formation of the arc-shaped melt streams using the carefully selected spinnerets, as described herein above, conditions in a quench zone are employed which cause the freshly extruded melt streams to self-coalesce to form uniform hollow filaments with the void being substantially continuous along the length of the filament. It is preferred to protect the extruded melt during and immediately after self-coalescence from stray air currents and to minimize oxidative degradation of the freshly extruded polymer melt. It is common practice to eliminate air (i.e., oxygen) in the first few centimeters by introducing low velocity inert gas, such as nitrogen or steam. Protection from stray air currents may be accomplished, for example, by use of cross-flow quench fitted with a delay tube, as described by Makansi in U.S. Pat. No. 4,529,368, wherein the length of the delay tube $(L_D)$ is selected for the best along-end uniformity and void content. After self-coalescence is complete, the filament bundles may, if desired, be divided into two or more separate bundles of lesser denier and treated as individual bundles during the remaining process steps; and also, the separation may occur at the surface of the spinneret face, if the separation is done in manner that does not adversely affect the uniformity of the self-coalescence and the subsequent uniformity of the attenuating filaments (herein, this is called "multi-ending").

Figure 1A:
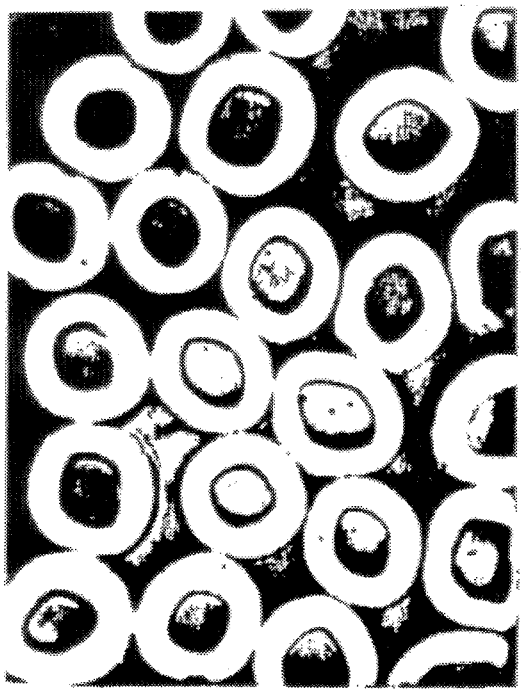
FIGS. 1A–1L are representative copies of enlarged photographs of cross-sections of filaments.
Figure 1B:
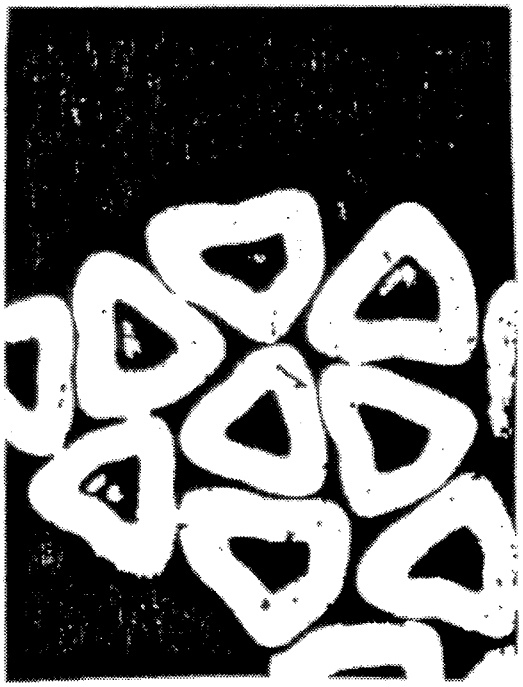
Figure 1C:
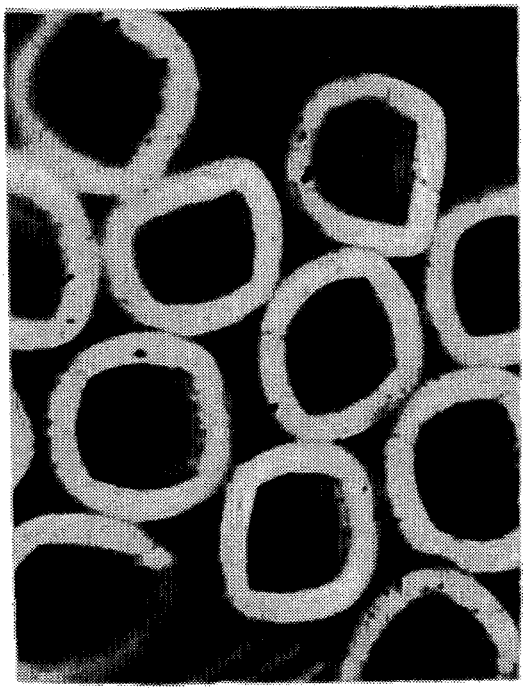
Figure 1D:
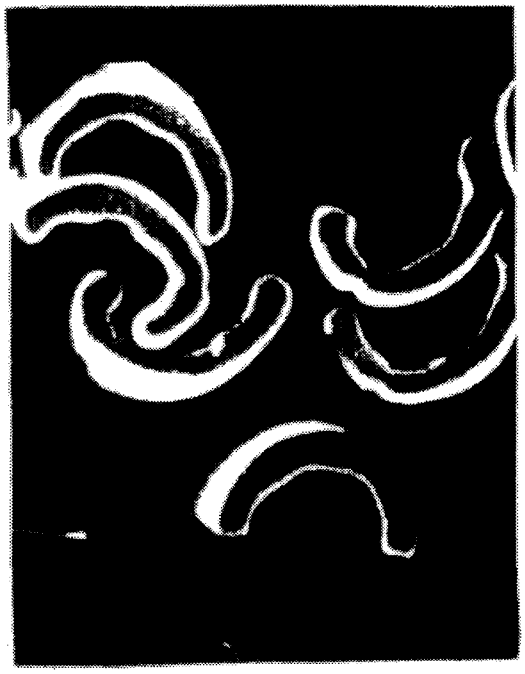
Figure 1E:
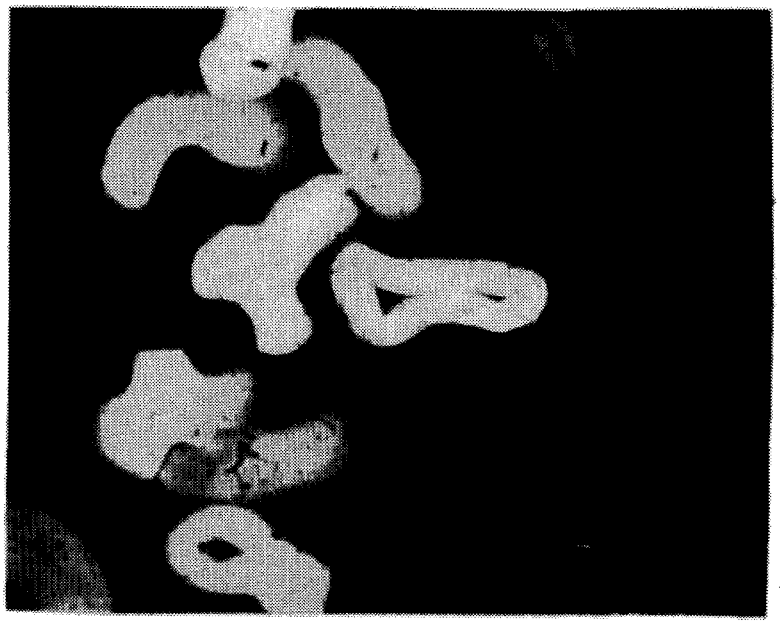
Figure 1F:
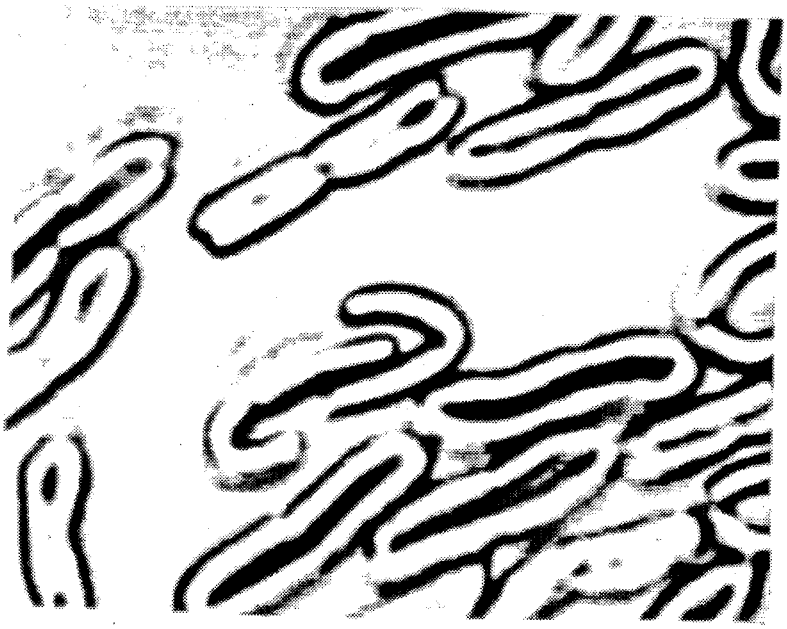
Figure 2:
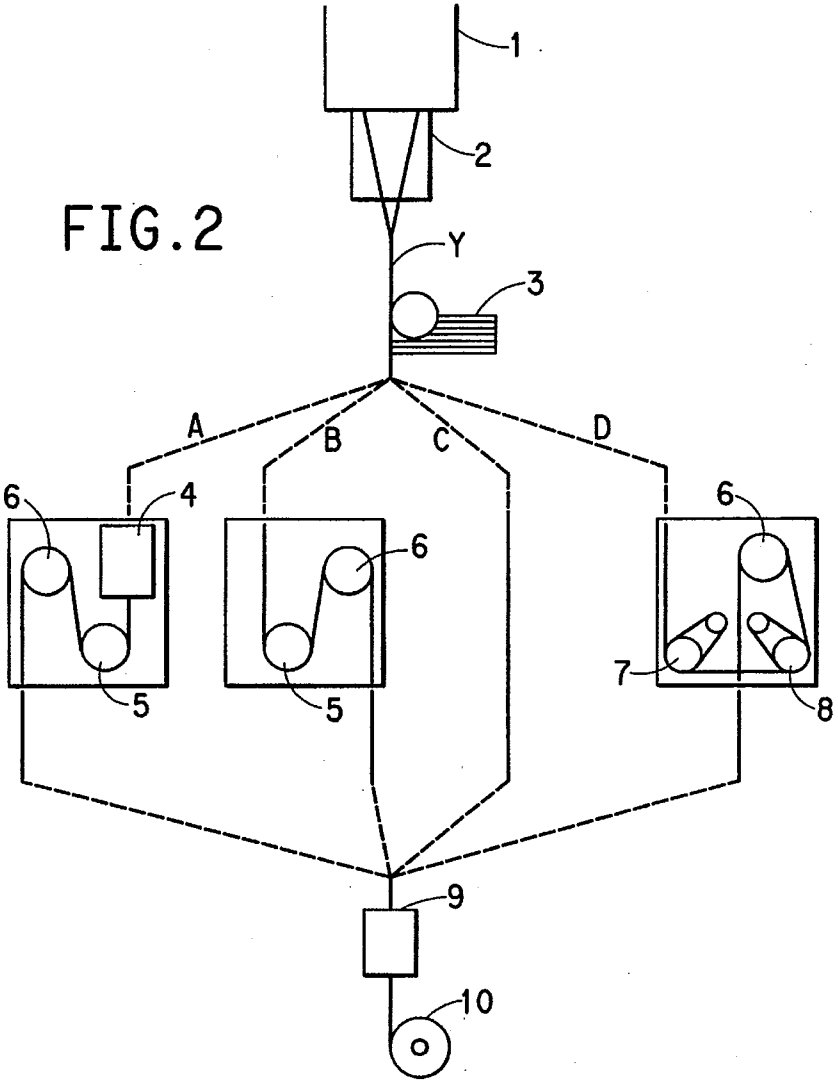
FIG. 2 illustrates the process including alternatives for making flat and feed yarns, where the multi-filament yarn Y is spun from spinneret 1 using a high speed melt spinning process. The filaments are cooled in a "quench" chimney using cross-flow air at, for example, 20° C. and 70% relative humidity (RH) for development of along-end uniformity and mechanical quality by adjusting the quench flow rate Qa (mpm) for the mass flow rate "w" through the spin pack; and for the number of filaments per spinneret area (i.e., for filament density $F_D$, (# fils/cm$^2$). The quenched filaments are then converged at a finish applicator such as a roll or metered finish tip applicator.

It is also observed that increasing the melt viscosity $\eta_{melt}$, [herein taken to be proportional to the expression $\{(RV)[(T_M+25)/T_P]^6\}$ and by increasing the extensional viscosity $\eta_{ext}$ by use of increased quench rate herein denoted as quench factor (QF) where QF is given by the ratio of two expressions. Expression 1 is the ratio of the laminar air flow rates ($Q_a$, mpm) and the mass flow rate in gpm of the spinneret (w) where $w=[(dpf)_S \cdot V_S/9000]\times$number of filaments per spinneret. Expression 2 represents filament density $(F_D)$ which is the number of filaments per spinneret per usable unit area in $cm^2$. Thus, quench factor (QF)=Expression 1/Expression 2. However, too high an extrudate melt viscosity $(\eta_{melt})$ or an extensional viscosity $(\eta_{ext})$ for a given degree and rate of attenuation (as measured herein by the ratio $[EVA/(dpf)_S]$) can lead to incomplete coalescence (FIG. 1D). If desired, the formation of "opens" may be incorporated into the extrusion process step to provide for a mixed-filament yarn, but such an extrusion step must be controlled or spinning performance and subsequent end-use processing performance will be adversely affected. The deliberate formation of "opens" may be made by taking the existing spinneret wherein the arc-shaped orifices have "gaps" of varying widths (or if desired spinneret orifices specifically designed to form "C"-shape "open" filaments) so to provide a mixture of hollow filaments and "open" filaments for obtaining a variety of different tactile aesthetics.

The freshly self-coalesced hollow filaments are then attenuated (i.e., reach $V_S$) in the quench zone at a distance $(L_w)$, quenched to below the polymer glass-transition temperature $(T_g)$ and then converged into a multi-filament bundle at a distance $(L_c)$ which is greater than $L_w$, but as short as possible so not to introduce increased spin line tension from air drag, which must then be removed by a relaxation step in subsequent processing prior to packaging. The convergence of the fully quenched filament bundles is preferably by metered finish tip applicators as described by Agers in U.S. Pat. No. 4,926,661. The length of the convergence zone $(L_c)$, length of quench delay $(L_D)$ and quench air flow velocity $(Q_a)$ are selected to provide for uniform filaments characterized by along-end denier variation [herein referred to as Denier Spread, DS] of preferably less than 4%, more preferably less than 3%, and most preferably than 2%. Preferably, the process of the invention further provides hollow filaments of good mechanical quality as indicated by a normalized tenacity at break $(T_B)_n$ of at least 4 g/dd (grams per drawn denier) and most preferably also at least the value in g/dd of the expression $\{4\cdot[(1-\sqrt{VC})/(1+\sqrt{VC})]+3\}$. $(T_B)_n$ is calculated from the tenacity in grams per drawn denier ($T_B$) by multiplying $T_B$ by $\sqrt{RV/65}$.

The converged filament yarns are withdrawn at $V_S$ sufficient to provide a spun yarn with a $(RDR)_S$ less than 2.75 and then subjected to a stabilization step to reduce the yarn (PDR) to between 2.25 and 1.2. At very high spinning speeds, the treatment of the yarn to reduce its (RDR) to between about 2.25 and about 1.2 will be provided during spinning since the value of the spun $(RDR)_S$ will be within this range. Preferred yarns of invention for use as feed yarns have a residual draw ratio (RDR) of about 1.6 to about 2.25 are advantageously made using such high spinning speeds although other means of stabilization may also be used. If the treatment step is a "mechanical" or "aerodynamic" draw step (or a direct spun step using high $V_S$), it is preferably followed by a relaxation step for proper packaging. If heat is used in the relaxation step, it preferred that the temperature of the filament yarn for critical dye end-uses, such as swim wear and auto upholstery, be selected according to the teachings Boles et al., U.S. Pat. No. 5,219,503, at a yarn relaxation temperature ($T_R$) between 20° C. and a temperature of 40° C. less than the melting point ($T_M$) of the polyamide polymer and less than the expression: $T_R \leqq (1000/[K_1-K_2(RDR)_D])-273°$ C., where for nylon 66 polymers, the values of $K_1$ and $K_2$ are 4.95 and 1.75, respectively; and for nylon 6 polymers, the values of $K_1$ and $K_2$ are 5.35 and 1.95, respectively. Finish type and level and extent of filament interlace is selected based on the end-use processing needs. Filament interlace is preferably provided by use of air jet, such as described in Bunting and Nelson, U.S. Pat. No. 2,985,995, and in Gray, U.S. Pat. No. 3,563,021, wherein the degree of inter-filament entanglement (herein referred to as rapid pin count, RPC) is as measured according to Hitt in U.S. Pat. No. 3,290,932. In one preferred form of the invention, the drawing provides drawn flat yarns having a residual draw ratio $(RDR)_D$ between 1.2 and 1.6. In another preferred form of the invention, the yarns are drawn and bulked to provide a bulked yarn a residual draw ratio (RDR)D between 1.2 and 1.6.

In a process in accordance with the invention, the spun denier is selected such that the value for the denier per filament at 25% elongation, i.e. as if drawn to 25% elongation, and referred to as $(dpf)_{25}$ is about 0.5 to about 20. This expression accounts for varying degrees of orientation which may be imparted to the yarn during spinning which either necessitate or affects the subsequent treatments to reduce (RDR) and which decreases dpf and may be calculated by the formula $[1.25(dpf)_S/(RDR)_S]$. Filaments in accordance with the invention have a denier per filament at 25% elongation $(dpf)_{25}$ of 0.5 to about 20. It is preferred in accordance with the process of the invention for the filaments to have a fractional void content (VC) of at least about $[(7.5\text{Log}_{10}(dpf)+10)/100]$, more preferably at least about $[(7.5\text{Log}_{10}(dpf)+15)/100]$, and most preferably at least about $[(7.5\text{Log}_{10}(dpf)+20)/100]$. Filaments in accordance with the invention have a fractional void content (VC) of at least about $[(7.5\text{Log}_{10}(dpf)+10)/100]$, preferably at least about $[(7.5\text{Log}_{10}(dpf)+15)/100]$, and most preferably at least $[(7.5\text{Log}_{10}(dpf)+20)/100]$.

In the process of the invention, the initial fractional void content of the freshly self-coalesced hollow filament can be assumed to be approximately the same as the fractional extrusion void content [EVA/EA]. During attenuation of the melt, the fractional extrusion void content [EVA/EA] reduces to that of the measured fractional void content of the spun filament. Herein, the ratio of the measured fractional filament void content (VC) and the fractional extrusion void content [EVA/EA]; i.e., [VC/(EVA/EA)], is a measure of the reduction in void content during the melt spinning process and hereinafter referred to as the void retention index (VRI). In a preferred process in accordance with the invention, VRI is at least 0.15. VRI is related to spinning parameters and most preferably also has a value at least the value of the expression $$n\left\{K_1\left[RV\cdot\left(\frac{T_M+25}{T_P}\right)^6\right]\cdot\left[\frac{(dpf)_S\cdot V_S}{1-\frac{EVA}{EA}}\right]^{1/2}\cdot\left[\frac{H}{W}\right]^{0.1}\cdot[QF]^{0.2}+K_2\right\},$$

wherein n is 0.7, $K_1$ is $1.7\times10^{-5}$, and $K_2$ is 0.17.

To obtain desired values of $(RDR)_S$ for a process in accordance with the invention, it is preferred for the base 10 logarithm of the value for the empirical expression of the apparent spinning stress ($\sigma_a$) to be about 1 to about 5.25. ($\sigma_a$) may be obtained from the spinning parameters from the expression $$(\sigma_a)=\left\{K_3\left[RV\cdot\left(\frac{T_M+25}{T_P}\right)^6\right]\cdot\left[\frac{(V_S)^2}{(dpf)_S}\right]\cdot\left[\frac{EVA}{(dpf)_S}\right]^{1/2}\right\}^{0.8}$$

wherein $K_3$ has a value of $9\times10^{-6}$.

Indeed, further modifications will be apparent, especially as these and other technologies advance. For example, any type of draw winding machine may be used; post heat treatment of the feed and/or drawn yarns, if desired, may be applied by any type of heating device (such as heated godets, hot air and/or steam jet, passage through a heated tube, microwave heating, etc.); finish application may be applied by conventional roll application, herein metered finish tip applicators are preferred and finish may be applied in several steps, for example, during spinning prior to drawing and after drawing prior to winding; interlace may be developed by using heated or unheated entanglement air jets and may be developed in several steps, such as during spinning and during drawing and other devices may be used, such as by use of tangle-reeds on a weftless sheet of yarns; and if required devices, such as draw pins or steam draw jets may be used to isolate the draw point so that it does not move unto a roll surface and cause process breaks, for example.

Incorporating filaments of different deniers, void content and/or cross-sections may also be used to reduce filament-to-filament packing and thereby improve tactile aesthetics and comfort. Filaments with differing shrinkages may be present in the same yarns to obtain desired effects. One preferred form of the invention uses higher shrinkage filaments having a shrinkage (S) of at least 12% together with lower shrinkage filaments with a boil-off shrinkage of less than 12%, the difference in shrinkage between at least some of the higher shrinkage filaments and at least some of the lower shrinkage filaments being at least 5%. Such yarns self-bulk on exposure to heat. Unique dyeability effects may be obtained by co-spinning filaments of differing polymer modifications, such as modifying an anionic dyeable nylon with cationic moieties to provide for cationic dyeability. Fabrics comprised of hollow filament yarns provide superior air resistance and cover at lower fabric weight than fabrics containing solid yarns of the same denier. It will be recognized that, where appropriate, the technology may apply also to nylon hollow filaments in other forms, such as tows, which may then be converted into staple fiber.

The woven fabric in accordance with the invention preferably is made from yarns of nylon polymer such as the hollow nylon yarns in accordance with the invention. Yarns in the woven fabric can also be made of any of a variety of other yarns of thermoplastic polymers including, e.g., polyester or polyolefins such as polypropropylene.

With reference to FIGS. 24, 25, 31, and 34 which illustrate preferred embodiments of the present invention, In the fabrics, at least some of the filaments of the yarns are hollow filaments having at least one longitudinal void. In addition, at least a majority of the hollow filaments are collapsed to form collapsed hollow filaments having an oblong exterior cross-section with major and minor dimensions. "Oblong" in this patent application is intended to refer to any of a variety of elongated cross-sectional shapes having major and minor dimensions. Depending on extent to which the filaments have been collapsed, the cross-sections range from oval cross-sections such as the filaments depicted in FIG. 24 to the almost ribbon-like cross-sections of FIG. 34.

In a fabric in accordance with the invention, the major dimensions of the cross-section of at least a majority of the collapsed hollow filaments are generally aligned with having front and back surfaces of the fabric. "Generally aligned" with the fabric surfaces in this application is intended to mean that a line parallel to the major dimension of the collapsed hollow filament is at an angle less than 20 degrees with respect to the surfaces of the fabric.

In accordance with a preferred form of the invention, all of the filaments of the yarns in one of the warp and fill directions are hollow filaments having at least one longitudinal void. While fabrics in accordance with the invention may have fewer than all of the yarns in either the warp or fill directions with hollow filaments, fabrics with very low air permeability are provided when all of the yarns in one of the two fabric directions have filaments which are hollow. It has been found to be particularly advantageous to employ solid yarns for the warp and hollow yarns as the fill yarns.

When the yarns employed are nylon, it is preferred for the hollow filaments to have a denier per filament (dpf) such that the denier per filament at 25% elongation $(dpf)_{25}$ is about 0.5 to about 20. Preferably, the void of said filaments provides a fractional void content (VC) of at least $[(7.5\mathrm{Log}_{10}(dpf)+10)/100]$.

The fabrics in accordance with the invention can be manufactured by calendering woven fabrics containing hollow yarns using conditions which cause the voids to collapse such that the major dimension of the cross-section of the collapsed filaments is in alignment with the fabric surfaces. As will become more apparent from the examples which follow, suitable conditions for calendering are roll temperatures 70° to 360° F. (21° to 182° C.) at 40–60 tons total roll force roll for a 50 inch (127 cm) roll. It is possible to obtain low permeabilities with less severe calendering conditions than have been required for fabrics with all solid yarns. Consequently, when a fabric with a soft "hand" is desired, the conditions for calendering should be no more severe than necessary to get the desired effect on air permeability. Other fabric treatments which produce the same effect as calendering can also be used to manufacture fabrics in accordance with the invention.

Compared to calendered fabrics containing only solid yarns, fabrics in accordance with the invention exhibit lower air permeability, especially at lower calendering temperatures. Low permeability fabrics in accordance with the invention can provide low air permeability without excess stiffness.

From the foregoing, it will be clear that there are many ways to take advantage of the benefits of the preferred and especially preferred feed yarns of the invention in various drawing processes as described herein. Additional uses for and advantages of these feed, drawn, and bulked yarns of the invention are summarized:

1. Potentially reduced surface oligomer deposits for high RV hollow nylon filaments used in draw feed yarns; e.g. for warp drawing and draw texturing.

2. Passing the hollow filament yarns through a calendering process to form collapsed filaments for use as covering yarns of elastomeric filament yarns to provide protection to the elastomer and a more cotton-like hand.

3. Use chain-branching agents to provide hollow filaments of equal void content to filaments spun from polymer without chain-branching agents by a process of lower $(\sigma_a)$ and higher RV values.

4. Use chain-branching agents and/or incorporate 2-methyl pentamethylene diamine as described in PCT Publication No. WO91/19753, published Dec. 26, 1991 to reduce the development of spherulites during attenuation/quenching and thereby increase the tenacity at break of the hollow filament yarns.

5. Incorporate a pigment or carbon black in the nylon polymer such that the spun filaments have a gray color which permits dyeing to deeper shades without increasing dye content of relative to that of an equivalent denier round filaments dyed to equal shade depth (i.e., to overcome the loss in dye yield of hollow filaments due to internal reflectance).

6. Provide pile fabrics which may be cut and brushed such that the cut tubular filaments will fribrillate to finer denier filament ends and provide soft velvet to suede-like tactility.

7. By combination of nylon and polyester polymer, relative viscosities, incorporation of chain branching agents, copolymers, and selection of filament dpf and void content VC, it would be possible to "design" a family of nylon and polyester filaments that have the same $(RDR)_S$ versus spin speed relationship, making them indistinguishable as filaments in a co-draw feed yarns.

The following Examples further illustrate the invention and are not intended to be limiting. Yarn properties and process parameters are measured in accordance with the following test methods.

TEST METHODS

Relative Viscosity (RV) of nylon is the ratio of solution and solvent viscosities measured at 25° C., wherein the solution is an 8.4% by weight polyamide polymer in a solvent of formic acid containing 10% by weight of water.

Fractional Void Content (VC) is measured using the following procedure. A fiber specimen is mounted in a Hardy microtome (Hardy, U.S. Dept. Agricult. circa. 378, 1933) and thin sections are made [according to methods essentially as disclosed in "Fibre Microscopy its Technique and Application" by J. L. Stoves (van Nostrand Co., Inc., New York 1958, pp. 180–182)] and are mounted on a SUPER FIBERQUANT video microscope system stage [VASHAW SCIENTIFIC CO., 3597 Parkway Lane, Suite 100, Norcross, Ga. 30092] and displayed on the SUPER FIBERQUANT CRT under magnification up to 100×, as needed. The image of an individual thin section of the fiber is selected, and its outside and inside diameters are measured automatically by the FIBERQUANT software. The ratio of the cross-sectional area surrounded by the periphery of the filament void region to that of the cross-sectional area of the filament is the fractional void content (VC). Using the FIBERQUANT results, percent void is calculated as the square of the inside diameter divided by the square of the outside diameter of each filament. The process is then repeated for each filament in the field of view to generate a statistically significant sample set that are averaged to provide a value for VC.

Crystal Perfection Index (CPI) is derived from wide angle X-ray diffraction scans (WAXS). The diffraction pattern of fiber of these compositions is characterized by two prominent equatorial X-ray reflections with peaks occurring at scattering angles approximately 20° to 21° and 23°2θ. X-ray patterns were recorded on a XENTRONICS area detector (Model X200B, 10 cm diameter with a 512 by 512 resolution). The X-ray source was a Siemens/Nicolet (3.0 kW) generator operated at 40 kV and 35 mA with a copper radiation source (CU K-alpha, 1.5418 angstroms wavelength). A 0.5 mm collimator was used with sample to camera distance of 10 cm. The detector was centered at an angle of 20 degrees (2θ) to maximize resolution. Exposure time for data collection varied from 10 to 20 minutes to obtain optimum signal level.

Data collection, on the area detector, is started with initial calibration using an Fe55 radiation source which corrects for relative efficiency of detection from individual locations on the detector. Then a background scan is obtained with a blank sample holder to define and remove air scattering of the X-ray beam from the final X-ray pattern. Data is also corrected for the curvature of the detector by using a fiducial plate that contains equally spaced holes on a square grid that is attached to the face of the detector. Sample fiber mounting is vertical at 0.5 to 1.0 mm thick and approximately 10 mm long, with scattering data collected in the equatorial direction or normal to the fiber axis. A computer program analyses the X-ray diffraction data by enabling one dimensional section construction in the appropriate directions, smoothes the data and measures the peak position and full width at half maximum.

The X-ray diffraction measurement of crystallinity in 66 nylon, and copolymers of 66 and 6 nylon is the Crystal Perfection Index (CPI) (as taught by P. F. Dismore and W. O. Statton, *J. Polym. Sci.* Part C, No. 13, pp. 133–148, 1966). The positions of the two peaks at 21° and 23° 2θ are observed to shift, and as the crystallinity increases, the peaks shift farther apart and approach the positions corresponding to the "ideal" positions based on the Bunn-Garner 66 nylon structure. This shift in peak location provides the basis of the measurement of Crystal Perfection Index in 66 nylon:

$$CPI = \frac{[d(\text{outer})/d(\text{inner})] - 1}{0.189} \times 100$$

where d(outer) and d(inner) are the Bragg 'd' spacings for the peaks at 23° and 21° respectively, and the denominator 0.189 is the value for d(100)/d(010) for well-crystallized 66 nylon as reported by Bunn and Garner (Proc. Royal Soc. (London), A189, 39, 1947). An equivalent and more useful equation, based on 2θ values, is:

$$CPI=''2\theta(\text{outer})/2\theta(\text{inner})-1]\times 546.7$$

X-ray Orientation Angle ($COA_{WAXS}$). The same procedures (as discussed in the previous CPI section) are used to obtain and analyze the X-ray diffraction patterns. The diffraction pattern of 66 nylon and copolymers of 66 and 6 nylon has two prominent equatorial reflections at 2θ approximately 20° to 21° and 23°. For 6 nylon one prominent equatorial reflection occurs at 2θ approximately 20° to 21°. The approximately 21° equatorial reflection is used for the measurement of Orientation Angle. A data array equivalent to an azimuthal trace through the equatorial peaks is created from the image data file.

The Orientation Angle ($COA_{WAXS}$) is taken to be the arc length in degrees at the half-maximum optical density (angle subtending points of 50 percent of maximum density) of the equatorial peak, corrected for background.

Small angle X-ray scattering (SAXS) patterns were recorded on a XENTRONICS area detector (Model X200B, 10 cm diameter with 512 by 512 resolution). The X-ray source was a Siemens/Nicolet (3.0 kW) generator operated at 40 kV and 35 mA with a copper radiation source (Cu K-alpha, 1.5418 Å wavelength). A 0.5 mm collimator was used with specimen to camera distance of 50 cm. Exposure time for data collection varied from ½ to 5 hours to obtain optimum signal level. Scattering patterns were analyzed in the meridional direction and parallel to the equatorial direction, through the intensity maxima of the two scattering peaks. Two symmetrical SAXS spots, due to long period spacing distribution, were fitted with a Pearson VII function [see: Heuval et al., *J. Appl. Poly. Sci.*, 22, 2229–2243 (1978)] to obtain maximum intensity, position and full-width at half-maximum. The SAXS intensity (NORM. INT.), normalized for one hour collection time; the average intensity (AVG. INT.) of the four scattering peaks corrected for sample thickness (MULT. FACTOR) and exposure time, were calculated. The normalized intensity (NORM. INT.) is a measure of the difference in electron density between amorphous and crystalline regions of the polymer comprising the spun hollow filament; i.e., NORM. INT.=[AVG. INT.×MULT. FACTOR×60]/[Collect time, min.].

The average lamella dimensions were determined from the SAXS discrete scattering X-ray diffraction maxima. In the meridional direction, this is the average size of the lamellar scatter in the fiber direction. In the equatorial direction, this is the average size of the lamellar scatter perpendicular to the fiber direction. Scherrer's methods were used to estimate sizes of lamellar scatter from the width of the diffraction maxima using: D(Meridional or Equatorial)=(kl/b) cosQ, where k is the shape factor depending on the way b is determined, as discussed below, l is the X-ray wavelength (1.5418 Å); Q is the Bragg angle; and b is the spot width of the discrete scattering in radians. b {meridional}=$(2Q_D-2Q_b)$, where $2Q_D$(radians)=[Arctan(HW+w)]/2r and, $2Q_b$(radians)=[Arctan(HW−w)]/2r; and where r=fiber to camera distance (500 mm), w=corrected half-width of the scattering (discussed below); and HW=peak-to-peak distance (mm) between discrete scattering maxima.

The size of the lamellar scatter in the equatorial direction through the discrete scattering maxima was calculated from Scherrer's equation: b(Equatorial)=2Arctan(w/2$R_o$), where $R_o=[(HW/2)^2+(500)^2]^{0.5}$. As a correction to Scherrer's line broadening equation, Warren's correction for line broadening due to instrumental effects was used. $Wm^2=w^2+W^2$, where: $W_M$=the measured line width, W=0.39 mm (the instrumental contribution from known standards), and w=corrected line width (either in the equatorial or meridional directions) used to calculate the spot width in radians, b. The measured line width $W_M$ was taken to be the width at one-half the maximum diffraction intensity for a particular exposure. This "half-width" parameter was used in the curve fitting procedure. The shape factor, K, in Scherrer's equations was taken to be 0.90. Any line broadening due to variation in periodicity was neglected. The lamellar dimensional product (LDP) is given then by LDP=D(Meridional)× D(Equatorial).

CLO values are a unit of thermal resistance of fabrics and are measured according to ASTM Method D 1518-85, re-approved 1990. The units of CLO are derived from the following expression: CLO=[thickness of fabric (inches)× 0.00164] heat conductivity, where: 0.00164 is a combined factor to yield the specific CLO in (°K.)($m^2$)/Watt per unit thickness. Typically, the heat conductivity measurement is performed on a samples area of fabric (5 cm by 5 cm) and measured at a DT of 10° C. under 6 grams of force per $cm^2$. The heat conductivity (the denominator of the expression above) becomes: (W×D)/(A×DT)=heat conductivity where: W (Watts); D (sample thickness under 150 grams per $cm^2$); A (area=25 $cm^2$); and DT=10° C.

Air permeability is measured in accordance with ASTM Method D 737-75, re-approved 1980, where ASTM D 737 defines air permeability as the rate of air flow through a fabric of known area (7.0 cm diameter) under a fixed differential pressure (12.7 mm Hg) between the two fabric surfaces. Before testing, the fabric is preconditioned at 21°±1° C. and 65±2% relative humidity for at least 16 hours prior to testing. Measurements are reported as cubic feet per minute per square foot (cu ft/min/sq ft), which can be converted to cubic centimeters per second per square centimeter by multiplying by 0.508.

Other polymer, filament, yarn, and fiber structure properties and process parameters for polyester and nylon are measured in accordance with the corresponding test methods and descriptions as disclosed in Knox in U.S. Pat. No. 4,156,071; and by Knox et al in U.S. Pat. Nos. 5,066,427, and 5,137,666 and Boles et al., U.S. Pat. No. 5,219,503.

Various embodiments of the invention are illustrated by, but not limited to, the following Examples. In Tables 1 through 9, PDR (process draw-ratio) is used in place of MDR (machine draw-ratio), where MDR and PDR are equivalent; Ten. is textile tenacity of breaking load (g) per original denier (g/d); Tb (or $T_B$) is the tenacity (grams) per drawn denier (g/dd); $(T_B)_n$ is not shown in the tables but is a value of $T_B$ normalized to a nylon polymer reference RV of 65 and is calculated by multiplying $T_B$ by $\sqrt{RV/65}$; S, %=boil-off shrinkage (%); Fractional Void Content (VC) is stated in percent (%); "Spin" is spinning speed (withdrawal speed, mpm); "Pol Typ" is polymer type; "DPF 25%" (also written as $(dpf)_{25}$ in this application) is the denier of the filaments as if drawn to a constant reference elongation-to-break of 25% (i.e., to a constant RDR of 1.25), the formula [1.25(dpf)/RDR] may be used to calculate $(dpf)_{25}$; MOD. is the initial slope of the Instron load-extension curve (g/d); HC. (or HCT) is the "hot chest temperature °C.; $Q_a$ is the laminar quench air velocity in mpm; "---" denotes data not available; Acid Pyridyl Catalyst=APC (all at 0.098% except where noted); Ester Pyridyl Catalyst=EPC; clave flake polymer=CFP; solid phase polymerization=SPP; Vacuum Finished polymerization=VFP; dead bright luster (DBL)=0.0% $TiO_2$; semi-dull luster (SDL)=0.3% $TiO_2$; N66=nylon 66; N6=nylon 6; 0.15% anti-oxidant 50% neutralized=AOX/50; 0.15% anti-oxidant 100% neutralized=AOX/100, where AOX is phenyl phosphinic acid.

Polymer Types that were used in Examples 1 through 18 are listed as follows: Type I—40 RV CF/APC SDL N66; Type II—40 RV CF/APC DBL N66; Type III—40 RV CF/0.098% EPC/VFP DBL N66; Type IV—40 RV CF/APC DBL N66; Type V—40 RV CF/0.15% EPC/VFP DBL N66; Type VI—80 RV CF/SPP DBL N66; Type VII—40 RV 50/50 blend of II+CF w/10% N6; Type VIII—80 RV CF/VFP DBL N66; Type IX—77 RV CF/VFP DBL N66; Type X—40 RV CF/VFP DBL N66; Type XI—92 RV CF/VFP DBL N66; Type XII—84 RV CF/VFP DBL N66; Type XIII—106 RV CF/VFP DBL N66; Type XIV 97 RV CF/VFP DBL N66.

EXAMPLE 1

Nylon 66 homopolymer was melt spun under the conditions as indicated in Table 1 to produce two metered 14 hollow filament bundles from a single spinneret (except Item 17 was split into four bundles of 7 filaments each), wherein the spinneret was comprised of 28 capillary orifices (FIGS. 4A/B) of height H of 0.254 mm, a width of 0.0762 mm to provide a H/W of 3.33, an OD of 2.03 mm, an ID of 1.876 mm, and a tab width of 0.203 mm to provide an EA of 3.22 $mm^2$, an EVA of 2.77 $mm^2$, and an EVA/EA ratio of 0.86. Items 5 to 12 of Table 1 show the affect of increasing feed roll speed ($V_S$) from 1330 to 2743 mpm wherein fractional filament VC increased from 0.2 to 0.4 with the greatest increase in VC in the 1400 to 1600 mpm range. Further, in Items 5 to 12, the affect of block temperature ($T_P$) was investigated for $T_P$ from 285° C. to 300° C. The fractional filament VC at 2103 mpm decreased from 0.43 with a $T_P$ of 285° C. to 0.36 at $T_P$ of 290° C. and to 0.33 at a $T_P$ of 300° C., or about [0.01 VC/1° C.]. In Item 20 of Table 1 the polymer mass flow rate was reduced to provide spun filaments of 2 dpf at a $V_S$ of 2743 mpm and filament breaks were observed and are attributed to the low mass flow rate for the given spinneret orifice capillary, described herein above.

The polymer was supplied from flake having a nominal RV of about 40 and the RV was increased in a vented screw melter by controlling the applied vacuum; wherein the removal of water extends the condensation polymerization to provide polymer melt of higher RV than that of the clave polymer flake. To permit use of lower vacuum levels catalysts were added, such as 2-(2'pyridyl)ethylphosphonic acid (APC) or diethyl 2-(2'pyridyl)ethylphosphonate (EPC). Also clave RV was increased by solid phase polymerization (SPP). In general, the properties of the spun filament yarns are independent of the method used to increase polymer RV as long as precautions were taken not to contaminate the polymer with gel formed from oxidative and/or thermal degradation and to minimize "fines" (i.e., small polymer dust-like particles) formed during cutting of the polymer strands into flake chips.

The items spun with polymer Type VII which contains 5% of epsilon-caproamide units and 0.049% of EPC have lower VC as a result of lower $\eta_{Melt}$ from the lower level of catalyst as on the effect of spinning at 6° C. higher relative to the melt point $T_M$ of 255° C. versus 261° C. versus nylon 66 homopolymer; that is, the $[(T_M+25)/T_P)]$-ratio is lower at the same polymer $T_P$. Attempts to spin hollow filaments with fractional void content greater than 0.10 with $(RDR)_S$ values less than 2.75 failed for conventional textile polymer RV of less than 50.

It should be noted that the items 1–4, 13 and 21 in Table 1 are included for the purposes of comparison and are not embodiments of the invention since they have an $(RDR)_S$ of greater than 2.75. Items 5 and 6 illustrate the process of the invention but do not have value for $I_{SAXS}$ of at least 175 in accordance with the product of the invention and the preferred process ($I_{SAXS}$ not given in Table 1.)

EXAMPLE 2

In Example 2 shown in Table 2, different 28-hole spinnerets were used all of which were separated in the quench chamber into 2 bundles of 14 filaments each. The capillary dimensions of all the items had the same OD of 2.03 mm, tab of 0.203 mm, and a width of 0.0762 mm like Example 1. The capillary H/W-ratio was increased from 3.33 (Example 1) to 5 and to 8.33 by increasing the capillary depth (H) from 0.254 mm (Example 1) to 0.381 mm and to 0.632 mm, respectively. Process settings that were constant for all items: $Q_a$ of 23 mpm, $V_S$ of 2037 mpm, and HC. of 155° C. The VC of the filaments spun from capillaries of depth (H) of 0.254, 0.381, and 0.632 mm are essentially the same with all other conditions being constant. However, the mechanical strength of the "gap" increases as the depth increases reducing spinneret damage. An analysis of short 0.1 mm capillaries versus the longer capillaries indicates a reduction of about 0.06 from 0.44 to 0.38, that is, the VC increases with the expression $(H/W)^{0.1}$.

EXAMPLE 3

Figure 1G:
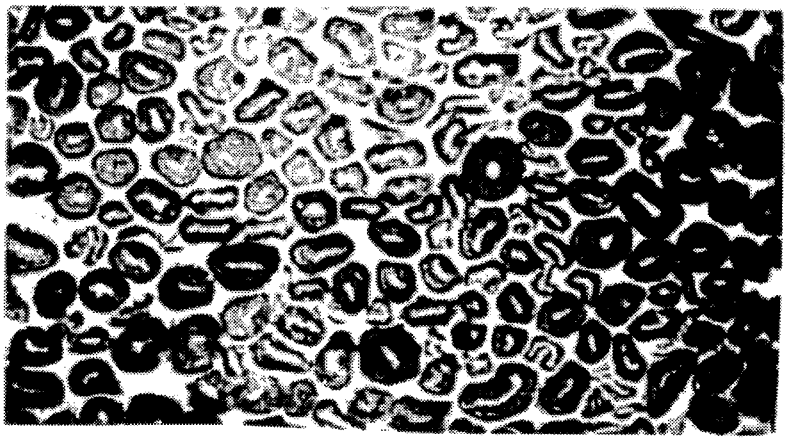
Figure 1H:
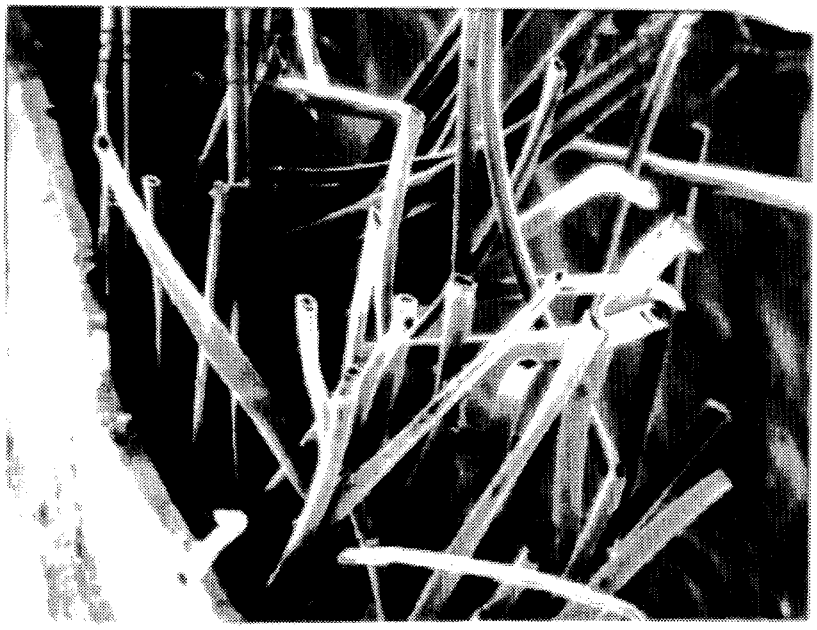
Figure 1I:
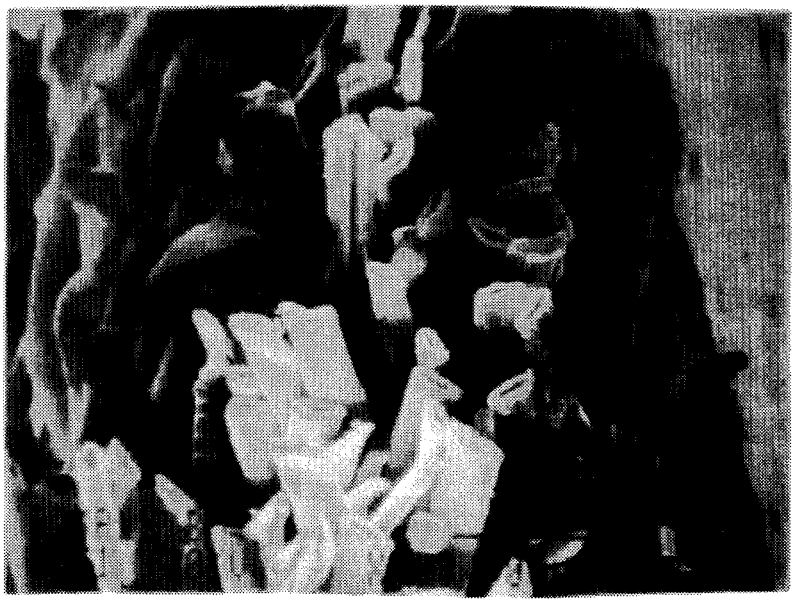
Figure 1J:
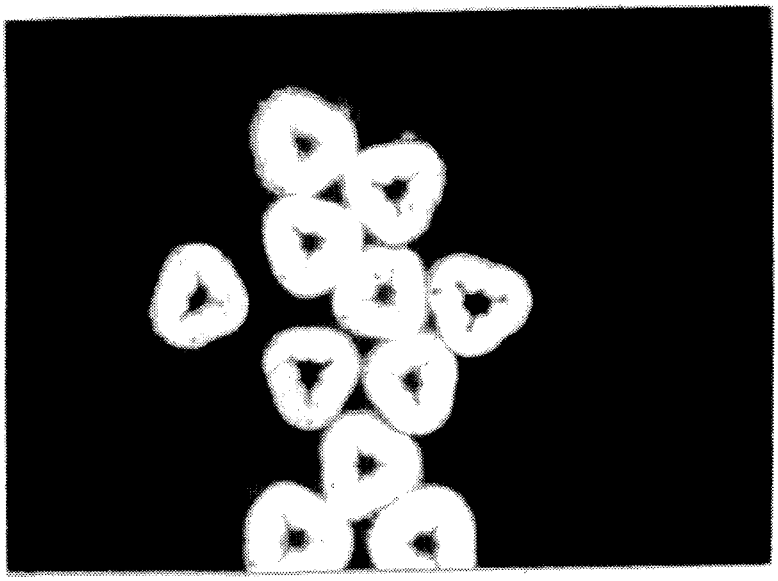
Figure 1K:
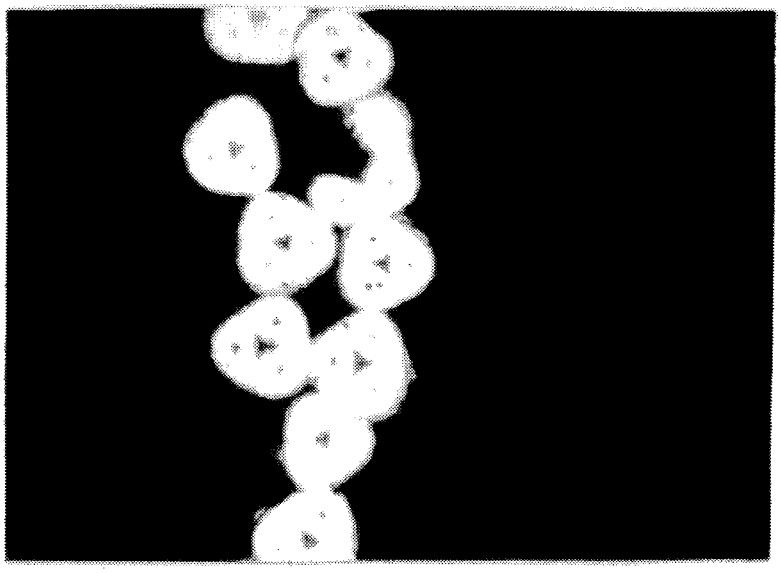

In Example 3 in which process and product properties are shown in Table 3, different 28 hole spinnerets were used, all of which were separated in the quench chamber into 2 bundles of 14 filaments each. The height of the capillary orifice (H) was 0.254 mm except for Item 1 with a height (H) of 0.1 mm. The S-angle is the angle on the island side of the capillary and the T angle is on the outside of the capillary, see FIG. A. Item 1 had an S angle of 45° and T angle of 25°. The remainder of the items in Table 3 have and S and T angle equal to 90° as shown in FIG. 6A. Process settings that were held constant for all items: $T_P$ of 290° C., $Q_a$ of 23 mpm, $V_S$ of 2057 mpm, and a PDR of 1.5. The significant reduction in VC of the smaller capillary OD is shown in items 12 and 13 which used a 0.76 mm OD and items 7–11, 14–31 which used a 1.52 mm OD versus the 2.03 mm OD used for the items in Table 1, see particularly items 25–27 which used the same spin speed. The VC level dropped about 20% between the largest and smallest OD orifice (i.e., with decreasing EVA). The reduction in VC as a result of the smaller capillary slot width (W) is shown in the comparison of items 4, 5, and 6 which used 0.0508 mm slot width and items 2 and 3 which used a 0.0635 mm slot width versus items 25, 26, and 27 which used a 0.0762 mm slot width. The fractional VC dropped 0.03 between each of the progressively increasing slot widths (i.e., with decreasing H/W-ratio and decreasing EVA). It was noted that in items with fractional VC about 0.5–0.6, such as items 3 and 4, the cross-section strength was so low that they are easily deformed (flattened) during processing (i.e., resembling a cross-section of mercerized cotton, such as shown in FIG. 1G).

EXAMPLE 4

In Example 4, N66 type II and type XIV polymers were melt spun from capillary orifices as used in Example 1, except a 68 orifice capillary spinneret was used to provide 68 hollow filaments which were separated in the quench chamber into 2 bundles of 34 filaments each. Process and product properties are shown in Table 4. All of the items were spun at 290° C. except for item 5 which was spun at 293° C. The $Q_a$ for all items was 18 mpm except for item 6 which had a $Q_a$ of 22 mpm. Process settings that were held constant for all the items in this Example: $Q_a$ of 23 mpm, $V_S$ of 2057 mpm, HCT of 155° C. and a PDR of 1.5.

It should be noted that the items 4–6, 28, and 30 in Table 4 are included for the purposes of comparison and are not embodiments of the invention since they have an $(RDR)_S$ of greater than 2.75. Item 27 illustrates the process of the invention but does not have a value for $I_{SAXS}$ of at least 175 in accordance with the product of the invention and the preferred process ($I_{SAXS}$ is not given in Table 4). Item 31 illustrates the process of the invention but does not have a value for fractional void content (VC) of at least about $[(7.5\text{Log}_{10}(\text{dpf})+10)/100]$ in accordance with the product of the invention and the preferred process.

EXAMPLE 5

In Example 5, solid control filaments were spun and their properties are shown in Table 5. Items 1 to 3 used 28 hole spinnerets which were separated in the quench chamber into 2 bundles of 14 filaments each. The round capillary orifice had a height (H), also referred to as depth), of 0.48 mm and a diameter D of 0.33 mm giving a H/D-ratio of about 1.455. Items 4 to 15 used a 68 hole spinneret which was separated in the quench chamber into 2 bundles of 34 filaments each. The capillary orifice had a height H of 0.41 and a diameter D of 0.28 giving a H/D ratio of 1.464. All items by definition had an EVA/EA ratio of 1. Items 1 to 6 had a HCT of 22° C. and items 7 to 15 had a HCT of 155° C. The $V_S$ to achieve a $(RDR)_S$ of 2.75 and of 2.25 were about 1650 mpm and about 2200 mpm, respectively versus about 1300 mpm and about 1900 mpm, respectively, for hollow filament yarns as shown in Tables 1 through 4.

EXAMPLE 6

In Example 6 shown in Table 6, different spinnerets were used. Items 1 to 4 and 11 used a 26 hole spinneret which was separated in the quench chamber into 2 bundles of 13 filaments each. Items 5 to 8 and 12 to 18 used 16 hole spinnerets which were separated in the quench chamber into 2 bundles of 8 filaments each. Item 9 used a 12 hole spinneret which was separated in the quench chamber into 2 bundles of 6 filaments each. Item 10 used a 4 hole spinneret which was separated in the quench chamber into 2 bundles of 2 filaments each. Items 1 to 11 used common capillaries of OD=2.03 mm, depth (H) of 0.1 mm, width (W) of 0.076 mm, and a tab ("gap") of 0.203 mm. Items 12 to 18 used a second set of common capillaries of OD=1.52 mm, depth (H) of 0.254 mm, width (W) of 0.064 mm, and a tab of 0.203 mm. Items 1 to 11 were spun with a $Q_a$ of 18 mpm, while items 12 to 18 had a $Q_a$ of 23 mpm. Process settings were spinning temperatures ($T_P$) of 290° C. except for items 1 to 8 were $T_P$ of 291° C., and HCT of 22° C. for items 1 to 8 and 169° C. for items 9 to 11 and 165° C. for items 12 to 18. Two spinnerets that had opposite entrance angles to the capillaries were tested. The S and T angles were 45° and 25°, respectively for items 4 and 5. Items 1 to 3 and 6 to 11 had opposite S and T entrance angles of 25° and 45°, respectively. The data indicates that the entrance angle does not have a significant effect of on the fractional VC for nylon polymers, it is important for less "elastic" polymer melts, such as for polyesters. The remainder of the items in this Table and in all other Tables, except for item 1 of Table 3, have S and T angles of 90° similar to that as shown in FIG. 6A.

It should be noted that item 5 in Table 6 is included for the purposes of comparison and is not an embodiments of the invention since it has an $(RDR)_S$ of greater than 2.75.

EXAMPLE 7

In Example 7 shown in Table 7 very low denier per filament yarns were produced. All items were 66 filaments per thread-line with 2 thread-lines per spinneret. The spinneret capillary had a 1.08 mm OD, 0.0508 mm width (W), 0.38 mm depth (H), and a 0.127 mm tab width which gives a (EVA/EA) of 0.81. All items were quenched with a $Q_a$ of 23 mpm. As shown in Table 7, items 1 and 2 had a $(DPF)_{25\%}$ less than 1 indicating that the filaments are micro-denier, wherein micro-denier is defined as dpf less than 1. The process parameter that permitted the spinning at such low dpf levels while maintaining a fractional VC greater than 0.10 is a reduction in capillary area by about 25% more than the polymer mass flow rate reduction; that is, the percent change in (EVA/EA) is greater than 1.25× the percent change in $[(dpf)_S V_S)]$. The area reduction is accomplished by reducing the capillary OD and slot width (W). The tab width is reduced to eliminate "opens" caused by incomplete self-coalescence.

It should be noted that item 3 in Table 7 is included for the purposes of comparison and is not an embodiments of the invention since it has an $(RDR)_S$ of greater than 2.75. Item 4 illustrates the process of the invention but does not have value for $I_{SAXS}$ of at least 175 in accordance with the product of the invention and the preferred process ($I_{SAXS}$ is not given in Table 7.)

EXAMPLE 8

In Example 8 as shown in Table 8, the capillary tab width was reduced. All items are 14 filament yarns spun 2 thread-lines per spinneret with a tab width of 0.127 mm, a width of 0.254 mm and a capillary width of 0.0762 min. The $T_P$ was 292° C. and the $Q_a$ was 65 mpm. Item 1 had less than 0.1% opens compared to items 41 to 44 of Table 1 spun under similar conditions, except with a capillary tab width of 0.203 mm had 1 to 10% opens. This reduction in open filaments translated to a reduction in yarn defects from an unacceptably high level of 2–50 defects per million yards (D/MEY) to a commercially acceptable level of 0.1 D/MEY [from 1.8 to 47 defects per million meters (D/MEM) to 0.09 D/MEM]. Similarly items 2 and 3 spun with a 0.127 mm tab width had less than 0.1% opens and less than 1 D/MEY while items spun with the same capillary shown in Table 3 for items 14 to 19 and 24 to 31, except with a wider tab width of 0.203 gave mm 3% opens and 5 D/MEY.

It should be noted that item 3 in Table 8 is included for the purposes of comparison and is not an embodiments of the invention since it has an $(RDR)_S$ of greater than 2.75.

EXAMPLE 9

In Example 9 three plain weave fabrics were made using 40 denier 2-ply air-jet textured fill yarns. The fabrics made using hollow filament yarns had CLO-values of 0.525 and a heat conductivity (w/cm°C.) of 0.00028 and the fabrics using conventional solid filaments had a CLO-value of 0.0507 and a heat conductivity (w/cm°C.) of 0.00027.

EXAMPLE 10

One of the thread lines of a nominal 54 denier, 14 filament yarn made in Example 1, Item 15 having a VC of 0.42 was drawn 1.2× and 1.5× by hand to determine the effect of drawing on percent VC. The resulting fiber maintained the round cross section with the longitudinal void in the center of the filaments and the measured fractional VC was 0.43 for the 1.2 draw ratio and 0.44 for the 1.5 draw ratio which demonstrates that the fractional VC is essentially unchanged by change in filament length.

EXAMPLE 11

The nominal 54 denier, 14 filament hollow yarn, of Example 1, Item 15, was textured at both 500 and 900 mpm. The 2.5 m hot plate was set at 200° C., feed roll was set at 680 mpm and draw roll at 900 mpm to achieve a pre twist tension of 23.8 gms., a post twist tension of 25 gms., and winding tension of 1.5 gms. The conditions yielded a usable textured yarn of 44 denier, 30% elongation and 3.7 g/d tenacity with a bulk of 7.4%. Circular knit tubing of this yarn gave uniform fabric and more cover, especially when the fabric was wet, than a comparable solid filament textured yarn.

EXAMPLE 12

The textured hollow yarn of Example 11 above was used in the fill of an air jet weaving machine with a solid 40 denier warp yarn of 34 solid filaments to make an impression fabric. The fabric was inked and tested as an computer printer ribbon and found to increase ink pickup 23% over that of the solid filament control fabric.

EXAMPLE 13

The hollow 40 denier, 14 filament yarn of Table 1, Item 9 was beamed onto a section beam and woven with the same yarns as the fill yarn. The control 70 denier, 34 filament solid yarn fabric woven with the same conditions had less cover than the hollow yarn. Both a 40 denier, 34 filament hollow yarn (Example 4, Item 24) and a 40 denier, 14 filament hollow yarn (Table 4, Item 9) were woven on a shuttle loom over a 70 denier, 34 filament solid yarn at 96 ends per inch to produce the standard 68–108 pick fabric that was judged acceptable. A 40-14 hollow yarn (Example 1, Item 12) was bulked on a ELTEX air jet texturing machine at 300 mpm. using an air jet pressure of 100 psi (7.0 kg/cm$^2$) with 20% overfeed and then used as a fill yarn in weaving over a standard 70 denier, 34 filament warp yarn to produce a fabric with bulk.

EXAMPLE 14

A 76 gauge Lawson circular knit machine was used to make a 4.5 oz/yd$^2$ (132 g/m$^2$) fabric of 40 denier, 14 filament hollow yarn of Table 4, Item 24. The yarn processed well and made acceptable fabric. In addition to 100% hollow nylon fabric, the same hollow yarn with an elastomeric spandex yarn (LYCRA®) plated in every course and into every other course was made that had a 2.0 oz/yd$^2$ (68 gm/m$^2$) yarn weight. Both the rigid (100% nylon) and elastic fabric made a lighter, more comfortable garment with more cover than a 70-34 solid yarn garment.

EXAMPLE 15

A 28 gauge single end warp knitting machine was used to demonstrate an acceptable hollow filament fabric made form the yarn of Table 1, Item 9 (40 denier, 14 filament. The fabric was judged acceptable for intimate apparel such as girdles.

EXAMPLE 16

A 40 denier, 14 filament hollow yarn (Table 1, Item 24) was used to single cover a 40 denier elastomeric spandex yarn (LYCRA®) on a conventional 2200 rpm spindle speed machine. The covered yarn was then knit into opaque panty hose at 800 rpm using alternate courses of hollow filament nylon yarns and an elastomeric spandex yarn (LYCRA®). The panty hose had good configurational structural dye uniformity and provided greater warmth at the same denier as the solid filament yarn controls.

EXAMPLE 17

Ten to twenty ends of 40 denier, 14 hollow filament yarns (Item 8 of Table 1) were plied into a single yarn bundle and run across a hot plate to heat the yarn to 120° C. at 65 mpm and then fed into a stuffer-box crimper. The crimped yarn was withdrawn and wound up onto a single tube. Six of the crimped yarn tubes were fed into a NEUMEG staple cutter and the yarn were cut to a 2-inch (5.1 cm) crimped staple fibers. Thirty tubes of the same hollow filament yarn bundles were fed directly (without pre-crimping) into the NEUMEG cutter and cut into 2-inch (5.1 cm) lengths. These two staple products were spun via ring spinning into 12/1CC and 10/1CC with a 3.0 twist multiplier in both S and Z twist yams. Athletic socks were knit on a 18-gauge 3.75 inch (8.73 cm) diameter machine. The socks made from the crimped yarn had a cotton-like aesthetics, while the socks knit from the uncrimped yarns had wool-like aesthetics. Laboratory measurements of moisture transport through the foot section of the socks showed that compared to cotton, the planar flow through the hollow nylon filament yarns is 2× greater, while the transplanar flow is about 8× greater. Using the same foot sections samples, the recovery from compression under 6 and 12 lbs./in$^2$ (2 to 4 kg/cm$^2$) for time periods ranging from 0.1 to 10 seconds showed that the nylon samples recovered 33% more to their original thickness than did the cotton sample. When the samples are dry, the nylon hollow filament samples recover 13% more than the original thickness vs. cotton. Finally the nylon hollow filament samples had 50% greater abrasion resistance than cotton. The 10's and 20's singles hollow nylon yarns were then plied into 10/2 and 12/2 yarns and knit on a 5-cut machine feeding three ends per needle. As expected the uncrimped yarns gave wool-like aesthetics versus a wool control and the crimped yarns gave cotton-like aesthetics versus a cotton control. Comparisons were made using both a 1×1 rib and a cable stitch fabrics.

EXAMPLE 18

Figure 1L:
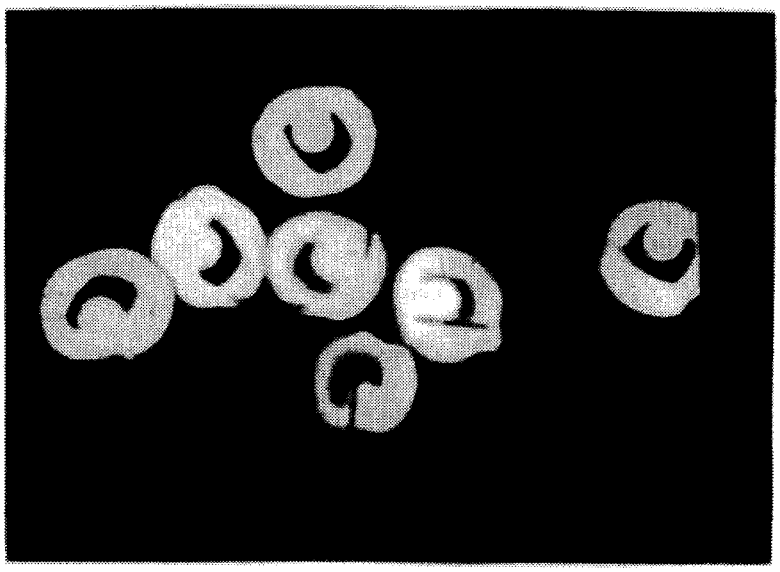

In Example 18, Type XIV nylon was spun with four bundles of seven filaments from a single spinneret in item 3 and combined to two bundles in items 1 and 2. The extrusion orifice was comprised of four arcs and a circular hole (similar to the arrangement of arcs shown in FIG. 4B, except for a circular capillary orifice in the center; and the capillary orifice/counterbore arrangement was similar to that depicted in FIG. 6A). Three of the arcs were 2.5 mils (0.0635 mm) wide and the fourth was 3 mils (0.0762 mm) wide. The circular hole had a diameter of 5 mils (0.127 mm). In Item 1 the 3 mil (0.0762 mm) wide arc was oriented toward the source of the quench air and in Items 2 and 3 have half of the arcs toward the quench air and half away from the quench air. A typical spun filament cross-section is illustrated in FIG. 1L. The multi-filament yarns were knit into ladies panty hose using an elastomeric spandex (Lycra®) in one course and the crimped yarn in the alternate course. The yarn generates 5% crimp on boil-off The hose are superior to those made with uncrimped yarn which have loops of nylon that are is more likely to fail (snag and create a hole) in wearing. In the spinning of the crimpable hollow filament yarns (Items 1, 2 and 3), a 290° C. polymer temperature was selected with a nominal 74 RV for Item 1 and a nominal 80 RV for items 2 and 3 and quenched using laminar quench air flow at a velocity $Q_a$ of 23.3 mpm. The spinnerets were designed to provide a 0.68 fractional extrusion ratio giving fractional void contents of 0.20–0.24. The filaments were withdrawn at a spinning speed of 2286 mpm and drawn 1.478× to provide a nominal $(RDR)_D$ of about 1.45 and a corresponding $(RDK)_S$ of about 2.13.

Examples 9 through 18 show that yarns with RDR-values of about 2.25 to 1.6 are suitable for use as DFY (e.g., for warp-drawing) or for bulking (e.g., by draw-twist texturing, draw-air-jet texturing, draw stuffer-box crimping) and the yarns with RDR-values of about 1.6 to about 1.2 are suitable for flat textile yarns; but these yarns may also be bulked without drawing by air-jet texturing or mechanically crimped. Yarns spun with $(RDR)_S$ values greater than about 2.25 were stabilized by drawing to provide stabilized yarns with RDR values less than 2.25. Stabilization can be achieved by use of steam or heat or by a partial drawing (e.g., 1.05×).

EXAMPLE 19

The single hollow and solid filament components of mixed-filament yarns comprised of hollow filaments of different dpf and mixed-filament yarns comprised of hollow and of solid filaments of the same and/or different dpf may be prepared according to the processes described by Tables 1 through 8, wherein the multi-filament components would, preferably, be co-spun/drawn prior to interlacing the filament bundles into a coherent multi-filament yarn. Comparing the $(RDR)_S$ values of hollow to solid filaments spun under identical conditions show that the hollow filaments have a lower $(RDR)_S$ value and therefore to avoid BFS during the split or coupled drawing step, the PDR is selected such that the ratio $[(RDR)_{S,N}/PDR]$ for the hollow filaments is greater than about 1.2. Further, the mixed-filament yarns may be comprised of different nylon polymers, such as a nylon polymer modified with about 1 to about 3 mole percent of a cationic moiety to provide dyeability with cationic dyes and/or modified with a copolyamide, such as that made from 2-methyl pentamethylene diamine and adipic acid to provide for shrinkages greater than 12%.

EXAMPLE 20

Nylon drawn and POY filaments may be used herein as companion filaments in mixed polyester hollow filament/nylon filament yarns; wherein, the nylon filaments are selected based on their dimensional stability; that is, are selected to avoid or minimize any tendency to spontaneously elongate (grow) at moderate temperatures (referred to in °C.) e.g., over the temperature range of 40° C. to 135° C., as measured by the dynamic length change (given by the difference between the lengths at 135° C. and at 40° C.), of less than 0 under a 5 mg/d load at a heating rate of 50/minute as described in Knox et al, U.S. Pat. No. 5,137,666 and is similar to a stability criterion ($TS_{140°\ C.}$–$TS_{90°\ C.}$) described by Adams in U.S. Pat. No. 3,994,121 (Col. 17 and 18). The nylon companion filaments may be fully or partially drawn cold or hot to elongations ($E_B$) greater than 30% to provide uniform filaments similar to that of low shrinkage polyester hollow filaments of the invention and thus provide for the capability of co-drawing polyamide filaments/polyester hollow filaments. The low shrinkage undrawn hollow polyester filaments may be co-mingled with polyamide filaments and the mixed-filament bundle may be uniformly partially drawn cold or hot to elongations ($E_B$) greater than 30% to provide uniform drawn filaments as low shrinkage polyester filaments, as described by Knox and Noe in U.S. Pat. No. 5,066,427, and thus provide for the capability of co-drawing polyamide/polyester undrawn hollow filaments. The polyamide/polyester hollow filaments may be drawn cold (i.e., without external heating), and up to the onset of cold crystallization $T_{cc}$, to provide polyester hollow filaments of higher shrinkage S and polyamide filaments with shrinkages in the range of about 6 to 10% as disclosed by Boles et al in U.S. Pat. No. 5,223,197. In such processes wherein yarns are post heat treated to reduce shrinkage, such post heat treatments are preferably carried out at temperatures ($T_R$ in degrees C.) less than about the following expression: $T_R \leqq (1000/[4.95-1.75(RDR)_{D,N}]-273)$, where $(RDR)_{D,N}$ is the calculated residual draw-ratio of the drawn nylon filaments, and is at least about 1.2 to provide for uniform dyeability of the nylon filaments with large molecule acid dyes as described by Boles et al in WO91/19839, published Dec. 26, 1991. Preferred polyamide filaments are described by Knox et al in U.S. Pat. No. 5,137,666.

Similar to that of nylon, the polyester hollow filaments had lower $(RDK)_S$ values than the corresponding solid filaments of the same dpf and spun under the same process conditions, except of course for the spinneret orifice. Unlike nylon, it requires higher $V_S$ and/or higher [EVA/dpf] ratios for stress-induced crystallization to take place. It is found that for polyester hollow filaments having a boil-off shrinkage S (such that the ratio $(1-S/S_M)$ is between about 0.4 and about 0.85 where $S_M=[(550-EB)/650]\%$, that the existing SIC levels are sufficient to provide fully drawn polyester filaments of $(RDR)_D$ values between about 1.2 and about 1.4 without losing VC and further without denier variations from neck-drawing typical for "partial drawing" of polyester spun filaments. Co-drawing of hollow polyester filaments, as characterized by a (1–S/SM)-ratio between about 0.4 and about 0.85 filaments, with hollow nylon filaments requires that the polyester filaments be fully drawn to avoid neck-drawing; that is, the co-draw ratio (CDR) for the mixed polyester(P)/nylon(N) hollow filaments be between $[(RDR)_{S,P}/1.2]$ and about $[(RDR)_{S,P}/1.4]$ such that the value of the ratio $[RDR)_{S,N}/CDR]$ for the nylon component is between about 1.2 and about 1.6.

If the (1–S/SM) ratio of the polyester hollow filaments is at least about 0.85 then the polyester hollow (or solid) filaments may be partially drawn hot or cold to $(RDR)_D$ values greater than 1.4 without neck-drawing and, if hollow, without loss in void content (may even observe an increase void content for these polyester hollow filaments). Co-drawing spun hollow nylon and polyester filaments wherein the polyester filaments have a $(1-S/S_M)$-ratio at least about 0.85, is not limited to a given final $(RDR)_D$ for uniformity concerns, but the $(RDR)_D$ is preferably greater than about 1.2 to avoid BFS during end-use processing. To make the mixed nylon/polyester filament yarns compatible with the dyeing of elastomeric containing yarns or fabrics, the polyester may be spun from polymer modified with 1 to about 3 mole percent of a cationic moiety to permit dyeing with cationic dyes rather than disperse dyes which diffuse (bleed) out of elastomeric fibers. The nylon filaments would be dyed normally with anionic acid dyes.

EXAMPLE 21

In Example 21, the tensile, wide-angle-x-ray (WAXS), and small-angle x-ray (SAXS) parameters were measured for a variety of hollow and solid nylon yarns and the measurements are summarized in Table 9. Hollow filaments are represented by rows 1 through 22 and solid filaments by rows 23 through 37. The crystalline Herman's orientation function $F_c$ is approximated in column 12 of Table 9 by the expression $$F_c \approx \frac{90 - COA_{WAXS}}{90}.$$

The estimated volume of the crystals ($V_X$) in cubic Angstroms (Å$^3$) are defined by two different methods. $V_X(A)=\frac{2}{3}(LPS)\cdot(D100)\cdot(D010)$ and $V_X(B)=\{(D100)\cdot(D010)\}^{1.5}$, wherein LPS, D100, and D010 are in Angstroms (Å). The values of $V_X(A)$ and $V_X(B)$ in Å$^3$ are related by the best fit linear regression expression: $V_X(A)=(V_X(B)+25665$. The advantage of $V_X(B)$ is that it does not require measurement of LPS by SAXS. In general the values of $I_{SAXS}$, for example, decrease with increasing polymer RV and increase with increasing spin speed. However, when values of $I_{SAXS}$ are plotted versus $(RDR)_S$ of the spun yarn, the hollow filaments and solid filaments follow a similar relationship. The difference between hollow and solid filaments is that the structural changes occur at lower spinning speeds, i.e., apparent stress values ($\sigma_a$) than for solid filaments. This permits the desired structure of high $I_{SAXS}$ and $COA_{WAXS}$ values to be obtained at moderate spin speeds without requiring the investment in high speed spinning equipment. Items 6, 7, 8, 10, 14, 15, 18, 21 and 22 are hollow filaments which are not preferred embodiments of the invention.

FIG. 20 is an illustrative best fit plot of $COA_{WAXS}$ values for hollow and solid filaments of Table 9 versus the corresponding $(RDR)_S$ values. A broad peak band is observed where filaments having $(RDR)_S$ values between about 1.6 and 2.25 have generally $COA_{WAXS}$ values of greater than about 20 degrees. The range of $(RDR)_S$ values corresponds to the preferred range for draw feed yarns. The figure suggests that preferred draw feed yarns are characterized by a greater crystalline disorder, i.e., higher $COA_{WAXS}$ values. In FIG. 9A, the SAXS intensity ($I_{SAXS}$) is plotted versus the spinning speed and the residual draw ratio of the spun yarn $(RDR)_S$, for a set of 3 denier per filament (3 dpf) yarns. Yarns indicated as b, c, d, e, and f as shown in FIG. 9A and the corresponding photographs of FIGS. *9b, 9c, 9d, 9e,* and *9f* are listed in Table 9 as items 14, 18, 20, 16 and 17, respectively.

EXAMPLE 22

For the purposes of employing the resulting yarns in fabrics in Examples 23–26 which follow, a 160 denier 132 filament nylon hollow nylon 66 yarn with a 22% void content is made in accordance with the procedures of Example 1 except that a 132 capillary spinneret is used, the feed roll speed is 2057 mpm, and the conditions as indicated in Table 10 for Item 1 are employed. Table 10 also lists the properties of the resulting yarn designated as item 1. A 150 denier 34 filament nylon 66 yarn with a 25% void content designated as item 2 in Table 10 is also made in accordance with Example 1 except that a 34 capillary spinneret is used, the feed roll speed is 2057 mpm, and the conditions as indicated in Table 10 are used. Table 10 also lists the properties of the yarn.

EXAMPLE 23

The yarn of Example 22, item 1 is employed as a fill yarn and woven with a Crompton & Knowles S-6 shuttle loom across a 70 end/inch (178 end/cm) warp of 200 denier 34 filament solid nylon yarn at three difference pick levels, 50, 56 and 64 picks/inch (127, 142, 163 picks/cm) to produce fabrics shown in Table 11 as items 1, 2 and 3, respectively. A control fabric is also made using the same warp yarn of items 1, 2, 3 at the same level of ends/inch but with the same solid yarn being used for the fill. Three different pick levels are used, 50, 56 and 60 picks/inch (127, 142, 152 picks/cm) to produce fabrics listed in Table 11 as item 4, 5, and 6, respectively. As shown in FIG. 21, which is an electron microscope photograph of the cross-section of the hollow yarn (fill, items 1, 2, 3) and the solid yarn (warp, all items—fill, items 4, 5, 6) used in this example, the outside diameters of the hollow and solid fill yarns are approximately the same.

An attempt to weave the control fabric at 64 picks/inch (163 picks/cm), the same level as the hollow yarn, is not runnable on this loom because the construction is too tight. Items 7 to 12 are items 1 to 6 that have been calendered on a Verdurin calendering mill using a silk (smooth) roll on both sides (50 inch–127 cm wide fabric).

The air permeability for the uncalendered and the calendered fabric containing the hollow fill yarn is significantly lower than the control fabric containing solid yarn at the same fabric weight as shown in FIG. 22. The air permeability of the uncalendered hollow in this example is about equal to the calendered solid yarn. FIG. 23 shows that air permeability of the fabric with the hollow yarn is lower at the same pick level.

EXAMPLE 24

To make a fabric containing hollow yarns, the yarn of Example 22, item 2, is used as a fill yarn on a commercial Picanol airjet loom at 52 picks (132 picks/cm) and woven across the same 200 denier 34 filament solid nylon 66 warp yarn as used in Example 23 at 67 ends/inch (170 ends/cm). A control fabric is made on the same loom except using a 200 denier 34 filament solid nylon 66 yarn used as a fill yarn at 50 picks/inch (127 picks/cm) and woven across the same 200 denier 34 filament solid nylon 66 warp yarn at 67 ends/inch (170 ends/cm). The hollow yarn employed has approximately the same filament diameter as the solid 200 denier solid yarn. Both undyed fabrics are calendered on a Verdurin calendering mill using a silk (smooth) roll on both sides at 50 tons on the 50 inch (127 cm) fabric.

The air permeability of the both fabrics after calendering are measured and ks the results are shown in Table 12. The air permeability of the fabric with the hollow fill yarn, item 1, had a lower air permeability of 22.8 cubic feet per minute (cfm) compared to the fabric of all solid yarn, item 3, which had an air permeability of 28.9 cubic feet per minute. After 10 washes, the air permeability of the fabric containing the hollow yarn, item 2, is 15.8 cfm which is lower than the same fabric before washing and is lower than the all solid yarn fabric, item 4, which is measured at 19.6 cfm.

FIG. 24 shows the calendered hollow fabric item 1 of table 12. FIG. 25 shows the calendered hollow fabric after washing. FIG. 26 and 27 show the calendered solid fabric before and after washing respectively. These photographs show how the hollow fiber is deformed into a rectangular cross section when it is calendered which is believed contribute to the decreased air permeability compared to the calendered fabric containing only solid yarns.

EXAMPLE 25

The item 1 fabric (hollow fill) and the item 3 fabric (all solid) of Example 24 (Table 12) are finished by dyeing with an acid dye at 208° F. (98° C.) in a Hendrickson jig dyer and heat set on a Bruckner at 375° F. (190° C.). After dyeing, the air permeability of the fabrics were measured. The dyed fabric containing the hollow fill, item 1 of Table 13, has an air permeability of 32.1 cfm. The dyed all solid yarn fabric, item 10 Table 13, has an air permeability of 45.9 cfm. The cross-sectional photographs of items 1 and 10, FIGS. 28 and 29, respectively, show that the hollow yarn is slightly crushed which Applicants believe is responsible for the lower air permeability observed.

The items 1 and 10 fabrics are calendered using a Verdurin calendering mill using silk (smooth) rolls on both sides using 50 tons across the 50 inch (127 cm) fabric. The calendering is performed at various temperatures from ranging 70° to 360° F. and the air permeability of for each of the fabrics is measured and reported in Table 13. In FIG. 30, the air permeability is plotted against the calendering temperature. As can be seen from this data, the fabrics with the hollow fill yarn have lower air permeability than the solid yarn fabrics, especially at lower calendering temperatures. FIG. 31 is a cross-sectional photograph of fabric designated as item 5 (hollow fill) in Table 13 and FIG. 32 is a cross-sectional photograph of the all solid fabric, item 12 in Table 13. While high calendering temperatures cause the air permeability of the all solid yarn fabrics to decrease to low levels, the extreme calendering conditions also produce a still broadly undesirable fabric. Low air permeabilities can be achieved with the fabrics containing the hollow yarns at much lower temperatures which do not cause the fabrics to become unduly stiff.

EXAMPLE 26

The fabrics of Example 25 are washed and the air permeability after ks washing is measured and reported in Table 13. FIG. 33 is a plot of the air permeability after washing plotted against calendering temperature and illustrates that the washed fabrics containing the hollow yarn have lower permeability at lower calendering temperature and approximately equal air permeability at higher calendering temperature. FIGS. 33 and 34 are cross-sectional photographs showing the calendered washed yarns of items 5 and 12 of Table 13. FIG. 34 illustrates that washing opens up the filament bundle but leaves the crushed filaments substantially unchanged.

TABLE 1

| Ex. No. | Pol Typ | RV | Tp, C | Qa mpm | Spin mpm | PDR | HC. C. | RDRd | RDRs | DPFd | DPF 25% | DPFs |
|---|---|---|---|---|---|---|---|---|---|---|---|---|
| 1 | I | 66 | 293 | 11 | 1330 | 2.3 | 160 | 1.32 | 2.99 | 3.1 | 2.9 | 7.0 |
| 2 | I | 69 | 293 | 20 | 1330 | 2.3 | 160 | 1.24 | 2.80 | 3.1 | 3.1 | 6.9 |
| 3 | I | 61 | 293 | 16 | 1330 | 2.3 | 160 | 1.36 | 3.12 | 3.1 | 2.8 | 7.1 |
| 4 | I | 57 | 293 | 16 | 1330 | 2.3 | 160 | 1.37 | 3.17 | 3.0 | 2.8 | 7.0 |
| 5 | I | 77 | 290 | 20 | 1417 | 2.1 | 160 | 1.15 | 2.40 | 2.9 | 3.2 | 6.1 |
| 6 | I | 76 | 290 | 20 | 1829 | 1.6 | 160 | 1.34 | 2.17 | 3.0 | 2.8 | 4.9 |
| 7 | I | 76 | 290 | 20 | 2286 | 1.3 | 160 | 1.49 | 1.96 | 3.0 | 2.6 | 4.0 |

TABLE 1-continued

| | | | | | | | | | | | | |
|---|---|---|---|---|---|---|---|---|---|---|---|---|
| 8 | I | 75 | 290 | 20 | 2103 | 1.4 | 160 | 1.45 | 2.07 | 2.9 | 2.5 | 4.1 |
| 9 | I | 82 | 285 | 20 | 2103 | 1.4 | 160 | 1.43 | 2.04 | 2.7 | 2.4 | 3.9 |
| 10 | I | 76 | 295 | 20 | 2103 | 1.4 | 160 | 1.53 | 2.18 | 2.8 | 2.3 | 4.0 |
| 11 | I | 73 | 300 | 20 | 2103 | 1.4 | 160 | 1.53 | 2.18 | 2.8 | 2.3 | 4.0 |
| 12 | I | 76 | 293 | 20 | 2743 | 1.1 | 160 | 1.65 | 1.87 | 2.7 | 2.0 | 3.0 |
| 13 | I | 63 | 293 | 16 | 1330 | 2.3 | 161 | 1.30 | 3.01 | 3.1 | 3.0 | 7.1 |
| 14 | II | 70 | 290 | 27 | 1829 | 1.5 | 22 | 1.66 | 2.45 | 4.0 | 3.0 | 5.9 |
| 15 | II | 71 | 290 | 27 | 1829 | 1.5 | 22 | 1.69 | 2.50 | 3.9 | 2.9 | 5.7 |
| 16 | II | 66 | 291 | 18 | 1829 | 1.7 | 22 | 1.45 | 2.42 | 3.0 | 2.5 | 4.9 |
| 17 | II | 70 | 291 | 18 | 2286 | 1.3 | 22 | 1.50 | 2.00 | 2.9 | 2.4 | 3.8 |
| 18 | II | 66 | 289 | 23 | 1829 | 1.7 | 155 | 1.43 | 2.46 | 3.0 | 2.6 | 5.1 |
| 19 | II | 78 | 293 | 20 | 3109 | 1.0 | 160 | 1.67 | 1.67 | 2.6 | 1.9 | 2.5 |
| 20 | II | 78 | 298 | 20 | 2743 | 1.1 | 160 | 1.41 | 1.58 | 1.9 | 1.7 | 2.1 |
| 21 | II | 76 | 294 | 21 | 1330 | 2.3 | 160 | 1.35 | 3.10 | 3.0 | 2.8 | 7.0 |
| 22 | II | 78 | 291 | 18 | 2286 | 1.4 | 169 | 1.50 | 2.09 | 2.8 | 2.3 | 3.9 |
| 23 | II | 71 | 291 | 18 | 2286 | 1.4 | 169 | 1.53 | 2.17 | 2.9 | 2.4 | 4.1 |
| 24 | III | 67 | 290 | 23 | 1829 | 1.7 | 155 | 1.34 | 2.32 | 3.0 | 2.8 | 5.1 |
| 25 | IX | 68 | 290 | 23 | 2057 | 1.5 | 165 | 1.55 | 2.38 | 3.3 | 2.7 | 5.1 |
| 26 | IX | 67 | 290 | 23 | 2057 | 1.5 | 165 | 1.54 | 2.36 | 3.3 | 2.7 | 5.1 |
| 27 | IX | 72 | 290 | 23 | 2057 | 1.5 | 165 | 1.43 | 2.20 | 3.3 | 2.8 | 5.0 |
| 28 | VI | 67 | 291 | 18 | 1829 | 1.7 | 169 | 1.38 | 2.37 | 2.7 | 2.5 | 4.7 |
| 29 | VI | 69 | 291 | 18 | 1829 | 1.7 | 169 | 1.34 | 2.31 | 2.8 | 2.6 | 4.8 |
| 30 | VI | 69 | 291 | 18 | 1829 | 1.7 | 169 | 1.41 | 2.43 | 2.8 | 2.4 | 4.7 |
| 31 | VI | 71 | 291 | 18 | 2932 | 1.1 | 169 | 1.71 | 1.88 | 2.8 | 2.0 | 3.1 |
| 32 | VII | 68 | 291 | 18 | 2286 | 1.4 | 169 | 1.49 | 2.07 | 2.9 | 2.4 | 4.0 |
| 33 | VII | 62 | 291 | 18 | 2286 | 1.4 | 169 | 1.53 | 2.17 | 2.9 | 2.4 | 4.1 |
| 34 | VII | 62 | 291 | 18 | 3109 | 1.0 | 169 | 1.72 | 1.80 | 2.9 | 2.1 | 3.0 |
| 35 | VII | 68 | 291 | 18 | 3109 | 1.1 | 169 | 1.73 | 1.83 | 2.9 | 2.1 | 3.0 |
| 36 | XI | 69 | 290 | 23 | 2057 | 1.5 | 165 | 1.45 | 2.23 | 3.2 | 2.8 | 5.0 |
| 37 | XI | 65 | 290 | 23 | 2057 | 1.5 | 165 | 1.40 | 2.15 | 3.2 | 2.8 | 4.9 |
| 38 | XI | 77 | 290 | 23 | 2057 | 1.5 | 165 | 1.48 | 2.25 | 3.5 | 3.0 | 5.3 |
| 39 | XII | 67 | 290 | 23 | 2057 | 1.5 | 165 | 1.52 | 2.33 | 3.2 | 2.6 | 4.9 |
| 40 | XII | 68 | 290 | 23 | 2057 | 1.5 | 165 | 1.51 | 2.32 | 3.2 | 2.7 | 5.0 |
| 41 | XIII | 82 | 291 | 65 | 1829 | 1.6 | 22 | 1.59 | 2.53 | 4.0 | 3.1 | 6.3 |
| 42 | XIII | 69 | 292 | 65 | 2012 | 1.6 | 165 | 1.54 | 2.43 | 3.2 | 2.6 | 5.0 |
| 43 | XIII | 79 | 292 | 65 | 2012 | 1.6 | 168 | 1.45 | 2.29 | 3.2 | 2.7 | 5.0 |
| 44 | XIII | 79 | 293 | 65 | 2012 | 1.6 | 168 | 1.56 | 2.44 | 5.0 | 4.0 | 7.8 |
| 45 | XIV | 77 | 292 | 65 | 2012 | 1.5 | 169 | 1.48 | 2.29 | 3.2 | 2.7 | 5.0 |

| Ex. No. | EVA/ DPFs | Vc, % | S, % | Mod gpd | Ten gpd | Eb, % | Tb, g/dd |
|---|---|---|---|---|---|---|---|
| 1 | 0.40 | 18 | 8 | 34 | 5.1 | 32 | 6.8 |
| 2 | 0.40 | 26 | 8 | 35 | 5.1 | 24 | 6.3 |
| 3 | 0.39 | 16 | 8 | 46 | 4.8 | 36 | 6.5 |
| 4 | 0.39 | 14 | 7 | 44 | 4.4 | 37 | 6.1 |
| 5 | 0.46 | 41 | 9 | 60 | 4.4 | 15 | 5.1 |
| 6 | 0.57 | 43 | 9 | 30 | 3.6 | 34 | 4.8 |
| 7 | 0.69 | 47 | 8 | 16 | 2.7 | 49 | 4.1 |
| 8 | 0.67 | 43 | 8 | 19 | 3.0 | 45 | 4.4 |
| 9 | 0.71 | 45 | 9 | 25 | 3.1 | 43 | 4.4 |
| 10 | 0.70 | 36 | 8 | 16 | 3.0 | 53 | 4.6 |
| 11 | 0.69 | 33 | 8 | 18 | 3.4 | 53 | 5.1 |
| 12 | 0.92 | 41 | 7 | 19 | 2.5 | 65 | 4.1 |
| 13 | 0.39 | 16 | 7 | 41 | 4.3 | 30 | 5.6 |
| 14 | 0.47 | 46 | 9 | 18 | 3.2 | 66 | 5.3 |
| 15 | 0.49 | 42 | 9 | 13 | 3.2 | 69 | 5.4 |
| 16 | 0.56 | 39 | 10 | 20 | 3.6 | 45 | 5.2 |
| 17 | 0.73 | 43 | 10 | 16 | 3.1 | 50 | 4.7 |
| 18 | 0.55 | 42 | 8 | 18 | 3.8 | 43 | 5.4 |
| 19 | 1.09 | 42 | 6 | 12 | 2.1 | 67 | 3.5 |
| 20 | 1.32 | 43 | 7 | 18 | 2.3 | 41 | 3.3 |
| 21 | 0.40 | 22 | 8 | 46 | 5.2 | 35 | 7.0 |
| 22 | 0.71 | 50 | 8 | 19 | 3.1 | 50 | 4.7 |
| 23 | 0.67 | 33 | — | 14 | 3.7 | 53 | 5.7 |
| 24 | 0.54 | 41 | 8 | 25 | 3.4 | 34 | 4.6 |
| 25 | 0.54 | 38 | 7 | 20 | 3.5 | 55 | 5.4 |
| 26 | 0.54 | 45 | 9 | 27 | 3.4 | 54 | 5.2 |
| 27 | 0.56 | 48 | 8 | 29 | 3.3 | 43 | 4.7 |
| 28 | 0.59 | 39 | 6 | 27 | 4.0 | 38 | 5.5 |
| 29 | 0.58 | 38 | 7 | 28 | 3.8 | 34 | 5.1 |
| 30 | 0.58 | 42 | 8 | 28 | 4.0 | 41 | 5.6 |
| 31 | 0.90 | 33 | 5 | 11 | 2.3 | 71 | 3.9 |
| 32 | 0.69 | 36 | — | — | 3.5 | 49 | 5.2 |
| 33 | 0.67 | 34 | — | 15 | 3.5 | 53 | 5.4 |
| 34 | 0.93 | 33 | — | 10 | 2.6 | 72 | 4.5 |
| 35 | 0.91 | 46 | — | 10 | 2.6 | 73 | 4.5 |
| 36 | 0.56 | 43 | 8 | 27 | 3.6 | 45 | 5.2 |
| 37 | 0.57 | 42 | 9 | 19 | 3.6 | 40 | 5.0 |

TABLE 1-continued

| | | | | | | | |
|---|---|---|---|---|---|---|---|
| 38 | 0.52 | 39 | 8 | 26 | 3.4 | 48 | 5.1 |
| 39 | 0.56 | 41 | 8 | 26 | 3.9 | 52 | 5.9 |
| 40 | 0.56 | 35 | 7 | 33 | 3.6 | 51 | 5.5 |
| 41 | 0.44 | 46 | 11 | 15 | 3.6 | 59 | 5.7 |
| 42 | 0.55 | 39 | 5 | 24 | 4.5 | 54 | 6.9 |
| 43 | 0.55 | 42 | 7 | 24 | 4.0 | 45 | 5.8 |
| 44 | 0.36 | 46 | 6 | 21 | 3.6 | 56 | 5.7 |
| 45 | 0.56 | 36 | 6 | 27 | 4.1 | 48 | 6.1 |

TABLE 2

| Ex. No. | Pol Typ | RV | Tp. c | RDRd | RDRs | DPFd | DPF 25% | DPFs | H/W | EVA/ DPFs | Vc, % | S, % | Mod gpd | Ten gpd | Eb, % | Tb, g/dd |
|---|---|---|---|---|---|---|---|---|---|---|---|---|---|---|---|---|
| 1 | I | 69 | 293 | 1.48 | 2.27 | 3.1 | 2.7 | 4.8 | 8.33 | 0.57 | 34 | 8 | 18 | 3.3 | 48 | 4.9 |
| 2 | I | 63 | 292 | 1.55 | 2.38 | 3.2 | 2.6 | 5.0 | 8.33 | 0.56 | 25 | 7 | 24 | 3.4 | 55 | 5.3 |
| 3 | I | 65 | 293 | 1.53 | 2.35 | 3.2 | 2.6 | 5.0 | 8.33 | 0.56 | 27 | 7 | 21 | 3.4 | 53 | 5.2 |
| 4 | I | 70 | 293 | 1.48 | 2.27 | 3.3 | 2.8 | 5.1 | 8.33 | 0.55 | 34 | 8 | 22 | 3.6 | 48 | 5.3 |
| 5 | I | 70 | 293 | 1.47 | 2.26 | 3.3 | 2.8 | 5.0 | 5.00 | 0.55 | 33 | 8 | 19 | 3.7 | 47 | 5.4 |
| 6 | II | 67 | 292 | 1.52 | 2.33 | 3.2 | 2.6 | 4.9 | 8.33 | 0.56 | 35 | 7 | 24 | 3.2 | 52 | 4.9 |
| 7 | III | 73 | 292 | 1.41 | 2.16 | 6.3 | 5.6 | 9.7 | 5.00 | 0.29 | 48 | 10 | 24 | 3.1 | 41 | 4.4 |
| 8 | III | 70 | 292 | 1.41 | 2.17 | 3.3 | 2.9 | 5.1 | 8.33 | 0.55 | 47 | 9 | 29 | 3.3 | 41 | 4.6 |
| 9 | III | 69 | 292 | 1.45 | 2.24 | 3.2 | 2.7 | 4.9 | 8.33 | 0.56 | 42 | 8 | 25 | 3.1 | 45 | 4.6 |
| 10 | III | 66 | 292 | 1.53 | 2.36 | 3.2 | 2.6 | 4.9 | 8.33 | 0.56 | 36 | 8 | 17 | 3.4 | 53 | 5.2 |
| 11 | IV | 68 | 290 | 1.48 | 2.27 | 3.2 | 2.7 | 5.0 | 5.00 | 0.56 | 46 | 8 | 15 | 3.3 | 48 | 4.8 |
| 12 | IV | 81 | 291 | 1.48 | 2.27 | 3.2 | 2.7 | 4.9 | 5.00 | 0.57 | 53 | 9 | 27 | 3.5 | 48 | 5.2 |
| 13 | IV | 60 | 292 | 1.59 | 2.44 | 3.3 | 2.6 | 5.1 | 5.00 | 0.54 | 30 | 7 | 17 | 3.5 | 59 | 5.6 |
| 14 | IV | 74 | 292 | 1.53 | 2.35 | 3.2 | 2.6 | 4.9 | 5.00 | 0.56 | 47 | 8 | 21 | 3.5 | 53 | 5.3 |
| 15 | IV | 86 | 291 | 1.43 | 2.19 | 3.2 | 2.8 | 4.9 | 5.00 | 0.57 | 52 | 9 | 23 | 3.6 | 43 | 5.1 |
| 16 | IV | 74 | 292 | 1.50 | 2.31 | 3.3 | 2.7 | 5.1 | 5.00 | 0.55 | 47 | 8 | 19 | 3.6 | 50 | 5.4 |
| 17 | V | 68 | 290 | 1.51 | 2.32 | 3.3 | 2.7 | 5.1 | 5.00 | 0.55 | 45 | — | 28 | 3.8 | 51 | 5.8 |
| 18 | V | 76 | 291 | 1.49 | 2.28 | 3.3 | 2.8 | 5.1 | 5.00 | 0.55 | 43 | 8 | 26 | 3.6 | 49 | 5.3 |
| 19 | VIII | 72 | 290 | 1.51 | 2.32 | 3.3 | 2.7 | 5.1 | 5.00 | 0.55 | 40 | 8 | 27 | 3.3 | 51 | 5.0 |
| 20 | VIII | 66 | 290 | 1.63 | 2.51 | 3.3 | 2.5 | 5.1 | 5.00 | 0.55 | 33 | 7 | 17 | 3.4 | 63 | 5.5 |

TABLE 3

| Ex. No. | Pol Typ | RV | HC C. | RDRd | RDRs | DPFd | DPF 25% | DPFs | H/W | OD | EVA /EA | EVA/ DPFs | Vc, % | S, % | Mod gpd | Ten gpd | Eb, % | Tb, g/dd |
|---|---|---|---|---|---|---|---|---|---|---|---|---|---|---|---|---|---|---|
| 1 | I | 63 | 155 | 1.51 | 2.32 | 3.4 | 2.8 | 5.2 | 1.33 | 2.03 | 0.86 | 0.53 | 31 | 7 | 19 | 3.7 | 51 | 5.6 |
| 2 | IX | 71 | 165 | 1.51 | 2.31 | 3.3 | 2.7 | 5.0 | 4.00 | 2.03 | 0.88 | 0.57 | 45 | 8 | 18 | 3.4 | 51 | 5.1 |
| 3 | IX | 68 | 165 | 1.50 | 2.30 | 3.3 | 2.7 | 5.0 | 4.00 | 2.03 | 0.88 | 0.57 | 50 | 8 | 26 | 3.2 | 50 | 4.8 |
| 4 | IX | 69 | 165 | 1.45 | 2.22 | 3.1 | 2.7 | 4.8 | 5.00 | 2.03 | 0.90 | 0.61 | 58 | 9 | 30 | 3.2 | 45 | 4.7 |
| 5 | IX | 67 | 165 | 1.52 | 2.33 | 3.2 | 2.6 | 4.9 | 5.00 | 2.03 | 0.90 | 0.59 | 44 | 8 | 17 | 3.4 | 52 | 5.2 |
| 6 | IX | 65 | 165 | 1.45 | 2.23 | 3.2 | 2.8 | 4.9 | 5.00 | 2.03 | 0.90 | 0.59 | 38 | 8 | 18 | 3.1 | 45 | 4.5 |
| 7 | IX | 65 | 165 | — | — | — | — | — | 4.00 | 1.52 | 0.84 | — | 41 | 7 | — | — | — | — |
| 8 | IX | 67 | 165 | 1.54 | 2.36 | 3.2 | 2.6 | 4.9 | 4.00 | 1.52 | 0.84 | 0.31 | 41 | 8 | 25 | 3.5 | 54 | 5.4 |
| 9 | IX | 67 | 165 | 1.46 | 2.24 | 3.1 | 2.7 | 4.8 | 4.00 | 1.52 | 0.84 | 0.32 | 33 | 9 | 30 | 3.4 | 46 | 5.0 |
| 10 | IX | 73 | 165 | 1.49 | 2.29 | 3.0 | 2.5 | 4.6 | 3.33 | 1.52 | 0.81 | 0.32 | 35 | 9 | 22 | 3.6 | 49 | 5.4 |
| 11 | IX | 70 | 165 | 1.58 | 2.42 | 3.2 | 2.6 | 5.0 | 3.33 | 1.52 | 0.81 | 0.30 | 28 | 7 | 20 | 3.8 | 58 | 5.9 |
| 12 | IX | 70 | 165 | 1.56 | 2.39 | 3.3 | 2.6 | 5.1 | 3.33 | 0.76 | 0.64 | 0.06 | 15 | 7 | 17 | 3.7 | 56 | 5.7 |
| 13 | IX | 69 | 165 | 1.41 | 2.16 | 3.1 | 2.8 | 4.8 | 3.33 | 0.76 | 0.64 | 0.06 | 19 | 9 | 20 | 2.9 | 41 | 4.1 |
| 14 | IX | 71 | 165 | 1.48 | 2.27 | 3.4 | 2.9 | 5.2 | 3.33 | 1.52 | 0.81 | 0.28 | 35 | 7 | 19 | 3.2 | 48 | 4.8 |
| 15 | IX | 71 | 165 | 1.58 | 2.42 | 3.2 | 2.5 | 4.9 | 3.33 | 1.52 | 0.81 | 0.30 | 24 | 6 | 17 | 3.7 | 58 | 5.8 |
| 16 | IX | 62 | 165 | 1.55 | 2.38 | 3.1 | 2.5 | 4.8 | 3.33 | 1.52 | 0.81 | 0.31 | 32 | 7 | 20 | 3.8 | 55 | 5.8 |
| 17 | XI | 79 | 165 | 1.43 | 2.19 | 2.9 | 2.5 | 4.4 | 3.33 | 1.52 | 0.81 | 0.34 | 40 | 9 | 23 | 4.0 | 43 | 5.7 |
| 18 | XI | 83 | 165 | 1.50 | 2.31 | 3.2 | 2.7 | 4.9 | 3.33 | 1.52 | 0.81 | 0.30 | 36 | 8 | 24 | 3.8 | 50 | 5.6 |
| 19 | XI | 77 | 165 | 1.52 | 2.32 | 3.2 | 2.6 | 4.9 | 3.33 | 1.52 | 0.81 | 0.30 | 36 | 8 | 18 | 3.7 | 52 | 5.6 |
| 20 | XI | 73 | 165 | 1.45 | 2.22 | 3.3 | 2.8 | 5.0 | 4.00 | 1.52 | 0.84 | 0.30 | 38 | 6 | 20 | 3.7 | 45 | 5.4 |
| 21 | XI | 72 | 165 | 1.47 | 2.23 | 3.2 | 2.7 | 4.9 | 4.00 | 1.52 | 0.84 | 0.31 | 40 | 8 | 25 | 3.3 | 47 | 4.8 |
| 22 | XI | 77 | 165 | 1.50 | 2.29 | 3.4 | 2.8 | 5.2 | 4.00 | 1.52 | 0.84 | 0.30 | 38 | 8 | 21 | 3.5 | 50 | 5.3 |
| 23 | XI | 70 | 165 | 1.50 | 2.30 | 3.1 | 2.6 | 4.8 | 4.00 | 1.52 | 0.84 | 0.32 | 36 | 8 | 25 | 3.9 | 50 | 5.8 |
| 24 | XI | 73 | 165 | 1.48 | 2.26 | 3.2 | 2.7 | 4.8 | 3.33 | 1.52 | 0.81 | 0.31 | 35 | 9 | 30 | 3.9 | 48 | 5.5 |
| 25 | XI | 72 | 165 | — | — | 3.2 | — | 4.9 | 3.33 | 1.52 | 0.81 | 0.30 | 36 | 8 | — | — | — | — |
| 26 | XI | 80 | 165 | 1.51 | 2.31 | 3.2 | 2.7 | 5.0 | 3.33 | 1.52 | 0.81 | 0.30 | 38 | — | 19 | 3.9 | 51 | 6.0 |
| 27 | XI | 72 | 165 | — | — | — | — | — | 3.33 | 1.52 | 0.81 | — | 33 | 7 | — | — | — | — |
| 28 | XI | 72 | 165 | 1.49 | 2.28 | 3.3 | 2.8 | 5.1 | 3.33 | 1.52 | 0.81 | 0.29 | 36 | 7 | 27 | 4.1 | 49 | 6.1 |
| 29 | XI | 74 | 165 | 1.58 | 2.41 | 4.9 | 3.9 | 7.5 | 3.33 | 1.52 | 0.81 | 0.20 | 37 | 7 | 21 | 3.7 | 58 | 5.9 |
| 30 | XI | 63 | 165 | 1.51 | 2.32 | 3.0 | 2.5 | 4.6 | 3.33 | 1.52 | 0.81 | 0.32 | 35 | 7 | 23 | 3.7 | 51 | 5.6 |
| 31 | XII | 85 | 165 | 1.35 | 2.07 | 3.2 | 2.9 | 4.9 | 3.33 | 1.52 | 0.81 | 0.30 | 43 | 9 | 28 | 3.4 | 35 | 4.7 |

TABLE 4

| Ex. No. | Pol Typ | RV | Spin mpm | PDR | HC. C. | RDRd | RDRs | DPFd | DPF 25% | DPFs | H/W | OD |
|---|---|---|---|---|---|---|---|---|---|---|---|---|
| 1 | II | 68 | 1829 | 1.7 | 22 | 1.43 | 2.42 | 3.0 | 2.6 | 5.0 | 3.3 | 2.0 |
| 2 | II | 69 | 2743 | 1.1 | 22 | 1.76 | 2.01 | 2.9 | 2.1 | 3.4 | 3.3 | 2.0 |
| 3 | II | 68 | 2286 | 1.3 | 22 | 1.61 | 2.15 | 3.0 | 2.3 | 4.0 | 3.3 | 2.0 |
| 4 | II | 68 | 1417 | 2.2 | 22 | 1.68 | 3.67 | 2.9 | 2.2 | 6.4 | 3.3 | 2.0 |
| 5 | II | 63 | 1829 | 1.7 | 22 | 1.65 | 2.88 | 3.8 | 2.9 | 6.6 | 3.3 | 2.0 |
| 6 | II | 63 | 1829 | 1.7 | 22 | 1.66 | 2.90 | 3.6 | 2.7 | 6.2 | 3.3 | 2.0 |
| 7 | II | 72 | 1829 | 1.7 | 155 | 1.39 | 2.43 | 2.1 | 1.9 | 3.7 | 1.7 | 1.5 |
| 8 | II | 72 | 2286 | 1.4 | 155 | 1.58 | 2.21 | 2.1 | 1.7 | 2.9 | 1.7 | 1.5 |
| 9 | II | 69 | 2743 | 1.2 | 155 | 1.70 | 1.98 | 2.1 | 1.5 | 2.5 | 1.7 | 1.5 |
| 10 | II | 72 | 1829 | 1.7 | 155 | 1.48 | 2.54 | 2.5 | 2.1 | 4.3 | 1.7 | 1.5 |
| 11 | II | 71 | 1829 | 1.7 | 155 | 1.33 | 2.28 | 1.6 | 1.5 | 2.8 | 1.7 | 1.5 |
| 12 | II | 71 | 1829 | 1.7 | 155 | 1.39 | 2.39 | 1.6 | 1.5 | 2.8 | 1.7 | 1.0 |
| 13 | II | 67 | 1829 | 1.7 | 155 | 1.28 | 2.20 | 1.2 | 1.2 | 2.1 | 1.7 | 1.0 |
| 14 | II | 71 | 1829 | 1.7 | 155 | 1.31 | 2.25 | 1.4 | 1.3 | 2.3 | 1.7 | 1.0 |
| 15 | II | 74 | 1829 | 1.7 | 155 | 1.33 | 2.28 | 1.4 | 1.3 | 2.3 | 1.7 | 1.0 |
| 16 | II | 75 | 1829 | 1.7 | 155 | 1.36 | 2.34 | 1.6 | 1.5 | 2.7 | 1.7 | 1.0 |
| 17 | II | 75 | 1829 | 1.7 | 155 | 1.36 | 2.34 | 1.2 | 1.1 | 2.0 | 1.7 | 1.0 |
| 18 | II | 71 | 1829 | 1.7 | 155 | 1.22 | 2.10 | 1.2 | 1.2 | 2.0 | 3.3 | 1.0 |
| 19 | II | 74 | 1829 | 1.7 | 155 | 1.25 | 2.15 | 1.3 | 1.3 | 2.3 | 3.3 | 1.0 |
| 20 | II | 75 | 1829 | 1.7 | 155 | 1.41 | 2.42 | 1.6 | 1.4 | 2.7 | 3.3 | 1.0 |
| 21 | II | 69 | 1829 | 1.7 | 155 | 1.29 | 2.22 | 1.3 | 1.3 | 2.3 | 3.3 | 0.8 |
| 22 | II | 75 | 1829 | 1.7 | 155 | 1.35 | 2.31 | 1.2 | 1.1 | 2.0 | 3.3 | 0.8 |
| 23 | II | 77 | 2286 | 1.4 | 155 | 1.31 | 1.79 | 0.9 | 0.9 | 1.2 | 3.3 | 0.8 |
| 24 | II | 78 | 2743 | 1.1 | 155 | 1.50 | 1.71 | 1.2 | 1.0 | 1.4 | 3.3 | 0.8 |
| 25 | II | 72 | 3200 | 1.0 | 155 | 1.69 | 1.65 | 1.2 | 0.9 | 1.1 | 3.3 | 0.8 |
| 26 | XIV | 71 | 2286 | 1.3 | 166 | 1.54 | 2.07 | 2.1 | 1.7 | 2.8 | 1.7 | 1.5 |
| 27 | XIV | 71 | 1829 | 1.7 | 167 | 1.38 | 2.30 | 2.1 | 1.9 | 3.4 | 1.7 | 1.5 |
| 28 | XIV | 71 | 1005 | 1.7 | 164 | 1.73 | 3.00 | 3.6 | 2.6 | 6.3 | 1.7 | 1.5 |
| 29 | XIV | 71 | 1189 | 1.5 | 165 | 1.85 | 2.72 | 3.6 | 2.4 | 5.3 | 1.7 | 1.5 |
| 30 | XIV | 75 | 1189 | 1.5 | 165 | 1.94 | 2.84 | 3.6 | 2.3 | 5.3 | 3.3 | 1.0 |
| 31 | XIV | 75 | 1006 | 1.7 | 165 | 1.53 | 2.65 | 2.7 | 2.2 | 4.7 | 3.3 | 1.0 |
| 32 | XIV | 75 | 1829 | 1.7 | 165 | 1.31 | 2.16 | 1.6 | 1.5 | 2.6 | 3.3 | 1.0 |
| 33 | XIV | 75 | 2286 | 1.3 | 165 | 1.50 | 2.02 | 1.5 | 1.3 | 2.1 | 3.3 | 1.0 |

| Ex. No. | EVA /EA | EVA/ DPFs | Vc, % | S, % | Mod gpd | Ten gpd | Eb, % | Tb, g/dd |
|---|---|---|---|---|---|---|---|---|
| 1 | 0.86 | 0.55 | 20 | 8 | — | 3.70 | 43.0 | 5.29 |
| 2 | 0.86 | 0.83 | 26 | 8 | — | 2.60 | 76.0 | 4.58 |
| 3 | 0.86 | 0.70 | 29 | 9 | — | 3.10 | 61.0 | 4.99 |
| 4 | 0.86 | 0.43 | 26 | 8 | — | 3.20 | 68.0 | 5.38 |
| 5 | 0.86 | 0.42 | 21 | 5 | — | 3.20 | 65.0 | 5.28 |
| 6 | 0.86 | 0.45 | 22 | 7 | — | 3.30 | 66.0 | 5.48 |
| 7 | 0.81 | 0.40 | 22 | 7 | 26 | 4.60 | 39.0 | 6.39 |
| 8 | 0.81 | 0.50 | 19 | 7 | 18 | 3.60 | 58.0 | 5.69 |
| 9 | 0.81 | 0.60 | 19 | 8 | 17 | 3.00 | 70.0 | 5.10 |
| 10 | 0.81 | 0.34 | 20 | 6 | 26 | 4.60 | 47.6 | 6.79 |
| 11 | 0.81 | 0.52 | 18 | 8 | 26 | 4.20 | 33.0 | 5.59 |
| 12 | 0.72 | 0.21 | 15 | 7 | 27 | 4.60 | 39.0 | 6.39 |
| 13 | 0.72 | 0.29 | 11 | 7 | 30 | 4.60 | 28.0 | 5.89 |
| 14 | 0.72 | 0.25 | 14 | 7 | 26 | 4.40 | 31.0 | 5.76 |
| 15 | 0.72 | 0.25 | 14 | 7 | 22 | 4.70 | 33.0 | 6.25 |
| 16 | 0.72 | 0.21 | 18 | 7 | 29 | 5.40 | 36.0 | 7.34 |
| 17 | 0.72 | 0.29 | 14 | 7 | 28 | 4.60 | 36.0 | 6.26 |
| 18 | 0.72 | 0.29 | 17 | 8 | 37 | 4.20 | 22.0 | 5.12 |
| 19 | 0.72 | 0.25 | 17 | 8 | 28 | 4.30 | 25.0 | 5.38 |
| 20 | 0.72 | 0.22 | 18 | 8 | 29 | 4.90 | 41.0 | 6.91 |
| 21 | 0.64 | 0.13 | 13 | 8 | 31 | 4.60 | 29.0 | 5.93 |
| 22 | 0.64 | 0.14 | 11 | 8 | 29 | 5.00 | 35.0 | 6.75 |
| 23 | 0.64 | 0.24 | 11 | 8 | 31 | 4.50 | 31.0 | 5.90 |
| 24 | 0.64 | 0.22 | 13 | 7 | 22 | 3.80 | 50.0 | 5.70 |
| 25 | 0.64 | 0.26 | 14 | 5 | 13 | 3.20 | 69.0 | 5.41 |
| 26 | 0.81 | 0.52 | 25 | 6 | 30 | 3.70 | 54.1 | 5.70 |
| 27 | 0.81 | 0.43 | 20 | 6 | 28 | 4.30 | 38.1 | 5.94 |
| 28 | 0.81 | 0.24 | 23 | 5 | 20 | 3.30 | 72.9 | 5.71 |
| 29 | 0.81 | 0.28 | 21 | 5 | 16 | 2.90 | 85.1 | 5.37 |
| 30 | 0.72 | 0.11 | 14 | 4 | 16 | 3.10 | 93.8 | 6.01 |
| 31 | 0.72 | 0.13 | 12 | 5 | 28 | 2.95 | 52.7 | 4.50 |
| 32 | 0.72 | 0.23 | 14 | 6 | 34 | 4.40 | 30.5 | 5.74 |
| 33 | 0.72 | 0.28 | 16 | 7 | 18 | 3.70 | 50.4 | 5.56 |

TABLE 5

| ITEM No. | Pol Typ | RV | Tp, c | Qa mpm | Spin mpm | PDR | HC. C. | RDRd | RDRs | DPFd | DPF 25% | DPFs | S, % | Mod g/d | Ten g/d | Eb, % |
|---|---|---|---|---|---|---|---|---|---|---|---|---|---|---|---|---|
| 1 | I | 60 | 315 | 11 | 1330 | 2.3 | 160 | 1.61 | 3.78 | 2.9 | 2.2 | 6.8 | 6 | 20 | 4.6 | 61 |
| 2 | I | 63 | 293 | 11 | 1330 | 2.3 | 160 | 1.46 | 3.42 | 3.1 | 2.6 | 7.1 | 7 | 38 | 4.8 | 46 |
| 3 | I | 74 | 293 | 11 | 1330 | 2.3 | 160 | 1.39 | 3.18 | 3.1 | 2.8 | 7.1 | 7 | 34 | 5.0 | 39 |
| 4 | X | 56 | 290 | 18 | 1126 | 2.8 | 169 | 1.37 | 3.80 | 2.1 | 1.9 | 5.7 | 7 | 32 | 5.7 | 37 |
| 5 | X | 56 | 290 | 18 | 1417 | 2.3 | 169 | 1.43 | 3.22 | 2.0 | 1.8 | 4.6 | 6 | 32 | 4.8 | 43 |
| 6 | X | 56 | 290 | 18 | 1829 | 1.8 | 169 | 1.53 | 2.72 | 2.0 | 1.6 | 3.6 | 5 | 26 | 4.5 | 53 |
| 7 | X | 55 | 290 | 18 | 2743 | 1.2 | 169 | 1.78 | 2.16 | 1.9 | 1.4 | 2.4 | 4 | 11 | 3.7 | 78 |
| 8 | II | 66 | 290 | 18 | 1829 | 1.8 | 169 | 1.48 | 2.61 | 2.1 | 1.7 | 3.6 | 6 | 28 | 4.5 | 48 |
| 9 | II | 62 | 290 | 18 | 1417 | 2.2 | 169 | 1.34 | 3.01 | 2.0 | 1.9 | 4.5 | 7 | 33 | 5.2 | 34 |
| 10 | II | 66 | 290 | 18 | 2743 | 1.2 | 169 | 1.76 | 2.09 | 2.1 | 1.5 | 2.5 | 5 | 11 | 3.3 | 76 |
| 11 | II | 68 | 290 | 18 | 2743 | 1.1 | 169 | 1.83 | 2..07 | 2.1 | 1.4 | 2.4 | 4 | 12 | 3.0 | 83 |
| 12 | II | 67 | 290 | 18 | 1829 | 1.7 | 22 | 1.55 | 2.63 | 2.1 | 1.7 | 3.5 | 7 | 39 | 4.3 | 55 |
| 13 | X | 59 | 290 | 18 | 1829 | 1.8 | 155 | 1.57 | 2.79 | 2.0 | 1.6 | 3.6 | 5 | 21 | 4.2 | 57 |
| 14 | II | 77 | 290 | 18 | 1829 | 1.8 | 155 | 1.45 | 2.56 | 2.0 | 1.7 | 3.5 | 7 | 22 | 4.8 | 45 |
| 15 | X | 56 | 289 | 23 | 1829 | 1.7 | 155 | 1.63 | 2.84 | 2.1 | 1.6 | 3.7 | 5 | 20 | 4.1 | 63 |

TABLE 6

| Ex. No. | Pol Typ | RV | Spin mpm | PDR | RDRd | RDRs | DPFd | DPF 25% | DPFs | H/W | EVA /EA | EVA/ DPFs | Vc, % | S, % | Mod gpd | Ten gpd | Eb, % | Tb, g/dd |
|---|---|---|---|---|---|---|---|---|---|---|---|---|---|---|---|---|---|---|
| 1 | I | 69 | 1829 | 1.7 | 1.48 | 2.45 | 3.8 | 3.2 | 6.3 | 1.33 | 0.86 | 0.44 | 32 | 8 | 7 | 2.3 | 48 | 3.4 |
| 2 | 11 | 70 | 1829 | 1.6 | 1.66 | 2.72 | 3.8 | 2.8 | 6.2 | 1.33 | 0.86 | 0.45 | 40 | 9 | 11 | 2.8 | 66 | 4.6 |
| 3 | II | 75 | 2743 | 1.1 | 1.65 | 1.80 | 3.8 | 2.9 | 4.2 | 1.33 | 0.86 | 0.66 | 44 | — | 11 | 2.9 | 65 | 4.8 |
| 4 | II | 73 | 3109 | 1.0 | 1.70 | 1.64 | 3.8 | 2.8 | 3.7 | 1.33 | 0.86 | 0.75 | 44 | — | 11 | 2.9 | 70 | 4.9 |
| 5 | 11 | 75 | 1417 | 2.2 | 1.54 | 3.35 | 4.6 | 3.8 | 10.1 | 1.33 | 0.86 | 0.28 | 37 | — | 17 | 3.7 | 54 | 5.7 |
| 6 | II | 72 | 1829 | 1.6 | 1.37 | 2.24 | 4.6 | 4.2 | 7.6 | 1.33 | 0.86 | 0.37 | 41 | — | 27 | 4.3 | 37 | 5.9 |
| 7 | II | 71 | 1829 | 1.7 | 1.57 | 2.65 | 4.6 | 3.7 | 7.8 | 1.33 | 0.86 | 0.36 | 38 | — | 16 | 3.3 | 57 | 5.2 |
| 8 | II | 65 | 1417 | 2.2 | — | — | 4.6 | — | 10.1 | 1.33 | 0.86 | 0.28 | 35 | — | — | — | — | — |
| 9 | VII | 74 | 2286 | 1.4 | 1.64 | 2.35 | 6.8 | 5.2 | 9.7 | 1.33 | 0.86 | 0.29 | 53 | — | 11 | 3.1 | 64 | 5.1 |
| 10 | VII | 75 | 2286 | 1.5 | 1.61 | 2.34 | 20.3 | 16 | 29.4 | 1.33 | 0.86 | 0.09 | 56 | — | 9 | 2.2 | 61 | 3.5 |
| 11 | VII | 73 | 2286 | 1.4 | 1.55 | 2.16 | 3.2 | 2.6 | 4.5 | 1.33 | 0.86 | 0.62 | 37 | — | 16 | 3.1 | 55 | 4.8 |

TABLE 7

| Ex. No. | Pol Typ | RV | Tp. C | Spin mpm | PDR | HC. C | RDRd | RDRs | DPFd | DPF 25% | DPFs | EVA/ DPFs | Vc, % | S, % | Mod gpd | Ten gpd | Eb, % | Tb, g/dd |
|---|---|---|---|---|---|---|---|---|---|---|---|---|---|---|---|---|---|---|
| 1 | XIV | 71 | 293 | 1829 | 1.7 | 165 | 1.40 | 2.35 | 1.0 | 0.9 | 1.7 | 0.39 | 13 | 6 | 37 | 5.3 | 40 | 7.4 |
| 2 | XIV | 72 | 296 | 2286 | 1.3 | 165 | 1.65 | 2.21 | 1.2 | 0.9 | 1.6 | 0.41 | 14 | 5 | 32 | 4.0 | 65 | 6.6 |
| 3 | XIV | 74 | 293 | 1189 | 1.5 | 165 | 2.03 | 2.97 | 2.1 | 1.3 | 3.0 | 0.22 | 18 | 4 | 15 | 2.9 | 103 | 5.9 |
| 4 | XIV | 75 | 296 | 1829 | 1.7 | 165 | 1.38 | 2.31 | 1.2 | 1.1 | 2.0 | 0.33 | 21 | 5 | 33 | 4.6 | 38 | 6.3 |

TABLE 8

| Ex. No. | Pol Typ | RV | Spin mpm | PDR | HC. C. | RDRd | RDRs | DPFd | DPF 25% | DPFs | OD |
|---|---|---|---|---|---|---|---|---|---|---|---|
| 1 | XIII | 81 | 2012 | 1.5 | 166 | 1.43 | 2.21 | 3.2 | 2.8 | 5.0 | 2.03 |
| 2 | XIII | 80 | 2012 | 1.5 | 168 | 1.48 | 2.29 | 3.2 | 2.7 | 4.9 | 1.52 |
| 3 | XIII | 79 | 2012 | 1.8 | 165 | 1.76 | 3.15 | 3.2 | 2.3 | 5.8 | 1.52 |
| 4 | XIV | 79 | 3200 | 1.1 | 170 | 1.78 | 1.91 | 2.9 | 2.0 | 3.1 | 1.52 |
| 5 | XIV | 77 | 2972 | 1.1 | 169 | 1.81 | 1.98 | 3.1 | 2.1 | 3.4 | 1.52 |
| 6 | XIV | 77 | 2743 | 1.2 | 169 | 1.79 | 2.09 | 3.1 | 2.2 | 3.7 | 1.52 |
| 7 | XIV | 77 | 2286 | 1.4 | 169 | 1.60 | 2.18 | 3.2 | 2.5 | 4.4 | 1.52 |

TABLE 8-continued

| Ex. No. | EVA/ EA | EVA/ DPFs | Vc, % | S, % | Mod gpd | Ten gpd | Eb, % | Tb, g/dd |
|---|---|---|---|---|---|---|---|---|
| 1 | 0.86 | 0.55 | 39 | 8 | 21 | 3.7 | 43 | 5.3 |
| 2 | 0.81 | 0.30 | 37 | 7 | 24 | 4.0 | 48 | 5.9 |
| 3 | 0.81 | 0.26 | 37 | 5 | 25 | 3.0 | 76 | 5.2 |
| 4 | 0.81 | 0.47 | 36 | 5 | 14 | 3.0 | 78 | 5.3 |
| 5 | 0.81 | 0.44 | 34 | 5 | 27 | 3.2 | 81 | 5.8 |
| 6 | 0.81 | 0.40 | 34 | 6 | 14 | 3.3 | 79 | 5.8 |
| 7 | 0.81 | 0.34 | 35 | 6 | 20 | 3.7 | 60 | 5.8 |

TABLE 9

| EX. NO. | NYLON RV | SPIN MPM | PDR | VC | RDR SPUN | RDR DRAWN | CPI % | CS D100 | CS D010 | Vx A | Vx, B | COA | Fc | Isaxo | LPS SAXS |
|---|---|---|---|---|---|---|---|---|---|---|---|---|---|---|---|
| 1 | 74.4 | 3109 | 1.029 | 0.10 | 1.920 | 1.860 | 71.1 | 59.0 | 38.0 | 135193 | 106158 | 25.6 | 0.716 | 1510 | 90.0 |
| 2 | 74.4 | 2743 | 1.130 | 0.12 | 1.950 | 1.730 | 66.3 | 57.0 | 36.0 | 116861 | 92954 | 22.4 | 0.751 | 928 | 85.0 |
| 3 | 72.0 | 2286 | 1.340 | 0.14 | 2.210 | 1.648 | 60.7 | 50.0 | 33.0 | 90762 | 67023 | 19.3 | 0.786 | 191 | 82.1 |
| 4 | 72.0 | 3109 | 1.028 | 0.16 | 1.860 | 1.810 | 71.5 | 63.0 | 37.0 | 140559 | 112542 | 26.3 | 0.708 | 1398 | 90.0 |
| 5 | 73.5 | 1189 | 1.467 | 0.17 | 2.970 | 2.030 | 70.0 | 56.0 | 33.0 | 102024 | 79443 | 21.6 | 0.760 | 238 | 82.4 |
| 6 | 76.0 | 1330 | 2.289 | 0.23 | 3.090 | 1.354 | 68.9 | 54.0 | 31.5 | 110320 | 70155 | 14.4 | 0.840 | 68 | 96.8 |
| 7 | 75.4 | 1829 | 1.675 | 0.20 | 2.310 | 1.380 | 61.6 | 50.0 | 30.0 | 82712 | 58095 | 14.2 | 0.842 | 77 | 82.3 |
| 8 | 71.0 | 1829 | 1.666 | 0.20 | 2.070 | 1.381 | 65.8 | 65.0 | 32.0 | 116923 | 94863 | 18.7 | 0.792 | 136 | 83.9 |
| 9 | 71.1 | 2743 | 1.130 | 0.20 | 2.000 | 1.770 | 66.6 | 59.0 | 36.0 | 123808 | 97889 | 22.6 | 0.749 | 876 | 87.0 |
| 10 | 71.0 | 1372 | 2.223 | 0.21 | 2.600 | 1,168 | 69.5 | 58.0 | 31.0 | — | 76240 | 12.9 | 0.857 | 65 | — |
| 11 | 71.4 | 2290 | 1.345 | 0.25 | 2.070 | 1.541 | 59.7 | 59.0 | 34.0 | 117602 | 89846 | 23.3 | 0.741 | 200 | 87.5 |
| 12 | 82.0 | 2286 | 1.314 | 0.38 | 1.860 | 1.420 | 76.7 | 76.0 | 41.0 | 204597 | 173939 | 26.5 | 0.706 | 789 | 98.0 |
| 13 | 82.0 | 1646 | 1.804 | 0.39 | 2.390 | 1.330 | 74.6 | 59.0 | 34.0 | 123650 | 89846 | 18.8 | 0.791 | 352 | 92.0 |
| 14 | 77.0 | 1420 | 2.094 | 0.41 | 2.400 | 1.150 | 63.9 | 48.0 | 32.0 | 100030 | 60199 | 19.0 | 0.789 | 70 | 97.2 |
| 15 | 82.0 | 1330 | 2.289 | 0.41 | 2.700 | 1.180 | 72.6 | 52.0 | 33.0 | 96576 | 71065 | 16.1 | 0.821 | 170 | 84.0 |
| 16 | 76.0 | 2743 | 1.130 | 0.42 | 1.870 | 1.650 | 72.9 | 82.0 | 45.0 | 272200 | 224150 | 30.0 | 0.667 | 785 | 110.1 |
| 17 | 78.0 | 3110 | 0.997 | 0.42 | 1.670 | 1.670 | 79.0 | 73.0 | 43.5: | 165952 | 178944 | 26.8 | 0.702 | 2332 | 78.0 |
| 18 | 76.0 | 1830 | 1.628 | 0.43 | 2.180 | 1.340 | 68.1 | 58.5 | 37.5 | 141102 | 102750 | 27.4 | 0.696 | 146 | 96.0 |
| 19 | 82.2 | 3109 | 0.997 | 0.44 | 1.650 | 1.650 | 82.3 | 74.0 | 42.0 | 212401 | 173269 | 26.5 | 0.706 | 1710 | 102.0 |
| 20 | 76.0 | 2290 | 1.314 | 0.47 | 1.950 | 1.490 | 74.0 | 64.0 | 42.0 | 169470 | 139362 | 24.8 | 0.724 | 400 | 94.1 |
| 21 | 78.2 | 2290 | 1.372 | 0.25 | 1.950 | 1.419 | 58.2 | — | — | — | — | 21.7 | 0.759 | 128 | — |
| 22 | 74.7 | 1829 | 1.688 | 0.29 | 2.260 | 1.339 | 61.1 | — | — | — | — | 14.1 | 0.843 | 54 | — |
| 23 | 51.5 | 1829 | 1.733 | 0.00 | 2.740 | 1.580 | 69.4 | 63.0 | 34.0 | 126866 | 99135 | 15.9 | 0.823 | 92 | 88.4 |
| 24 | 50.4 | 1829 | 1.692 | 0.00 | 2.510 | 1.490 | 74.9 | 72.0 | 33.0 | 150118 | 115816 | 13.2 | 0.853 | 111 | 94.3 |
| 25 | 50.6 | 1829 | 1.692 | 0.00 | 2.680 | 1.580 | 71.9 | 65.0 | 35.0 | 137030 | 108511 | 16.6 | 0.816 | 123 | 89.9 |
| 26 | 65.0 | 5300 | 1.000 | 0.00 | 2.180 | 2.180 | 73.2 | 67.0 | 34.0 | 143926 | 108725 | 17.7 | 0.800 | 829 | 94.3 |
| 27 | 65.0 | 5300 | 1.000 | 0.00 | 1.766 | 1.766 | 66.3 | 61.2 | 37.2. | 138807 | 108628 | 22.8 | 0.747 | 433 | 91.0 |
| 28 | 42.0 | 5000 | 1.000 | 0.00 | 1.589 | 1.589 | 69.3 | — | — | — | — | 18.6 | 0.793 | 365 | 65.8 |
| 29 | 42.0 | 6500 | 1.000 | 0.00 | 1.534 | 1.538 | 60.6 | — | — | — | — | 17.1 | 0.615 | 360 | 79.7 |
| 30 | 42.0 | 7500 | 1.000 | 0.00 | 1.453 | 1.453 | 70.5 | — | — | — | — | 17.1 | 0.615 | 490 | 86.0 |
| 31 | 66.2 | 3500 | 1.000 | 0.00 | 2.218 | 2.218 | 2.2 | 45.1 | 27.4 | — | 43440 | 17.5 | 0.917 | 363 | — |
| 32 | 44.3 | 3500 | 1.000 | 0.00 | 2.109 | 2.218 | 62.4 | 44.7 | 25.8 | — | 39164 | 16.9 | 0.923 | 226 | — |
| 33 | 65.0 | 5300 | 1.000 | 0.00 | 1.761 | 1.761 | 59.6 | 59.6 | 37.2 | 114381 | 104396 | 29.1 | 0.788 | — | 77.0 |
| 34 | 65.0 | 5300 | 1.080 | 0.00 | 1.761 | 1.631 | 64.9 | 56.3 | 39.1 | 119466 | 103283 | 23.0 | 0.856 | — | 81.0 |
| 35 | 65.0 | 5300 | 1.110 | 0.00 | 1.600 | 1.441 | 68.3 | 58.4 | 39.7 | 132037 | 111636 | 21.1 | 0.843 | — | 85.0 |
| 36 | 65.0 | 5300 | 1.170 | 0.00 | 1.561 | 1.338 | 65.6 | 51.1 | 37.5 | 111698 | 83884 | 24.5 | 0.839 | — | 87.0 |
| 37 | 65.0 | 5300 | 1.277 | 0.00 | 1.507 | 1.176 | 53.9 | 46.5 | 35.1 | 97325 | 65939 | 19.9 | 0.890 | — | 89.0 |

TABLE 10

| Item | Pol Typ | RV | Tp, C | Qa mpm | PDR | HC. °C. | RDRd | RDRs | DPFd | DPF 25% | DPFs |
|---|---|---|---|---|---|---|---|---|---|---|---|
| 1 | XI | 78 | 292 | 19 | 1.5 | 165 | 1.44 | 2.13 | 1.2 | 1.0 | 1.8 |
| 2 | XI | 81 | 293 | 27 | 1.5 | 165 | 1.52 | 2.35 | 4.4 | 3.7 | 6.9 |

| Item | H/W | OD | EVA /EA | EVA/ DPFs | Vc, % | S, % | Mod gpd | Ten gpd | Eb, % | $(TB)_n$, g/dd |
|---|---|---|---|---|---|---|---|---|---|---|
| 1 | 6.00 | 0.76 | 0.69 | 0.18 | 22 | 7 | 24 | 4.4 | 44 | 6.3 |
| 2 | 1.67 | 1.52 | 0.81 | 0.21 | 25 | 6 | 23 | 3.6 | 52 | 5.5 |

TABLE 11

| Fabric Item | Fill Yarn | Picks Per In. | Calendar Tons | Calender Temp °F. | Weight Oz./Yd. | Thick In. × $10^{-4}$ | Air Perm. cmf |
|---|---|---|---|---|---|---|---|
| 1 | Hollow | 64 | 0 | — | 3.75 | 77 | 9.43 |
| 2 | Hollow | 56 | 0 | — | 3.62 | 72 | 14.60 |
| 3 | Holow | 50 | 0 | — | 3.40 | 68 | 16.40 |
| 4 | Solid | 50 | 0 | — | 3.63 | 68 | 19.90 |
| 5 | Solid | 56 | 0 | — | 3.86 | 76 | 16.80 |
| 6 | Solid | 60 | 0 | — | 4.03 | 78 | 13.50 |
| 7 | Hollow | 64 | 50 | 70 | 3.75 | 72 | 2.52 |
| 8 | Hollow | 56 | 50 | 70 | 3.62 | 69 | 4.94 |
| 9 | Hollow | 50 | 50 | 70 | 3.40 | 65 | 6.92 |
| 10 | Solid | 50 | 50 | 70 | 3.63 | 68 | 11.79 |
| 11 | Solid | 56 | 50 | 70 | 3.86 | 72 | 8.05 |
| 12 | Solid | 60 | 50 | 70 | 4.03 | 73 | 5.14 |

TABLE 12

| Fabric Item | Hollow Fill Yarn | Dyed | Calendared | Washed | Calendar Temp. °F. | Air Perm. cmf |
|---|---|---|---|---|---|---|
| 1 | Yes | No | Yes | No | 70 | 22.8 |
| 2 | Yes | No | Yes | Yes | 70 | 15.8 |
| 3 | No | No | Yes | No | 70 | 28.9 |
| 4 | No | No | Yes | Yes | 70 | 19.6 |

TABLE 13

| Fabric Item | Hollow Fill Yarn | Dyed | Calendered | Calender Temp °F. | Air Perm. cfm Before Washing | Air Perm. cfm After Washing |
|---|---|---|---|---|---|---|
| 1 | Yes | Yes | No | — | 32.1 | 25.3 |
| 2 | Yes | Yes | Yes | 70 | 16.1 | 24.0 |
| 3 | Yes | Yes | Yes | 220 | 4.3 | 22.1 |
| 4 | Yes | Yes | Yes | 280 | 4.3 | 21.3 |
| s | Yes | Yes | Yes | 280 | 2.8 | 13.7 |
| 6 | Yes | Yes | Yes | 220 | 3.1 | 14.6 |
| 7 | Yes | Yes | Yes | 320 | 4.3 | 11.4 |
| 8 | Yes | Yes | Yes | 320 | 4.2 | 10.6 |
| 9 | Yes | Yes | Yes | 360 | 5.1 | 9.7 |
| 10 | No | Yes | No | — | 45.9 | 28.3 |
| 11 | No | Yes | Yes | 70 | 28.3 | 24.1 |
| 12 | No | Yes | Yes | 280 | 5.2 | 15.1 |
| 13 | No | Yes | Yes | 260 | 2.5 | 4.9 |

What is claimed is:

1. Hollow filaments comprised of nylon polymer with a relative viscosity (RV) of at least 50 and a melting point ($T_M$) between 210° C. and 310° C., said filaments having a denier per filament (dpf) such that the denier per filament at 25% elongation $(dpf)_{25}$ is about 0.5 to about denier 20 and having at least one longitudinal void such that the fractional void content (VC) is at least $[(7.5Log_{10}(dpf)+10)/100]$, said filaments having a residual draw ratio (RDR) of about 1.2 to about 2.25 and a small-angle x-ray scattering intensity ($I_{saxs}$) of at least 175 pulses normalized for one hour collection time.

2. The filaments according to claim 1 wherein said filaments have a fractional void content (VC) at least $[(7.5Log_{10}(dpf)+15)/100]$.

3. The filaments according to claim 1 wherein said filaments have a wide angle x-ray scattering crystalline orientation angle ($COA_{waxs}$) of at least 20 degrees.

4. The filaments according to claim 1 wherein said filaments have a normalized tenacity at break of at least 4 g/dd.

5. The filaments according to claim 4 wherein said filaments have a normalized tenacity at break of at least the value of the expression $\{4\cdot[(1-\sqrt{VC})/(1+\sqrt{VC})]+3\}$, wherein VC is the fractional void content of said filaments.

6. The filaments according to claim 1 wherein said residual draw ratio (RDR) is about 1.6 to about 2.25.

7. The filaments according to claim 1 wherein said residual draw ratio (RDR) is about 1.2 to about 1.6.

8. A yarn comprised of the filaments of claim 7 wherein said yarn is bulked.

9. The filaments according to claim 1 wherein said nylon polymer has a melting point of about 240° C. to about 310° C.

10. The filaments according to claim 1 wherein said nylon polymer contains a sufficient quantity of at least one bi-functional comonomer to provide a filament boil-off shrinkage (S) of at least 12%.

11. The filaments according to claim 1 wherein said hollow filaments comprise a longitudinal void asymmetric with respect to the center of said filament cross-section such that the filaments will self helical crimp on exposure to heat.

12. The filaments of claim 1 wherein said nylon polymer is comprised of about 30 to about 70 amine-end equivalents per $10^6$ grams of nylon polymer and said hollow filaments have an acid dye transition temperature ($T_{dye}$) of less than 65° C.

13. The filaments of claim 1 wherein said nylon polymer has a relative viscosity of at least 60.

14. A yarn comprising filaments according to claim 7 wherein said filaments have differing shrinkages with at least some of said filaments being higher shrinkage filaments having a boil-off shrinkage (S) of at least 12% and at least some of said filaments being lower shrinkage filaments having a boil-off shrinkage of less than 12%, the difference in shrinkage between at least some of said higher shrinkage filaments and at least some of said lower shrinkage filaments being at least about 5%.

* * * * *